US006809469B1

(12) United States Patent
Ito et al.

(10) Patent No.: US 6,809,469 B1
(45) Date of Patent: Oct. 26, 2004

(54) SPACER STRUCTURE HAVING A SURFACE WHICH CAN REDUCE SECONDARIES

(75) Inventors: Nobuhiro Ito, Sagamihara (JP); Hideaki Mitsutake, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/413,774

(22) Filed: Oct. 7, 1999

(30) Foreign Application Priority Data

Oct. 7, 1998 (JP) ..... 10-285759
Feb. 26, 1999 (JP) ..... 11-051547
Oct. 4, 1999 (JP) ..... 11-283439

(51) Int. Cl.[7] ..... H01J 1/62; H01J 63/04

(52) U.S. Cl. ..... 313/495; 313/422; 313/292; 313/497; 313/257; 313/258; 315/169.1; 315/169.4; 445/24

(58) Field of Search ..... 313/422, 495, 313/292, 309, 310, 258, 496, 497; 315/169.1, 164.4; 455/24

(56) References Cited

U.S. PATENT DOCUMENTS

| | | | | | |
|---|---|---|---|---|---|
| 4,181,870 | A | * | 1/1980 | Stevens | 313/414 |
| 4,904,895 | A | | 2/1990 | Tsukamoto et al. | 313/336 |
| 5,029,314 | A | | 7/1991 | Katsumi et al. | 355/208 |
| 5,066,883 | A | | 11/1991 | Yoshioka et al. | 313/309 |
| 5,523,834 | A | | 6/1996 | Ito | 355/315 |
| 5,561,340 | A | * | 10/1996 | Jin et al. | 313/309 |
| 5,598,056 | A | * | 1/1997 | Jin et al. | 313/309 |
| 5,704,820 | A | * | 1/1998 | Chandross et al. | 445/24 |
| 5,726,529 | A | * | 3/1998 | Dean et al. | 313/495 |
| 5,729,802 | A | | 3/1998 | Hirabayashi et al. | 399/174 |
| 5,760,538 | A | | 6/1998 | Mitsutake et al. | 313/422 |
| 5,811,919 | A | * | 9/1998 | Hoogsteen et al. | 313/422 |
| 5,939,822 | A | * | 8/1999 | Alderson | 313/493 |
| 5,970,285 | A | | 10/1999 | Ito et al. | 399/149 |
| 5,995,786 | A | | 11/1999 | Ito | 399/150 |
| 6,005,540 | A | | 12/1999 | Shinjo et al. | 345/74 |
| 6,153,973 | A | | 11/2000 | Shibata et al. | 313/495 |
| 6,222,313 | B1 | * | 4/2001 | Smith et al. | 313/495 |
| 6,236,157 | B1 | * | 5/2001 | Pan et al. | 313/495 |

FOREIGN PATENT DOCUMENTS

| | | | | |
|---|---|---|---|---|
| EP | 725418 A1 | * | 8/1996 | H01J/29/82 |
| EP | 0 851 458 | | 1/1998 | |
| EP | 405262 | * | 1/1999 | H01J/31/12 |
| JP | 64-31332 | | 2/1989 | |
| JP | 2-257551 | | 10/1990 | |
| JP | 3-55738 | | 3/1991 | |
| JP | 4-28137 | | 1/1992 | |
| JP | 8-180821 | | 7/1996 | |
| JP | 10-144203 | | 5/1998 | |

OTHER PUBLICATIONS

W. P. Dyke et al, "Field Emission", Advances in Electronics and Electron Physics. 1956. vol. VIII, pp. 89–185.

(List continued on next page.)

*Primary Examiner*—Nimeshkumar D. Patel
*Assistant Examiner*—Sikha Roy
(74) *Attorney, Agent, or Firm*—Fitzpatrick, Cella, Harper & Scinto

(57) ABSTRACT

A spacer on which static electricity is restricted and an electron beam apparatus in which the spacer is provided. In the electron beam apparatus comprising an electron source provided with electron emission devices, a face plate provided with anodes and spacers installed between the electron source and the face plate, unevenness is formed on the surface of the spacer substrate, and further a thin film which has a smaller thickness than a roughness. This makes possible the restriction of incident angle multiplication coefficient for the primary electrons whose energy is lower than the second cross-point energy of a resistive film. The electron beam apparatus provided with the above spacer is excellent in display definition and long-term reliability since the displacement of light emission points and the creeping discharge accompanying the static electricity can be restricted due to the spacer.

25 Claims, 30 Drawing Sheets

OTHER PUBLICATIONS

C. A. Mead, "Operation of Tunnel–Emission Devices" Journal of applied Physics, Apr. 1961, vol. 32, No. 4, pp. 646–652.

G. Dittmer, "Electrical Conduction and Electron Emission of Discontinuous Thin Films", Thin Solid Films, 1972, pp. 317–328.

M. Hartwell et al., "Strong Electron Emission From Patterned Tin–Indium Oxide Thin Films", IEDM Technical Digest, 1975, pp. 519–521.

M. I. Elinson et al., "The Emission of Hot Electrons and the Field Emission of Electrons from Tin Oxide", Radio Engineering and Electronic Physics, Jul. 1965, pp. 1290–1296.

C. A. Spindt et al., "Physical Properties of Thin–Film Field Emission Cathodes with Molybdenum Cones", Journal of Applied Physics, Dec. 1976, vol. 47, No. 12, pp. 5248–5263.

H. Araki et al., "Electroforming and Electron Emission of Carbon Thin Films", Journal of the Vaccum Society of Japan, Jan. 1983, vol. 26, No. 1, pp. 22–29.

R. Meyer, "Recent Development of 'Microtips' Display at Leti", Technical Digest of IVMC 91, 1991, pp. 6–9.

* cited by examiner

FIG. 15

INCIDENT ANGLE DEPENDENCY OF SECONDARY ELECTRON EMISSION COEFFICIENT $$\frac{\delta\theta}{\delta 0}=\frac{1-\left\{1-\frac{m_0\cos\theta}{1+(m1)^{-1}\times(m_0\cos\theta)^{m2}}\right\}\exp(-m_0\cos\theta)}{1-\left\{1-\frac{m_0}{1+(m1)^{-1}\times m_0^{m2}}\right\}\exp(-m_0)}\times\frac{1}{\cos\theta}$$

m1=0.68273, m2=0.86212

CALCULATION OF $\delta$ INCIDENT ANGLE DEPENDENCY COEFFICIENT m0 AND INCIDENT ANGLE MULTIPLICATION EFFECT

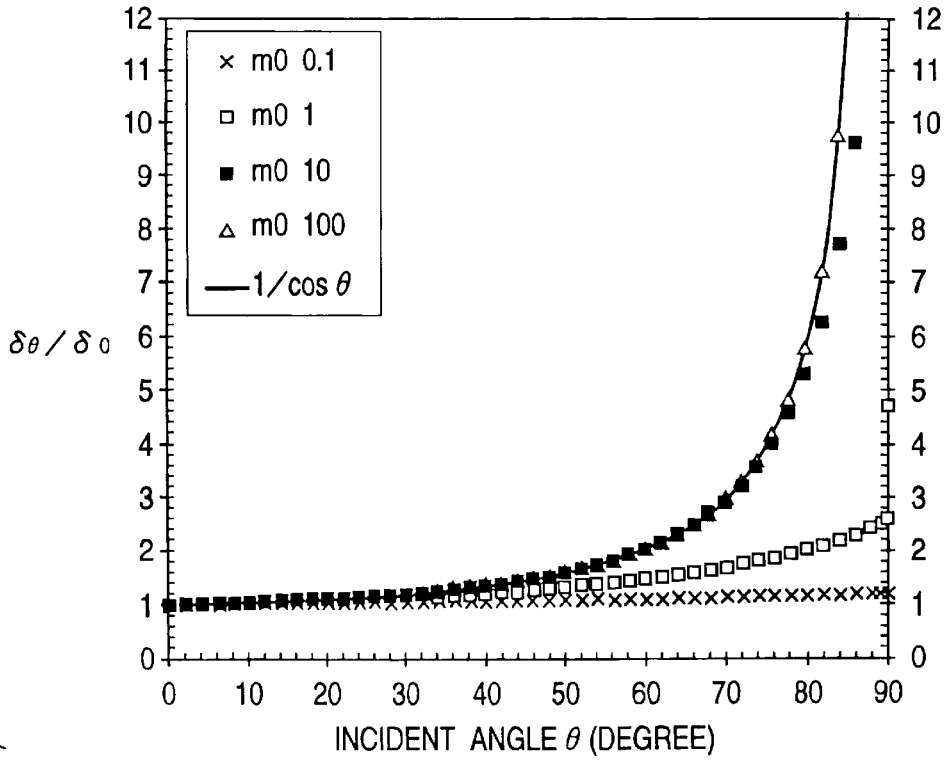

SPACER STRUCTURE HAVING A SURFACE WHICH CAN REDUCE SECONDARIES

BACKGROUND OF THE INVENTION

1. Field of the Invention

The present invention relates to an electron beam apparatus and an image producer as an application thereof, such as an image display and the like. The present invention also relates to a spacer for use in the electron beam apparatus.

2. Related Background Art

There are two types of electron emission devices currently known: a hot cathode device and a cold cathode device. As to the latter, the known devices include, for example, surface conduction electron emission devices, field emission devices (hereinafter referred to as an FE type) and metal-insulating layer-metal type electron emission devices (hereinafter referred to as an MIM type).

The surface conduction electron emission devices currently known include, for example, one disclosed by M. I. Elinson in Radio Eng. Electron Phys., 10, 1290, (1965), and the others described below.

The surface conduction electron emission devices take advantage of the phenomenon that electron emission occurs on the thin film of a small area formed on the, substrate when applying electric current parallel to the surface of the film. There are several types of surface conduction electron emission devices reported, in addition to the aforesaid device by Elinson et al. which utilizes $SnO_2$ thin film: one utilizing Au thin film (refer to G. Dittmer: "Thin Solid Films," 9, 317 (1972)), one utilizing $In_2O_3/SnO_2$ thin film (refer to M. Hartwell and C. G. Fonstad: "IEEE Trans. ED Conf.," 519 (1975)), and one utilizing carbon thin film (refer to Hisashi Araki et al. "Vacuum," Vol. 26, No. 1, 22 (1983)).

FIG. 33 shows a plan view of the aforementioned device by M. Hartwell et al. as a typical example illustrating the construction of the surface conduction electron emission devices. In the figure, reference numeral 3001 designates a substrate and numeral 3004 designates a conductive thin film consisting of metal oxide and formed by sputtering. The conductive thin film 3004 is in the form of an H-shaped plan as shown in the figure. An electron emission portion 3005 is formed by conducting an energization treatment, known as energization forming which is to be described below, to the above conductive thin film 3004. The spacings L and W in the figure are set for 0.5 to 1 [mm] and 0.1 [mm], respectively. For convenience's sake, in the above figure the electron emission portion 3005 is shown in the center of the conductive thin film 3004 in the form of a rectangle. The figure is, however, very schematic and does not necessarily represent the actual position and form of the electron emission portion.

In the aforesaid surface conduction electron emission devices, including one by M. Hartwell, it has been common that the electron emission portion 3005 is formed by conducting an energization treatment, called energization forming, to the conductive thin film 3004 prior to the execution of electron emission. Energization forming used herein means that a constant direct-current voltage or a direct-current voltage stepping up at a very slow rate of, for example, about 1 V/min is applied to both ends of the conductive thin film 3004 to pass a current therethrough and cause a local fracture, deformation or change in quality therein, so as to form the electron emission portion 3005 in a highly resistive state. In some part of the conductive thin film 3004 having undergone a local fracture, deformation or change in quality, a crack is to appear. When applying a proper voltage to the conductive thin film 3004 after the above energization forming, electric emission occurs in the vicinity of the above crack.

The known FE type devices include, for example, one disclosed by W. P. Dyke & W. W. Dolan in "Field Emission," Advance in Electron Physics, 8, 89 (1956) and one disclosed by C. A. Spindt in "Physical Properties of Thin-Film Field Emission Cathodes with Molybdenium cones," J. Appl. Phys., 47, 5248 (1976).

FIG. 34 shows a sectional view of the aforementioned device by C. A. Spindt et al. as a typical example illustrating the configuration of FE type devices. In the figure, reference numeral 3010 designates a substrate, numeral 3011 an emitter wiring consisting of a conductive material, numeral 3012 an emitter cone, numeral 3013 an insulating layer and numeral 3014 a gate electrode. In this device, field emission is caused at the tip portion of the emitter cone 3012 by applying a proper voltage between the emitter cone 3012 and the gate electrode 3014.

There is another example of the construction of FE type devices where, unlike the laminated structure shown in FIG. 34, an emitter and a gate electrode are arranged on the substrate almost parallel to the substrate plane.

The known MIM type devices include, for example, one disclosed by C. A. Mead in "Operation of Tunnel-Emission Devices," J. Appl. Phys., 32, 646 (1961). FIG. 35 shows a typical example of the construction of MIM type devices. The figure is a sectional view, in which reference numeral 3020 designates a substrate numeral 3021 a lower electrode consisting of metal, numeral 3022 a thin insulating layer about 100 Å thick and numeral 3023 an upper electrode about 80 to 300 Å thick consisting of metal. In MIM type devices, electron emission is caused on the surface of the upper electrode 3023 by applying a proper voltage between the upper electrode 3023 and the lower electrode 3021.

The aforementioned cold cathode devices do not need a heater for heating their cathode since they allow electron emission to occur at a lower temperature than hot cathode devices. Accordingly, their structure can be simpler than that of hot cathode devices, which allows fine devices to be produced. Further, when multiple devices are densely arranged, problems such as melting substrate by heat and the like are unlikely to occur. In addition, unlike the hot cathode devices, which are slow at response because they operate only after heated with a heater, the cold cathode devices have the advantage of being quick at response.

Thus, a lot of studies have been conducted for the application of cold cathode devices.

A surface conduction electron emission device, for example, has a particularly simple structure and is easy to produce compared with the other cold cathode devices, accordingly the application of this type devices is advantageous to forming multiple devices over a large area of the substrate. Therefore, methods have been studied to arrange and drive multiple devices on the substrate, as disclosed, for example, by the present applicants in Japanese Patent Application Laid-Open No. 64-31332.

As to the application of surface conduction electron emission devices, the studies have been carried out of, for example, image producer such as an image display and an image recorder, charged beam sources and the like. For the application to an image display, the display using surface conduction electron emission devices in combination with a fluorescent substance, which emits light when electron beam is applied, has been studied as disclosed by the present applicants in U.S. Pat. No. 5,066,883, Japanese Patent Application Laid-Open No. 2-257551 and Japanese Patent Application Laid-Open No. 4-28137. An image display using surface conduction electron emission devices in combination with a fluorescent substance is expected to have properties superior to conventional ones using other methods. The above display may be superior to, for example, the liquid crystal display which has been in common use recently in that it does not need a backlight since it spontaneously emits light and in that it has a wide viewing angle.

A method for arranging and driving multiple FE type devices is disclosed, for example, by the present applicants in U.S. Pat. No 4,904,895. The known examples of the application of FE type devices to an image display include, for example, a planar image display reported by R. Meyer et al. (refer to R. Meyer: "Recent Development on Micro-Tips Display at LETI," Tech. Digest of 4th Int. Vacuum Microelectronics Conf., Nagahama, pp. 6–9 (1991)).

An example of the application of multiple MIM type devices in the arranged state to an image display is disclosed by the present applicants in Japanese Patent Application Laid-Open No. 3-55738.

Among the image producer using the electron emission devices described above, a planar image display which is thin depthwise has attracted considerable attention as a replacement of the image displays utilizing cathode-ray tubes, since it is space-saving and lightweight.

FIG. 36 is a perspective view of one example of the display panel constituting a planar image display, partially broken away to show the inside structure.

In the figure, reference numeral 3115 designates rear plate, numeral 3116 a side wall and numeral 3117 a face plate. And the rear plate 3115, the side wall 3116 and the face plate 3117 make up an outer enclosure (hermetic container) for keeping the inside of the panel cell vacuum. On the rear plate 3115 a substrate 3111 is fixed, while on the substrate 3111 N×M cold cathode devices are formed (wherein N, M are positive integers not lower than 2 and they are properly set according to the number of pixels to be displayed). The above N×M cold cathode devices 3112 are wired with M lines of row wiring 3113 and N lines of column wiring 3114 as shown in FIG. 27. The portion consisting of the substrate 3111, the cold cathode devices 3112, the row wiring 3113 and the column wiring 3114 is referred to as a multiple electron beam source. Between the row wiring 3113 and the column wiring 3114 an insulating layer (not shown in the figure) is formed at least at each portion where the row wiring intersects the column wiring. As a result, the row wiring 3113 and the column wiring 3114 can be kept electrically separated from each other.

On the underside of the face plate 3117, a fluorescent film 3118 is formed which consists of fluorescent substances of three primary colors: red (R), green (G) and blue (B) (not shown in the figure). Between adjacent fluorescent substances each of which is colored in any one of the above primary colors and constitutes the fluorescent film 3118, a black substance (not shown in the figure) is provided. And on the surface of the fluorescent film 3118 which faces the rear plate 3115, a metal back 3119 consisting of Al and etc. is formed.

Dx1 to Dxm, Dy1 to Dyn and Hv are electrical connection terminals having a hermetic structure for electrically connecting the above display panel with an electric circuit, which does not appear in the figure. Dx1 to Dxm, Dy1 to Dyn and Hv are electrically connected with the raw wiring 3113 of the multiple electron beam source, the column wiring 3114 of the multiple electron beam source and the metal back 3119, respectively.

The interior of the above hermetic container is kept at a vacuum of about $10^{-6}$ Torr ($1.33\times10^{-4}$ Pa). As the display area of the image display becomes larger, some means becomes necessary to prevent the rear plate 3115 and the face plate 3117 from undergoing deformation or fracture due to the difference in atmospheric pressure between the interior and the exterior of the hermetic container. The use of the method in which the rear plate 3115 and the face plate 3117 are made thicker not only increases weight of the image display, but causes distortion of images as well as parallax when viewing the display at an angle. Contrary to this, in FIG. 36 are provided structural supports (referred to as spacer or rib) 3120 made of a relatively thin glass plate for supporting atmospheric pressure. The spacing between the substrate 3111, which has a multiple electron beam source formed on it, and the face plate 3117, which has a fluorescent film 3118 formed on it, is usually kept submillimeter to several millimeters, and the interior of the hermetic container is kept at a high vacuum as described above.

When applying voltage to each cold cathode device 3112 in an image display with the display panel described above through the terminals, Dx1 to Dxm and Dy1 to Dyn, outside the container, electrons are emitted from each cold cathode device 3112. At the same time, a high voltage of several hundreds-volt to several-kilovolt is applied to the metal back 3119 through the terminal Hv outside the container to accelerate the emitted electrons above and force them to collide with the internal surface of the face plate 3117. This allows each colored fluorescent substance constituting the fluorescent film 3118 to be excited and emit light, as a result of which images are displayed.

The aforementioned display panel for image displays has, however, the following problems. First, the spacer 3120 may be charged when some of the electrons emitted from its vicinity hit it or when the ions emitted due to the action of the emitted electrons deposit to it. The orbit of the electrons emitted from the cold cathode device 3112 is deformed due to the charged spacer, so that the electrons reach the place other than the normal one, which leads to the distortion of the image in the vicinity of the spacer.

Second, there is a fear that a creeping discharge should occur along the surface of the spacer 3120 disposed between the multiple electron beam source and the face plate 3117, since a high voltage of several hundreds-volt or higher (that is, a high electric field of 1 kV/mm or higher) is applied therebetween to accelerate the electrons emitted from the cold cathode device 3112. An electric discharge is likely to be induced, particularly when the spacer is in the charged state as described above.

In order to solve this problem, there is proposed a method in U.S. Pat. No. 5,760,538 in which the electrical charge contained in spacers be neutralized by passing an infinitesimal current therethrough. In the above patent, an infinitesimal current is allowed to pass through the surface of the spacers by forming a highly resistant thin film as an antistatic film thereon. The antistatic film used in the above patent is a thin film of tin oxide, a mixed crystal thin film of tin oxide and indium oxide, or a metal thin film.

The use of the method in which electrical charge is neutralized with a highly resistant thin film sometimes leaves the problem of insufficient reduction of image distortion unsolved. The principal factor underlying this problem is considered to be the concentration of electrical charge in the vicinity of the junction portion due to the insufficient electrical junction between the spacers with a highly resistant thin film and the upper and lower substrates, that is, the face plate (hereinafter referred to as "FP") and the rear plate (hereinafter referred to as "RP"). In order to solve this problem, there is proposed a method in which the end faces of the spacer facing FP and RP, respectively, are coated with the material whose resistivity is lower than a metal thin film or a highly resistive film within the range of about 100 to 1000 micron so as to ensure its electrical contact with the upper and lower substrates and control its electrification due to the incidence of the reflected electrons from the face plate, as disclosed in Japanese Patent Application Laid-Open No. 8-180821 and Japanese Patent Application Laid-Open No. 10-144203.

Even with such a means given to the highly resistive film and the means for controlling the orbit of emitted electrons, as well as with the formation of low resistive film portion for a better electrical contact as described below, electrification of the spacers cannot be sufficiently controlled depending on the other design parameters of the electron beam apparatus, such as materials and film thickness of its face plate, shape, and anode accelerating voltage, and there still exist problems of, for example, displacement of light emitting points and occurrence of an infinitesimal discharge in the vicinity of the spacers due to the insufficient control.

The cause of such electrification is not clarified in detail, it is, however, considered that the factors lie upon the following background.

Presumably, the cause of electrification of the spacers is such that there may exist some factors which effectively increase the capacitance and resistance of the spacers as described below, or the spacers are exposed to the reflected electrons from the cold cathode devices 3112 close thereto other than the most closest ones during their non-selective period and also exposed to the abnormal field emission from the field concentration region in the vicinity of the spacer-cathode junction. In addition, it is considered to be another cause of the electrification that control of the secondary emission coefficient on the surface of the spacers is not accounted for in design.

[Background 1] Restriction by the relaxation time constant of a highly resistive film on spacers The progress of electrification and relaxation in any region of the surface of a spacer can be considered as a time delay of the charged electric potential corresponding to the injection current by the application of a charged dielectric model.

FIG. 12 illustrates a model which represents the relaxation by capacitance resistant devices in the case of looking at upper and lower electrodes from a current injection region, when an effective injection current ic is supplied from a current source to an arbitrary position z on the surface of a spacer. In the figure, Va designates a voltage applied from a voltage source to an anode and ic an effective injection current supplied to the position at a height of zh (wherein h corresponds to the height of a spacer, $0<z<1$). The effective injection current corresponds to the difference between a secondary current and a primary current. C1 and R1 designate values of capacitance and resistance, respectively, which specify the relaxation time constant between the injection region and the anode, while C2 and R2 values of capacitance and resistance, respectively, which specify the relaxation time constant between the injection region and the cathode. When the resistance and the capacitance distribute uniformly in the altitude direction, C1, C2, R1 and R2 are described using the resistance of the spacer R and the capacitance C by $C/(1-z)$, $R(1-z)$, $C/z$ and $Rz$, respectively.

Since the principle of superposition should hold for the injection current in any position, the electric potential in the region of an arbitrary altitude on the spacer can be specified without losing generality if considering the electrification process in the following manner; first a high voltage Va from a voltage source is applied between the anode and the cathode, then the electronic current entering from the vacuum side to the position z in the aimed region is treated as an effective injection current Ic which is equivalent to the difference between the entered and emitted currents, and finally performing formularization with an equivalent circuit to which the effective injection current Ic as a current source is supplied, as shown in FIG. 12.

Now, in order to design a suitable spacer construction, formularization of a relaxation process will be performed taking a concrete example of the charged electric potential on the spacer having an insulating or highly resistive film formed on it and suitable for the electron beam emission apparatus of the present invention. For simplification, it is assumed that distribution of electric constant is uniform on the surface of the spacer. First, formularization is performed treating the rate of effective injection charge to the surface of the spacer as amount of current supplied from a current source and taking into account the energy distribution and incident angle distribution of incident electrons. The result is as follows:

amount of electronic current emitted from the electron emission device Ie proportion of the incident electrons at an altitude of zh $(0<z<1)$ $\beta^{ij}$ secondary electron emission coefficient at an altitude of zh $(0-z<1)$ $\delta^{ij}$ provided that superscripts i, j correspond to incident energy and incident angle, respectively, amount of primary electronic current in the position z Ip $$Ip=\Sigma\Sigma Ip^{ij}=\Sigma\Sigma\beta^{ij}\times Ie$$

amount of secondary electronic current in the position z Is $$Is=\Sigma\Sigma\delta^{ij}\times Ip^{ij}=\Sigma\Sigma\delta^{ij}\times\beta^{ij}\times Ie$$

injection rate of the electrical charge in the position z Ic $$Ic=\Sigma\Sigma(\delta^{ij}-1)\times Ip^{ij}=\Sigma\Sigma(\delta^{ij}-1)\times\beta^{ij}\times Ie$$

Finally, the rate of injection charge Ic can be described as $$Ic=P\times Ie \qquad \text{General Formula (2)}$$

wherein P is described as $P=\Sigma\Sigma(\delta^{ij}-1)\times\beta^{ij}$ and is a coefficient independent of Ie, it is, however, assumed that in reality P changes as the progress of electrification.

Then, for the arrangement of the capacitance and resistance of the spacer film seen from the injection region, it is assumed for simplification that there exists neither resistance variation nor capacitance variation in the altitudinal direction of the spacer (this corresponds to the direction in which a high voltage is applied between anode and cathode). At this time, when the resistance and capacitance in the direction parallel to the surface of the spacer seen from anode/cathode are represented by R and C, the altitude of the spacer h, and the altitude of the injection region zh ($0\leqq z\leqq 1$, on the anode side $z=1$), the electric constant existing above and below the injection region is specified for the position z. Further, since a voltage from the voltage source is applied between the anode and the cathode, an effective impedance Z is dealt with as 0. Thus, it is understood that the injected electrical charge undergoes relaxation through the parallel resistance and the parallel capacitance of each resistance and capacitance lying above and below the injection region. The resistance and the capacitance between the injection region in the position z and GND are described by z(1−z)R and C/z+C/(1−z), respectively, and response time constant τ of the relaxation path corresponds to the product of the master resistance and capacitance of the spacer, that is, CR at an arbitrary position.

The electric potential in any position at this time is described as a function of time using the solution obtained by setting up a differential equation concerning a current for the entire close of the aforementioned equivalent circuit shown in FIG. 12.

When the time of starting electron emission is shown by t=0, provided that electron emission device is continuously driven, ΔV(t) which represents the progress of charged electric potential in the injection region is described by the following equation, $$\Delta V(t)=z(1-z)Ri_c(1-\exp(-t/\tau)) \qquad \text{General Formula (3)}$$

and it is clear that the progress of charged electric potential depends on the product of the resistance R and effective injection current Ic.

When plotting time in abscissa and the amount of the emission current from electron emission device and the time of emitting the charged electric potential electrons on the spacer in ordinate, setting quiescent time (that is, selective period, non-selective period) for t1 seconds, and repeating the drive of the device every t2 seconds, as shown in FIG. 5, the charged electric potential ΔV at the end of the first period (t1+t2 seconds) is described using the general formula (3) as follows:

$$\Delta V(t)=z(1-z)Ri_c(1-\exp(-t_1/\tau))\exp(-t\Sigma) \qquad \text{General Formula (4)}$$

And it is assumed that electrical charge is accumulated every time the devices close to the spacer are driven, provided that t2>>τ or t1<<τ does not hold. The relaxation process of electrification of the spacer is thus described.

On the other hand, the change in the position of a beam with the amount of electrons emitted during the selective period t1 (Duty dependency) is a problem for a display device, however such Duty dependency in the light emitting position can be dealt with as a change of ΔV shown by the general formula (3) corresponding to the amount of emitted electrons (the product of Ie and pulse width), accordingly both sides of the general formula (3) are differentiated by the amount of emitted electrons (the product of Ie and pulse width).

General Formula (5)

$$\frac{d\Delta V(t)}{d(I_e t_1)} = z(1-z)R\left\{\frac{P(1-\exp(-t_1/\tau))}{tI} + \frac{P\exp(-t_1/\tau)}{\tau}\right\} = \frac{z(1-x)}{C}\frac{P}{t_1}\{\tau + (t_1-\tau)\exp(-t_1/\tau)\}$$

The general formula (5) is simplified by the driving conditions and the material constant. When the material is insulating or selective period is very short, CR=τ>>t1 holds, and the following formula is established.

$$\frac{d\Delta V(t)}{d(I_e t_1)} = \frac{z(1-z)P}{C} \qquad \text{General Formula (6)}$$

When the material is low resistant or selective period is very long, CR=τ<<t1 holds, and the following formula is established.

$$\frac{d\Delta V(t)}{d(I_e t_1)} = \frac{z(1-z)PR}{t_1} \qquad \text{General Formula (7)}$$

Now parameters specifying Duty dependency in the light emitting position, that is, tone dependency during the selective period will be explained based on the above formularization.

In terms of the conditions under which an accelerating voltage between anode and cathode is maintained, preferably a spacer has some degree of insulating property or high resistance in the direction parallel to its surface. Accordingly, when taking into account Duty dependency of charged electric potential in any position, preferably the general formula (6) is applied. Thus, in order to control Duty dependency, dielectric constant or the section area of the spacer material needs to be enlarged. The controllable range of dielectric constant in material is, however, extremely limited compared with specific resistance, and as for film thickness, it is impossible to ensure an effective dimension for the reason related to processes. Thus, control of parameter P is required.

Further, in terms of the increase in effect of electrification relaxation during quiescent time, if electrons are injected into a spacer in a repetition period shorter than the time constant specified by resistance and capacitance, charges are accumulated, as described with respect to the above general formula (4). Even when the material is applied to the highly resistive film on the surface of the spacer whose relaxation time constant is smaller than the line non-selective period of electron emission device t2 second (≅selective period×the number of scanning lines), cumulative charge can be formed. Thus the design of relaxation time τ aiming at control of the resistance alone is considered to be insufficient for antistatic measures.

In any case, it is difficult to design suitable conditions under which electrification is restricted as long as control of resistance and capacitance alone is aimed at, for this purpose, the control of secondary electron emission coefficient is required

[Background 2] Generally secondary electron emission coefficient largely depends on the incident angle of incident electrons, and secondary electron emission coefficient δ doubles almost exponentially by enlarging the incident angle.

Generally, in cases where primary electrons enter the smooth surface as shown in FIG. 14, when the incident angle is represented by θ [degree] (−90<θ<90), incident energy by Ep [keV], the distance incident electrons penetrate into the film by d [Å], absorption coefficient of secondary by α [1/Å], the mean energy of primary electrons needed for the generation of secondary electrons in the film by ξ [eV] and the probability of secondary electrons escaping from the surface to vacuum by B, secondary electron emission coefficient is quantitatively described using parameters A, n describing the energy loss process of primary electrons in the film by the following general formula (0).

$$\delta = \frac{B}{4\xi}\left(\frac{An}{\alpha'}\right)^{\frac{1}{n}} (\alpha' d_p)^{\frac{1}{n}-1}\left[1-\left\{1+\left(\frac{1}{\gamma}-1\right)\alpha' d_p\right\}\exp(-\alpha' d_p)\right] \quad \text{General Formula (0)}$$

wherein parameters α, γ, dp are specified by the following relationship:

$$\alpha' = \alpha \cos\theta$$

$$\gamma = 1 + m_1 \times (\alpha' d_p)^{-m_2},\ m_1 = 0.68273,\ m_2 = 0.86212$$

$$dp = \frac{E_p^n}{An}$$

The incident energy dependency of secondary electron emission energy shown by the above general formula (0) generally has an angle property with peaks, and in many cases, it has two incident energies with which the peak value of secondary electron emission coefficient δ exceeds 1 and the relation δ=1 is satisfied. In the incident energy between these two cross-point energies, secondary electron emission coefficient is positive, which means the generation of positive charge. Of the two cross-point energies, the smaller one is referred to as a first cross-point energy E1 and the bigger one a second cross-point energy E2.

Here, the incident angle dependency of secondary electron emission coefficient standardized in the general formula (0) for the vertical incidence of 0 degree, that is, θ=0 can be an index for evaluating the secondary electron emission multiplication effect at an angle.

This is shown below as a general formula (1), $$\frac{\delta_\theta}{\delta_0} = \frac{\exp(-m_0\cos\theta)^{1-\left\{1-\frac{m_0\cos\theta}{1+(m_1)^{-1}\times(m_0\cos\theta)^{m_2}}\right\}}}{1-\left\{1-\frac{m_0}{1+(m_1)^{-1}\times m_0^{m_2}}\right\}\exp(-m_0)} \times \frac{1}{\cos\theta} \quad \text{General Formula (1)}$$

wherein parameters $m_1$, $m_2$ are constants having the following values:

$$m_1 = 0.68273,\ m_2 = 0.86212$$

In the general formula (1), m is equal to and which is the product of the absorption coefficient of secondary electrons α0 and the penetration distance of primary electrons d, is a function of incident energy, and can be a positive real number. Hereinafter $m_0$ is referred to as incident angle multiplication coefficient of secondary electron emission coefficient, because of its characteristics. In the above general formula (1), $m_0$ shows a tendency to increase monotonously with the incident angle |θ| under arbitrary incident energy conditions, then rapidly increases where the incident angle becomes about 90 degrees. This is because the primary electrons enter the surface at an angle and the distribution of the secondary electron generating sites shifts near to the surface of the film. For this reason, the proportion of the electrons increases which are emitted into vacuum without recombining and therefore vanishing. This can be understood as an apparent reduction of the absorption coefficient of secondary electrons α to α cos θ. In the smooth thin film formed on the smooth surface of a spacer as a spacer material, for example, many antistatic films have an incident angle multiplication coefficient of secondary electron emission coefficient $m_0$ larger than 10, provided that the incident energy having a positive secondary electron emission coefficient, which is larger than the first cross-point energy and smaller than the second cross-point energy, is 1 keV. This increases the positive electrification with the increase in the incident angle and is the big cause of the positive electrification of the spacer material. The enlarged incident angle multiplication effect of secondary electron emission coefficient is shown in FIG. 15 with black boxes.

[Background 3] The distribution of the incident angle to a spacer is large, in addition, the incident electrons entering the surface at a large incident angle are predominant.

There exist various routes for the electrons' incidence, they are, however, represented roughly by three particular routes. The first one is a direct incidence of the electrons emitted from electron emission devices. In this case, the incident angle is as large as about 80 to 86 degrees, though it depends on the degree of distortion in the electric field near the spacer and other designed values of the apparatus, and its incident mode is a large incident angle and high incident energy. Further, it has a feature such that, since the distance between the spacer and electron emission device close thereto is short, the amount of incident electrons is very large. The second one is an indirect incidence of the electrons reflected from a face plate to its surroundings. In this route, the distribution of the incident angle expands from 0 to large degrees, and the incident energy also has a distribution, but its range is smaller than that of the incident energy in the first route. The third one is re-incidence to the surface of the spacer of the incident electrons of the first and the second routes or the electrons emitted from field concentration points. This route is considered to occur because electrons are apt to re-enter the region in the locally positively charged state compared to other regions. In this case also, the incident angle has a distribution. Since a high electric field of about several kV/cm to several tens kV/cm is usually applied in the creeping direction as an accelerating voltage, the vertical incidence of electrons is modulated to an incidence at a large angle. Thus, incident electrons passing through any route have an incident angle distribution, and an effective charge injection is performed through the positive charge formed inside of a solid by the incident electrons entering at a large angle. Of the incident modes described above, the direct incident electrons of the first route is usually predominant over the positive charge in question, they are, however, dependent on the driving state and the design of electron emission device, and they can sometimes leave the problem unsolved of the reflected electrons from a face plate and the re-incidence of multiple scattered electrons described below.

[Background 4] Multiple electron emission on the surface

The secondary electrons once emitted from the surface of a spacer have a relatively small initial energy of at most 50 eV. Although in space they receive energy from the electric field between the anode and cathode, since situations in which the spacer is charged positively often occur, there exist many electrons plunging into the positively charged region on the spacer as well as the electrons reaching the anode. These electrons are problematic because they accumulate the positive charge on the spacer cumulatively while repeating their incidence at a low incident energy and a large incident angle and emission alternately. Thus, control of the above multiple electron emission is the subject for study.

Now the above backgrounds will be abstracted. As apparent from Background 1, there are some cases where the film designed taking into account resistant value alone is not perfect since the range within which the dielectric constant and resistant value of the film can be selected is restricted, and in such a case it is important to restrict the amount of effective current injected into the film, or to restrict secondary electron emission coefficient.

As apparent from Backgrounds 2 and 3, in the design of the spacer's surface the reduction of incident angle dependency of secondary electron emission coefficient and the absolute value thereof is a subject, since electrification by the electrons with a large incident angle is predominant over the real electron emission devices. Further, Background 4 shows that it is important to reduce the cumulative emission phenomenon of electrons to control the cumulative positive accumulation of multiple scattered electrons. These are the subjects of the art of the present invention.

As described so far taking a spacer for example, there are some cases where there exists a member in a hermetic container within an electron emission apparatus which may be exposed to electrons, and the effect of the member due to its electrification is desired to be relaxed. The effects include, for example, variation of the position exposed to the electrons and occurrence of creeping discharge. The present patent application provides an invention which implements a construction enabling the relaxation of the above effects.

SUMMARY OF THE INVENTION

Empirically, the above formulae (0) and (1) are satisfied in almost all the materials, and the incident angle multiplication coefficient of secondary electron emission coefficient $m_0$ is obtained by fitting experimental values in the general formula (1). $m_0$ can be used as an index of incident angle dependency of secondary electron emission coefficient since it is highly reproductive.

According to the present inventors' detailed examination, many inorganic materials having a low secondary electron emission coefficient which have been considered to be suitable for spacers show a strong incident angle dependency and have an incident angle multiplication coefficient of secondary electron emission coefficient $m_0$ of 10 or larger. This is a significant cause of positive electrification of spacers within image displays of the electron beam emission type where many electrons enter the surface of the spacer at an angle.

[Ideal State Derived From Theoretical Equation]

What should be done to reduce incident angle multiplication coefficient of secondary electron emission coefficient $m_0$ as well as to reduce secondary electron emission coefficient $\delta_0$ for the vertical impedance? After the present inventors' detailed examination, it was found that the above subject can be accomplished by satisfying the following requirements. Specifically, it is considered that the methods grouped into two major categories can be used in order to relax incident angle dependency.

Those are the methods for relaxing the uniformity of incident angle itself and for reducing surface effect as a property on material side, that is, the ratio of penetration depth of primary electrons to penetration depth of secondary electrons: $d/\lambda$.

(1) Dispersion of Incident Angle of Primary Electrons

Incident angle is allowed to have an infinitesimal distribution in the normal direction on the interface considered as a surface, so that it is not restricted to the angle specified by the outside. Thus the incident angle defined on a local basis has a distribution with respect to the angle defined on a broader basis, which allows dependency on incident angle to be relaxed. Since dependency on incident angle shows the property of rapidly increasing when incident angle is close to 90 degrees, relaxation by the dispersion of incident angle is significantly effective.

(2) Reduction of the Ratio of Penetration Depth of Primary Electrons to Penetration Depth of Secondary Electrons Since the penetration depth of electrons into a solid is proportional to the reciprocal of free electron density $\rho Z_{eff}/A_{eff}$, a larger free electron density makes possible a smaller incident angle multiplication coefficient of secondary electron emission coefficient $m_0$. In the devices other than hydrogen, values of $Z_{eff}/A_{eff}$ are in the range of 2 to 2.5, and since its variation is smaller than that of $\rho$, the penetration depth is specified by the specific gravity $\rho$ of each solid. In other words, when primary electrons have an equal incident energy, their penetration depth becomes smaller in the film having a larger density $\rho$. Then, since $m_0=d/\lambda$ (wherein $\lambda$ is escape depth of secondary electrons, $\lambda=1/\alpha$), the restriction of incident angle multiplication coefficient of secondary electron emission coefficient $m_0$ is understood as the restriction of the ratio of penetration depth of primary electrons to penetration depth of secondary electrons within the medium.

In a uniform single material system, however, it is very difficult to control the relationship between $\lambda$ and d independently. After the present inventors' examination, it was found that, provided that the spacer undergoes positive electrification which is the main subject when considering the electrification of the spacer, incident angle multiplication coefficient of secondary electron emission coefficient $m_0$ often has a value of 10 or larger for the primary electrons whose incident energy is the first cross-point energy E1 or more and the second cross-point energy E2 or less.

After the present inventors detailed examination, it was found that the following structures satisfy the requirements for the construction in which the above processes (1) and (2) are performed.

According to the result of the present inventor's examination, the escape depth of secondary electrons $\lambda$ is made to disperse and increase depthwise by constructing the surface of the spacer in such a manner that the incident angle of primary electrons have a distribution in the direction of film thickness. Because of $\lambda \cdot d$ in many regions within a solid from the difference between the energies of electrons, the increasing rate of d with the dispersion of incident angle in the surface position is infinitesimal compared with the increasing rate of $\lambda$, as a result, $d/\lambda$ value becomes small and incident angle multiplication coefficient of secondary electron emission coefficient $m_0$ is reduced. The above method in which incident angle is allowed to have a distribution in the direction of film thickness on the surface of the spacer is implemented by giving the surface of the spacer a network structure in which multiple localized parts are depressed and arranged in a intricate manner.

Increase in $\lambda$ was attempted with these methods, and it is found that the application of a suitable design allows incident angle multiplication coefficient of secondary electron emission coefficient $m_0$ to be reduced to about one third or smaller as compared to the conventional ones, that is, to be reduced to about 3.

The process of reducing incident angle dependency of secondary electron emission using the network structure consisting of an intricate surface described above is understood as follows.

Both of the primary and secondary electrons traveling in the highly resistive film portion gradually lose their energy while interacting with the atoms within the medium and repeating collision and scattering. In such a situation, their penetration depth and energy decreasing rate largely depend on the electron density of the medium they pass through. In the medium having a high electron density, since the probability of their scattering is high, their penetration depth becomes small. In addition, since the energy decreasing rate for a certain penetration distance is large, the amount of secondary electrons generated for unit depth increases. Thus, in the structure having a high electron density, in other words, in the material having a large specific gravity, penetration depth of electrons is smaller and the amount of secondary electrons generated within the is medium is larger than those in the material having a small specific gravity.

When taking into account the behavior of the secondary electrons generated at the interface of the media different in electron density while taking into account the differences in penetration depth and generation amount, it is considered microscopically that a phenomenon occurs that secondary electrons are emitted from the region where electron density is high into the region where electron density is low.

In cases where the above interface is formed unevenly and consequently the surface area is increased, electrons traveling in the low electron density region where penetration depth of incident electrons is large reach again its interface with the high electron density region, thus they lose their energy. Charges remain in the film for a certain period of time in the dielectric polarization, they, however, recombine with positive holes and vanish within the film in the end. After all, most of these electrons are not emitted into vacuum, and the amount of secondary electron emission is decreased.

In the embodiment of the present invention, a highly resistive film and vacuum are utilized as the two regions different from each other in electron density, and the surface of the foundation underlying the above highly resistive film is made uneven to form an intricate interface. In particular, a suitably intricate interface is formed in such a manner that the thickness of the resistive film is made smaller than the height difference between the highest and lowest portions of the uneven foundation.

Table 1 shows the processes implemented by the embodiment of the present invention in an arranged manner.

TABLE 1

| | Top surface Unevenness Uneven Substrate + Highly Resistive Film | |
|---|---|---|
| Interface (example) | Vacuum | Film |
| Specific Gravity $\rho$ | Small | Large |
| Electron density $\rho A_{eff}/Z_{eff}$ | 0 | |
| Primary Electron Penetration Depth | Large | Small |
| Secondary Electron Escape Depth $\lambda$ | Large | Small |
| Amount of Secondary Electron Generated $dE/dx/\xi$ | Small 0 | Large |

This structure is allowed to have a function of controlling secondary electrons by dealing with the two regions each of which has a different penetration depth due to the difference in electron density, as an interface and if the structure is constructed in such a manner that an interface of the two regions different in electron density distributes in the film, it can realize the same effects without limiting the material to a specific highly resistive material.

The invention of an electron beam apparatus according to the present application is constructed as follows.

An electron beam apparatus comprising a hermetic container which includes an electron source having electron emission devices and targets exposed to the electrons emitted from the above electron source and further comprising a first member within the above hermetic container, characterized in that the value of the incident angle multiplication coefficient of secondary electron emission coefficient $m_0$, which is a parameter of the following formula:

$$\frac{\delta_\theta}{\delta_o} = \frac{1-\left\{1-\frac{m_0\cos\theta}{1+(m_1)^{-1}\times(m_0\cos\theta)^{m_2}}\right\}\exp(-m_0\cos\theta)}{1-\left\{1-\frac{m_0}{1+(m_1)^{-1}\times m_0^{m_2}}\right\}\exp(-m_0)}\times\frac{1}{\cos\theta}$$

is 10 or less, when obtaining it from the value of secondary electron emission coefficient measured under the conditions that incident energy is 1 keV and incident angle is 0 degree as well as the values measured under the conditions that incident energy is 1 keV and incident angles $\theta$ are 20, 40, 60 and 80 degrees by conducting a regression analysis by the least square method in the above general formula, provided that the second electron emission coefficient of the surface of the above first member has two incident energies which satisfy the second electron emission coefficient $\delta=1$ under the vertical incident conditions, and that when the larger energy of the above two energies satisfying said condition $\delta=1$ is referred to as a second cross-point energy, the secondary electron emission coefficients for the primary electrons whose incident angles are $\theta$ and 0 degrees are represented by $\delta_{\theta,\ \delta 0}$, respectively, and $m_1$, $m_2$ have the values $m_1=0.68273$ $m_2=0.86212$, respectively, in the incident energy equal to or lower than the second cross-point energy.

This invention is particularly effective in the electron beam apparatus having a construction such that it comprises a hermetic container including an electron source and targets and further comprises a first member exposed to electrons within the hermetic container. The first member includes, for example, a member restricting the deformation and fracture of the hermetic container.

The measurement of the second electron emission coefficient and the determination of the incident angle multiplication coefficient of secondary electron emission coefficient $m_0$ are carried out as described below. First, for the measurement of secondary electron emission coefficient, a general-purpose scanning electron microscope (SEM) equipped with an electronic ammeter is used. For the measurement of primary electron current, Faraday cup is used. The amount of the secondary electron current is defined using a detector with collectors (for example, MCP or the like is available). Alternatively, it may be obtained from the specimen current and the primary electron current using the relationships of continuous law of the specimen current passing through the specimen portion, the primary current and the secondary current. Incident angle multiplication coefficient of secondary electron emission coefficient $m_0$ can be obtained by conducting the measurement at an incident angle of 0 and at an incident angle of other than 0 under the same incident energy conditions. It is a particularly good way to define different incident angles as $\theta$-$\delta$ property and perform regression analysis (fitting) in general formula (1) by the least square method. In this patent application, the above fitting was performed using the secondary device emission coefficients measured at an incident angle of 0, 20, 40, 60 and 80 degrees. As a spot diameter, when the first member has an uneven structure, the size is employed which is larger than the pitch of the unevenness, in particular, which makes it possible to simultaneously expose two cycles or more of unevenness to electrons. The measurement was conducted at a vacuum of $10^{-7}$ Torr ($1.3\times10^{-5}$ Pa) or lower at room temperature (20° C.).

It is more preferable that the incident angle multiplication coefficient of secondary electron emission coefficient $m_0$ is 5 or less which is obtained from the value of the secondary electron emission coefficient measured under the conditions that the incident energy is 1 keV and the incident angle is 0 degree as well as the values measured under the conditions that the incident energy is 1 keV and the incident angles are 20, 40,60 and 80 degrees by performing regression analysis in general formula (1) by the least square method in the incident energy equal to or lower than the above second cross-point energy.

Suitably the above first member has an uneven geometry at least on a part of its surface.

The above requirements can be met when constructing the above first member in such a manner that it comprises a substrate having an uneven geometry at least on a part of its surface and a film coating the above uneven geometry part, in addition, that the thickness of the above film becomes smaller than the height difference between the top and lowest portions of the above uneven geometry part.

Here, the thickness of the film on the uneven part of the substrate is measured in the following manner. That is to say, a section is made by cutting off the film perpendicular to the surface of the spacer and exposed. The thickness can be measured at the above section by the section SEM. The film thickness to be measured shall be that of the lowest portion of the concavity on the substrate. When evaluating the thickness by the section SEM, a metal film deposited by sputtering may be provided as a pretreatment. This allows the local charge-up due to the insulating property of the specimen to be restricted.

The above substrate may be any of a single substrate and a laminated substrate, and preferably the laminated substrate has a rough surface layer with the above unevenness formed on it. The construction of the unevenness may be such that fine particles are dispersed and contained in a binder matrix. Alternatively, porous glass or porous ceramics may be used.

It is preferable that the above first member is provided with an uneven geometry at least on a part of its surface and that the above uneven geometry is formed in such a direction that the incident angle dependency of the above secondary electron emission coefficient is reduced for any of the orbits of the electron beam from the above electron source as well as of the electron beam reflected on the above target side.

It is preferable that the above first member is provided with an uneven,geometry at least on a part of its surface and that the above uneven geometry is formed in all directions parallel to the surface of the above first member.

When unevenness is formed in only one direction, for example, the effects of the unevenness is not expected in that direction; on the other hand, when the first member has a structure in which unevenness can be confirmed in any section cut in any direction, the effects of the unevenness occur for the incidence of the electrons with various incident angles. More concretely, effective is a structure having unevenness in such a manner that grooves and ribs are provided in two directions not parallel to each other or in such a manner that the axes of grooves and ribs are not provided in a fixed direction. A construction in which unevenness has a random distribution is also suitable.

In each of the above inventions, it is preferable that the above first member is provided with an uneven geometry at least on a part of its surface and the uneven geometry has the average cycle of 100 $\mu$m or shorter, more preferably 10 $\mu$m or shorter.

In each of the above inventions, it is preferable that the above first member is provided with an uneven geometry at least on a part of its surface and the uneven geometry has the average roughness ranging from 0.1 $\mu$m to 100 $\mu$m. It is more preferable that the uneven geometry has the average roughness ranging from 1 $\mu$m to 10 $\mu$m.

In each of the above inventions, it is suitable that the above first member is provided with an uneven geometry at least on a part of its surface and the uneven geometry consists of the cycles of at least two kinds of unevenness.

In each of the above inventions, it is suitable that the above first member is provided with an uneven geometry at least on a part of its surface and the uneven geometry is obtained by removing the material surface of the above first member nonuniformly.

Here, as a material subjected to the above nonuniform removal of the surface, the substrate underlying the film constituting the surface can be adopted, as shown in the paragraphs of the embodiment of the present application. In the embodiment of the present application, the substrate is provided with a film on its surface. As a method of the above nonuniform removal, the method of corroding the surface, more concretely, the method of forming grooves and holes on the surface chemically or electrochemically can be adopted. In addition, the nonuniform removal using a solid, for example, treatment with an sandpaper and treatment by spraying a group of particles, and the nonuniform removal using a liquid can be adopted. Alternatively, the unevenness may be obtained by subjecting the material to a pressure (nonuniform pressure) using the method of injection molding, rolling or roll stamping.

In each of the above inventions, it is preferable that the above first member is provided with a film at, least on a part of its surface and the above film has a sheet resistivity of $10^7$ [Ω/□] to $10^{14}$ [Ω/□].

In each of the above inventions, it is preferable that the above first member is provided with a film at least on a part of its surface. And the film is suitably adopted which includes at least one kind of metal, carbon, silicon, or germanium and consists of nitride, oxide or carbide.

In each of the above inventions, it is preferable that the above first member is provided with a film at least on a part of its surface. And preferably the above film, when having been formed on a smooth substrate so as to have a smooth surface, has a composition which makes possible the secondary electron emission coefficient of 3.5 or less under vertical incident conditions.

In each of the above inventions, it is preferable that the above first member is provided with a film at least on a part of its surface and the surface of the above film has a high oxygen concentration as compared with the inside thereof.

The above first member is provided with a film at least on a part of its surface and the above film can be formed by any one of the following methods:

sputtering, vacuum deposition, wet printing, spraying, or dipping.

In each of the above inventions, preferably the above first member abuts the above electron source, preferably the above first member has a first film provided at least on a part of its surface and a conductive film provided on the portion where the above first film and the above electron source abut with each other, preferably the above first film and the above conductive film are in contact with each other, preferably the above first member abuts the electrode provided within the above hermetic container to control the electrons emitted from the above electron source, preferably the above first member has a first film provided at least on a part of its surface, and a low resistive film provided on the portion where the above first film and the above electrode abut with each other, and preferably the above first film and the above low resistive film are in contact with each other.

Preferably the above low resistive film has a low sheet resistivity as compared with the above first film. In particular, the above low resistive film has a sheet, resistivity lower than the above first film by an order of magnitude. In cases where the low resistive film and the first film are in contact with each other, even if nonuniform charges exist in the first film, the low resistive film makes it possible to relax the nonuniformity of the charges. In the construction in which the first member and the electron source or the electrode abut with each other, when the construction contains a low resistive film at the portion where the above two abut with each other, a first configuration may be adopted where the substrate 1, the first film 2 and the low resistive film 3 are arranged in this order so that the low resistive film can directly abut the electron source or the electrode, as shown in FIG. 1. Or a second configuration may be adopted where the substrate 1, the low resistive film 3 and the first film 2 are arranged in this order so that the first film can directly abut the electron source or the electrode. In the first configuration, of course, the first film is electrically connected to the electron source or the electrode via the low resistive film. And in the second configuration, since the first film has a lower resistance in the direction of the film thickness at the portion where the first film and the electron source or the electrode abut with each other, the charges generated at some portion of the first film can move to the electron source or the electrode via the low resistive film and the touch portion of the first film. In other words, the first film is electrically connected to the electron source or the electrode via the low resistive film.

Each of the above inventions is effective in its application to the first member wanting to relax the effects of static electricity, and it is especially effective when the first member is a spacer for maintaining the space between the multiple members.

Each of the above inventions can be constructed in such a manner that it further comprises an electrode for controlling the electrons emitted from the above electron source within the above hermetic container. In particular, the above electrode, for example, may be an accelerating electrode which provides voltage to accelerate the electrons emitted from the electron source toward a target. Each of the above inventions is particularly effective in a construction where the voltage applied between the electron emission device contained in the above electron source and the above electrode is 3 kV or higher.

In the above construction comprising such an electrode, it is suitable that the above first member is provided with a film at least on a part of its surface and the above film is electrically connected to both of the above electron source and the above electrode. The electrical connection between the film and the electron source is implemented by allowing the film to electrically connect to the electrode, such as wiring, contained in the electron source.

In each of the above inventions, it is suitable that the above electron source has cold cathode devices as an electron emission device. As a cold cathode device, suitably used is surface conduction electron emission device. In each of the above inventions, particularly effective is the use of the electron emission device contained in the electron source which generates an electric field having a field device in the direction parallel to the main surface of the electron source when emitting electrons.

In each of the above inventions, preferably the above target is such one as produces images when being exposed to electrons. The one provided with fluorescent substances is suitably employed for the above target.

The invention of the electron beam apparatus according to the present application also includes the construction described below.

An electron beam apparatus comprising a hermetic container which includes an electron source having electron emission devices and targets exposed to the electrons emitted from the above electron source and further comprising a first member within the above hermetic container, characterized in that the above first member has a film on its surface, the foundation of the above film having an uneven geometry, the thickness of the above film being smaller than the height difference between the top and lowest portions of the unevenness of the above foundation.

In each of the above inventions, an electron source in which multiple rows of emission devices and multiple columns of electron emission devices are wired in a matrix can be suitably adopted. The electron source can be constructed in a simple matrix.

Alternatively, a construction can be also adopted in which a control electrode for modulation is provided besides the electron emission mechanism.

For example, an electron source having an ladder-shaped arrangement may be used in which multiple rows of wiring formed by connecting multiple electron emission devices (suitably cold cathode devices) in a row to each other at each of their ends are arranged, the electrons emitted from the above electron emission devices are controlled by a control electrode (also called grid) arranged over the above electron emission devices along the direction intersecting the above multiple rows of wiring.

According to the concept of the present invention, the present invention is applicable not only to an image producer suitable for displaying, but to a light emission source for the alternative to the light emitting diode etc. of all optical printer consisting of a photosensitive drum, light emitting diodes, etc. And the above image producer is applicable not only to a linear light emission source, but to a two-dimensional light emission source if the above m rows of wiring and n columns of wiring are properly selected. In this case, the image producing member is not limited to the substances directly emitting light, such as fluorescent substances used in the embodiments described below, but the member is also applicable on which a latent image is formed due to the charge by electrons. Further, according to the concept of the present invention, the present invention is applicable to the cases where the member exposed to the electrons from the electron source is other than image producing member such as fluorescent substances, for example, as is the case of electron microscopes. The present invention may be constituted of a general electron beam apparatus which does not specify a member exposed to the electrons.

BRIEF DESCRIPTION OF THE DRAWINGS

FIG. 1A is a schematic view of a spacer substrate embodying the present invention, and FIGS. 1B end 1C are views illustrating one part of a surface geometry of a spacer substrate embodying the present invention;

FIG. 15 is a graph illustrating incident angle e dependency of secondary electron emission coefficient;

DETAILED DESCRIPTION OF THE PREFERRED EMBODIMENTS

The preferred embodiments of the present invention will be described below.

Figure 1A:
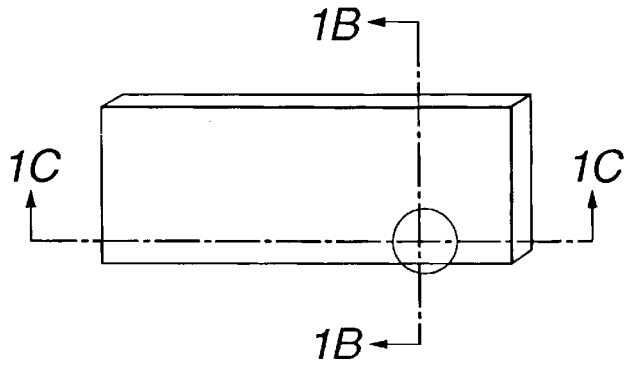
FIGS. 1A, 1B and 1C are schematic presentations of a spacer in accordance with Embodiment 1 of the present invention and illustrations of the production process thereof.
Figure 1B:
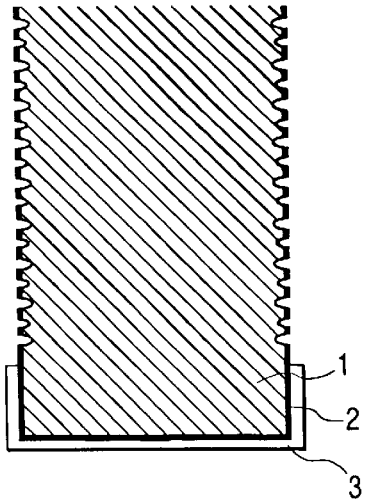
Figure 1C:
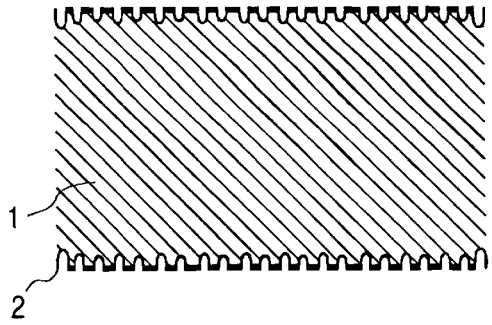
Figure 2:
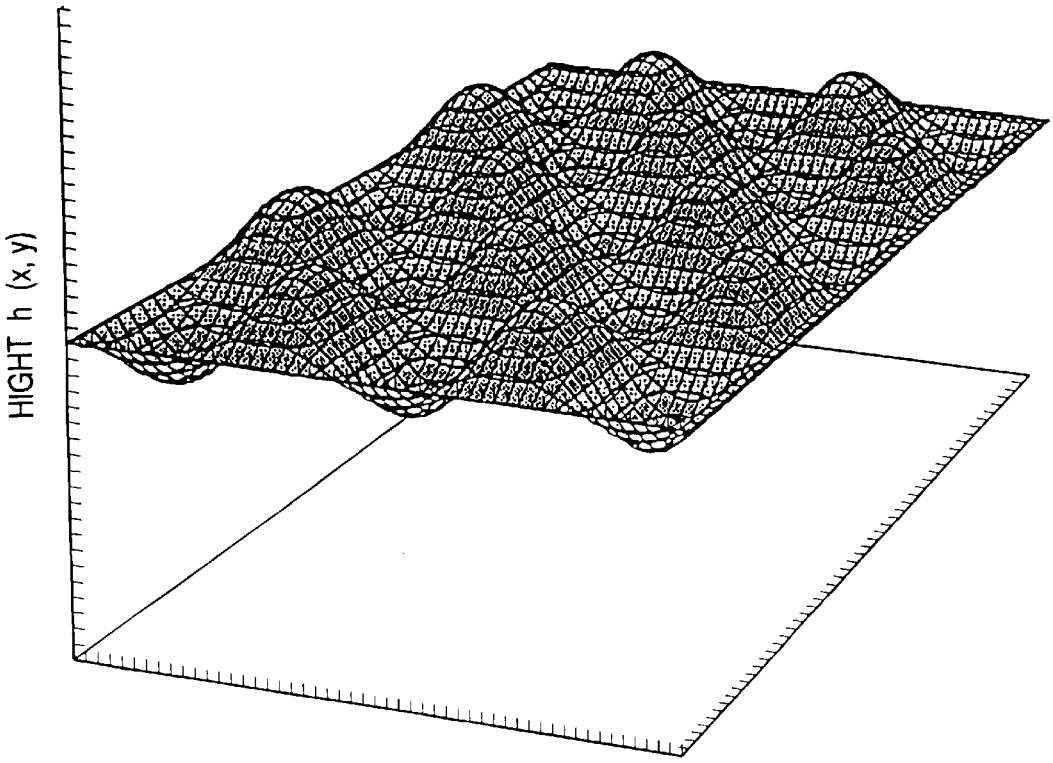
FIG. 2 is a view illustrating a surface geometry of another form of a spacer embodying the present invention.

The embodiment of the present invention described below is an uneven substrate having on its surface a highly resistive film for preventing static electricity, and the unevenness on the spacer substrate is formed so that it can relax incident angles in multiple directions. Referring now to the drawings, FIGS. 1B and 1C are schematic sectional views showing an uneven substrate of the spacer embodying the present invention. FIG. 1B is a section taken on longitudinal line 1B—1B in FIG. 1A and FIG. 1C is a section taken on transverse line 1C—1C in the same. In the Figure, reference numeral 1 designates a spacer substrate having unevenness formed at least on its surface, numeral 2 a highly resistive film formed on the surface of the spacer substrate 1 for preventing static electricity. The final form of the highly resistive film 2 has unevenness on,its surface following the unevenness of the surface of the spacer substrate. Numeral 3 designates a low resistive film for obtaining an ohmic contact between upper and lower electrodes and the spacer, which is provided in case of necessity. As is apparent from FIGS. 1B and 1C, the spacer substrate has an uneven geometry both in the direction of section 1B—1B and in the direction of section 1C—1C which lie at right angles to each other. Accordingly, it has an uneven geometry in the other sectional directions.

Further, described below is the embodiment of a planar image display (electron beam apparatus) using the substrate with a highly resistive film described above as a spacer. As roughly shown in FIG. 17 (the details will be described below), the image display is characterized in that it has a structure in which a substrate 1011 with multiple cold cathode devices 1012 formed on it and a clear face plate 1017 with a fluorescent film 1018, as a fluorescent material, formed on it are arranged opposite to each other via spacers 1020, and that each spacer 1020 has an uneven geometry on its surface and is coated with a highly resistive film for preventing static electricity whose thickness is smaller than the average amplitude of the unevenness.

[Functions of Unevenness (Incident Angle Dependency of Static Electricity Due to Secondary Electron Emission)]

[Direction of Unevenness Formation] Multiple Directions, Random

Referring to the drawings, FIGS. 2 to 9 show the other structures of the spacers in accordance with the present invention whose substrates are uneven and coated with a highly resistive film, and the same figures also illustrate the geometry of a part of their substrate surface. The functions performed by the unevenness formed on the surface of the spacer in accordance with the present invention have multiple effects, for the multiple problems described above in the item of the problems to be solved, as follows.

First, the unevenness is effective in decreasing the incident angle of the incident electrons in a high incident angle mode which largely contributes to the amount of the result is obtained that the incident angle multiplication coefficient of secondary electron emission coefficient $m_0$ defined in the general formula (1) is decreased. In particular, $m_0$ is restricted to a level of one third or less as high as that of the smooth surface. This is particularly effective against the incident electrons directly from the electron emission device closest to the spacer whose incident angle is 80 degrees or higher.

Figure 3:
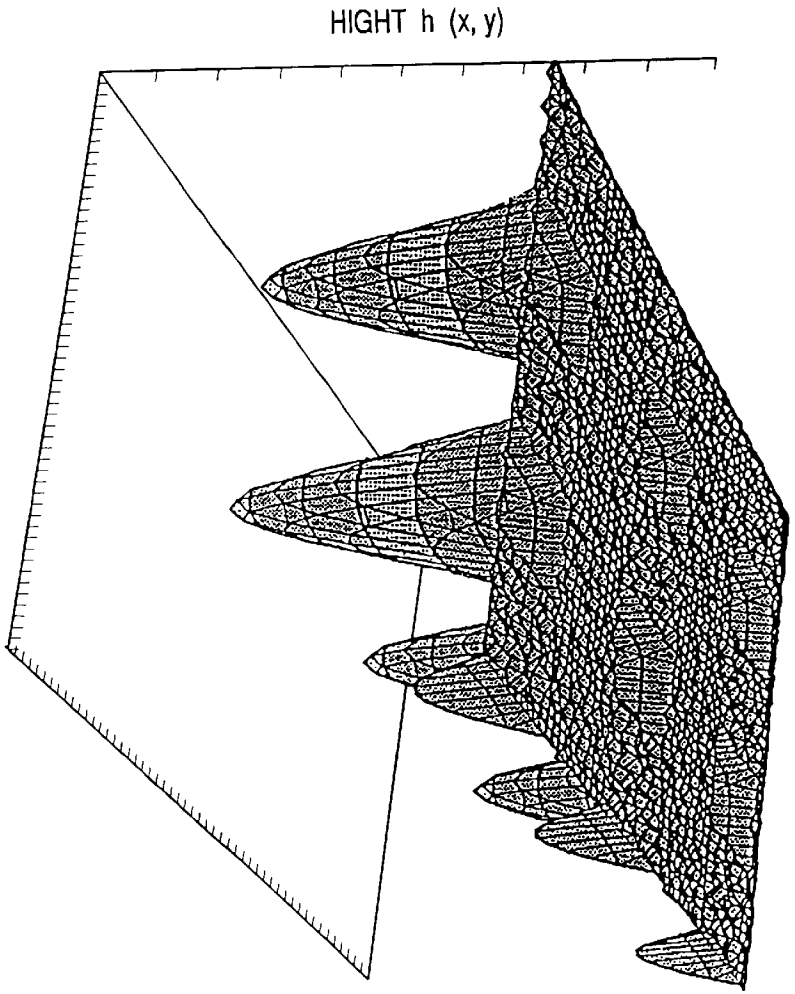
FIG. 3 is a view illustrating a surface geometry of still another form of a spacer embodying the present invention.

Second, the forms of uneven geometry include, for example, a porous structure as shown in FIG. 3, such a structure, like an integration of fine Faraday cups, is effective in shutting secondary electrons in the film.

Figure 16A:
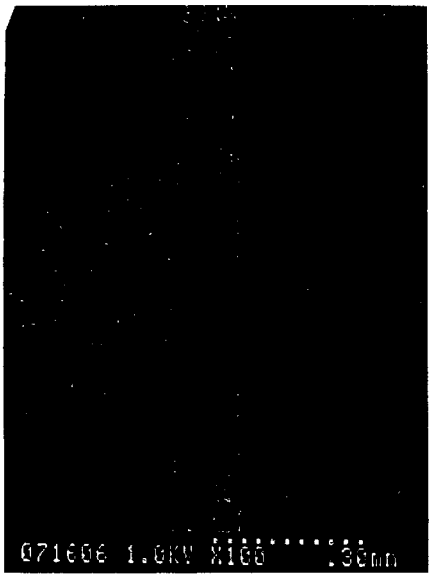
FIGS. 16A, 16B and 16C are photomicrographs of a scanning electron microscope showing the substrate unevenness dependency of incident angle dependency of the amount of secondary electron emission.
Figure 16B:
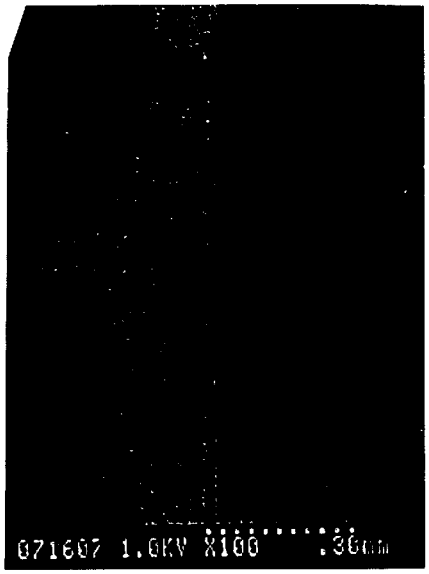
Figure 16C:
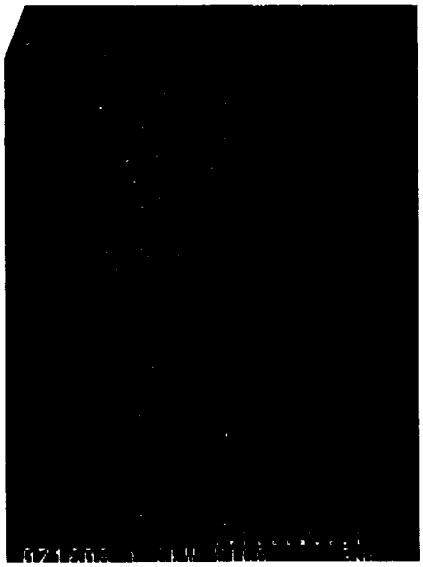

In order to confirm the effects of roughing the spacer surface on the restriction of secondary electron emission, observed with a scanning electron microscope were two types of alumina substrates on which a CrAlN film was formed under the same conditions: an alumina substrate whose surface was subjected to roughing (an alumina substrate having a roughed surface layer) and an alumina substrate whose surface was smooth. FIGS. 16A to 16C are the micrographs. FIGS. 16A, 16B and 16C show the amount of secondary electron emission when the incident angles of primary electron are 0.30 and 60 degrees, respectively. In this case, the primary electron acceleration voltage was 1 kV, and the surface of the alumina substrate was coated with a highly resistive film of CrAlN whose thickness is 200 nm. The left half of each figure shows an alumina substrate subjected to roughing and the right half a smooth alumina substrate. The larger the amount of secondary electron emission becomes, the lighter the micrograph becomes. The results show that the amount of secondary electron emission was restricted by roughing the substrate surface, provided the incident angles were large.

Third, the unevenness is effective in restricting the multiple emission of secondary electrons. The secondary electrons having been emitted have orbital motion toward the anode while being accelerated by the energy received from an accelerating field. However, the energy is relatively small immediately after the emission, and the above electrons are pulled into the locally charged region and rush to the surface of the spacer again. This causes $(\delta-1)$-fold positive charge to be generated. In such a situation, subjecting the substrate surface to roughing makes it possible to cut off the track length of the secondary electrons, and the electrons re-enter the surface of the spacer under the conditions that $\delta-1 \leqq 0$ or $\delta 1>0$, but the absolute value $|\delta-1|$ is not so large. This is effective in restricting the accumulation of positive charges.

Fourth, the highly resistive film in accordance with the present invention is effective in restricting the incident angle of the electrons reflected from the anode.

The flying route of the incident electrons into the spacer has various distributions. In cases where the electrons reflected from the face plate re-enter the spacer (hereinafter referred to as FP reflected electrons), the emission direction has a distribution almost in the form of a concentric circle, accordingly the reflected electrons have a distribution in many directions in the circumstances.

After the present inventor's intensive examination of the spacer-electron emission device distance dependency and the anode (anode substrate provided on the face plate) voltage dependency of the static electricity of each spacer with respect to the orbit distribution of FP reflected electrons observed from the high voltage application electrode side when driving the electron emission devices row by row, it has been found that the electrons reflected from the anode substrate (the metal back or the anode electrode provided on the face plate) includes not only the electrons omitted form the closest electron emission device (the first closest), but the electrons from the second, third and fourth closest electron emission, devices. The effects of the above track length vary depending on the image display because each image display is differently modulated, the effects are, however, doubled by the installation of the members, such as an aluminium electrode which is provided to promote efficiency in utilizing the light emitted from fluorescent substances, and by the increase in acceleration voltage applied, the above installation and the increase in voltage are generally carried out for the purpose of obtaining a high luminance, though. This is one of the causes for the static electricity on the spacer. The above phenomenon means that FP reflected electrons are dependent on the distance of the electron reflecting position of the face plate from the spacer and that the amount of the electrons re-entering is larger at the device closer to the spacer. In addition, the phenomenon means that, among the FP reflected electrons, the ones reflected in the position closer to the spacer have their incident angles more doubled when re-entering the point far away from the reflecting position. For these reasons, the unevenness formed in multiple directions effectively functions for restricting the secondary electron emission with respect to the reflected electrons in a angled mode.

The main functions of roughing the substrate surface or of an uneven substrate surface have been described above in terms of the restriction of static electricity. The unevenness, however, produces another effect such that the surface geometry within the spacer substrate can be easily controlled, as the unevenness is provided on the spacer substrate and its functions are separated from those of the antistatic film.

[Cyclicity of Unevenness]

In the electron beam apparatus in accordance with the present invention, the arrangement of the unevenness on the spacer is not necessarily limited to one cyclic arrangement even in order to obtain the effects on restricting the secondary electron emission, random cyclic arrangements are also acceptable. The arrangement may be determined in terms of simplicity and convenience in production process. In cases where the arrangement is cyclic, in particular, the evenness is preferably formed to have a repeating cycle consisting of a multiple cycle structure considering the energy distributions of secondary electrons and reflected electrons as well as the incident angle distribution. The term "multiple cycle structure" used herein means a structure in which multiple cycles are superposed.

[Details of Unevenness] Pitch. Amplitude

In terms of the relaxation of the incident angle dependency of secondary electron emission coefficient, the effects of the uneven geometry of the spacer substrate are not largely dependent on the spacing and the amplitude of the unevenness. And they can be selected arbitrarily. However, considering the effects of trapping the multiply emitted secondary electrons before they obtain an energy from the field in the gap between the anode and cathode and have an acceleration energy for entering the positively charged region, the unevenness of the spacer substrate preferably have a spacing or pitch of about 100 μm, and more preferably 10 μm or shorter. As for the amplitude of the unevenness, its value can be arbitrarily selected in terms of the relaxation of the incident angle dependency of secondary electron emission coefficient for the same reason as above. However, its average roughness is preferably as large as 0.05 μm or more in terms of the restriction of multiply emitted second electrons, and preferably as large as 100 μm or less, which is the upper limit, in terms of the restriction of the field-concentration-effect. It is particularly preferable that the average roughness ranges from 1 μm to 10 μm.

[Details of Uneven Geometry] Production Method

The method of producing the above uneven geometry of the spacer is not limited to the one described below. As long as the above geometry can be formed, any method may be selected freely and the combination of multiple methods may be applicable. For example, grating formation method, etching method and lift-off method are applicable as a technique for microprocessing glass materials. If necessary, the geometry can be controlled using an optical patterning and a mechanical mask.

Further, for obtaining a randomly uneven geometry, methods of spraying solid, liquid, particles or the like, such as sand blasting method, may be used. As a method of forming deeply depressed portions, in other words, a porous surface, porous glass and porous ceramic which are produced by subjecting the glass material and the ceramic material consisting of split-phase component to corrosion treatment are applicable. Further, micro-holes obtained electrochemically by subjecting metal surface to anodic oxidation are applicable. These are preferable methods because the density and shape of the porous geometry can be highly controllable by the processing time, heating temperature, the normality of corrosive, the current density etc.

Even in cases where the substrate itself does not have an uneven surface, a multilayer type uneven substrate can be used in which an uneven layer is provided between the spacer substrate and the highly resistive surface film. The method of producing an uneven layer is also not limited to the one described below. However, a film with a roughed surface of a fine-particle dispersion type is preferably used in which fine particles of silicon oxide, metal oxides etc. are dispersed in a binder matrix. Because the above type is characterized in that spacing between the unevenness and the amplitude of the same can be controllable and the unevenness have no sharp projections.

For the members relatively easy to melt, such as a glass member, it is possible that first a die is formed from the master which is produced using various surface-roughing means described above, then the substrate is subjected to shape processing using the above die by injection molding, rolling, roll stamping etc.

[Resistance Value of Highly Resistive Film (δ of Highly Resistive Film, Construction of Highly Resistive Film)]

Basically various types antistatic films can be used as a film on the substrate, as long as they can have unevenness on their surface following the uneven geometry of the underlying layer.

In order to form a highly resistive film whose uneven geometry is low in leveling, basically it is important that the film is formed not to have a significantly large thickness as compared with the desired amplitude of the unevenness of the underlying layer or the substrate. And it is preferable that the film is formed to have a thickness smaller than the amplitude of the underlying layer. However, the extremely thin film means losing the effect on increasing the sheet resistivity as well as losing the continuity of the film in the region where the curvature of the unevenness is large. Thus, when not taking advantage of the conductivity of the substrate, the conditions under which film thickness is at least 100 Å or larger, and preferably 500 Å or larger are selected.

As a method of forming a highly resisitive film, the existing processes for forming an antistatic film are applicable. For example, sputtering, vacuum evaporation, wet printing process, spraying process, dipping process and so on are applicable. Liquid phase processes such as dipping process are preferable in terms of lowering costs of production process. In such a process, in order to lower the leveling, it is important to control the film thickness and the viscosity of the coating liquid so that they will be kept small.

Further, in highly resistive films, it is preferable that the secondary electron emission coefficient is low. In smooth films, it is more preferable that the secondary electron emission coefficient is 3.5 or lower. In other word, it is preferable that the number of the secondary electrons emitted form the smooth film surface formed on the smooth substrate to the number of the primary electrons entering the same under vertical incident conditions is 3.5 or smaller in all the incident energies. Further, it is preferable in terms of chemical stability of the film that the surface layer of the highly resistive film is in a highly oxidized state as compared with the inside of the film.

Figure 17:
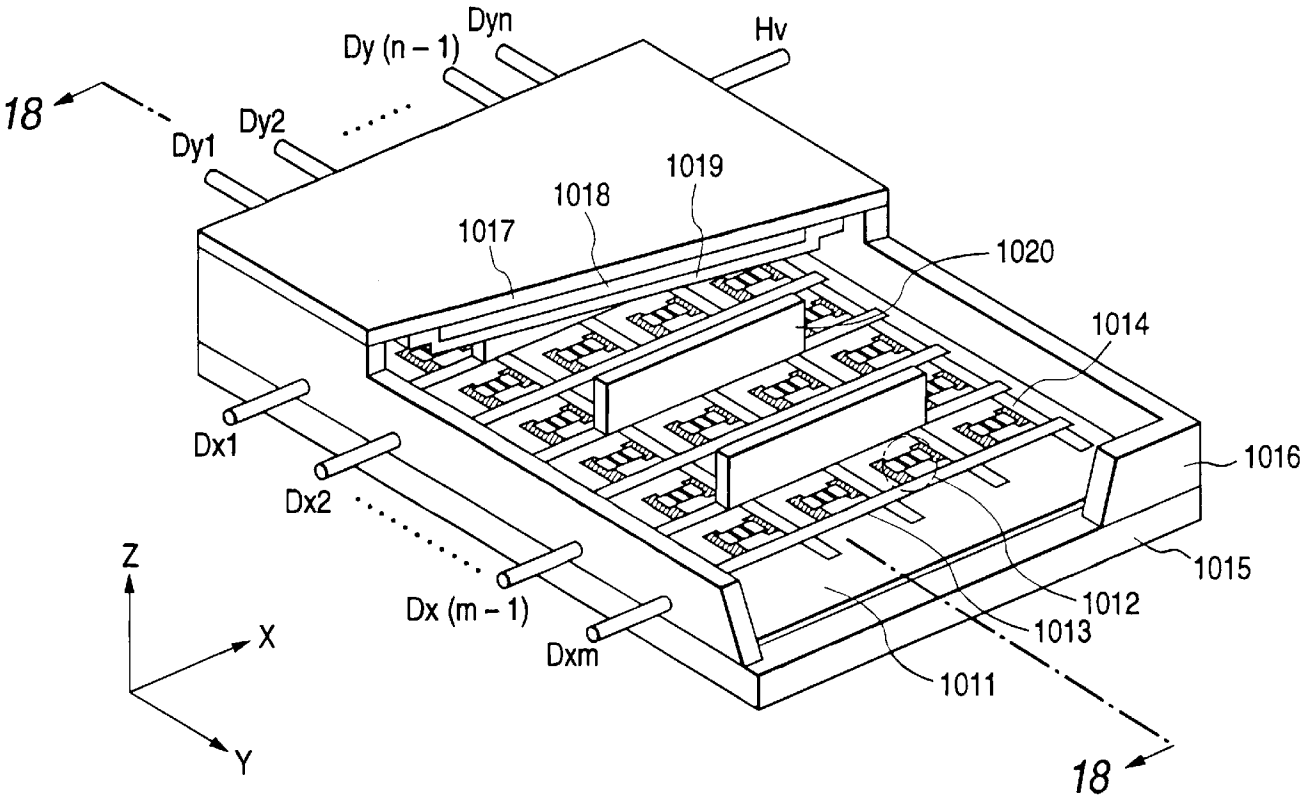
FIG. 17 is a partially cutaway view in perspective of a display panel of an image display embodying the present invention.

Referring to FIG. 17, in the image display of the present invention, one side of the above spacer 1020 is electrically connected to the wiring on the substrate 1011 on which cold cathode devices are formed. And the opposite side of the same is electrically connected to the accelerating electrode (metal back 1019) for causing the electrons emitted from the cold cathode devices to collide with the light emitting material (fluorescent film 1018) with a high energy. Specifically, a current whose amount is equivalent to the amount of accelerating voltage divided by the resistance value of the antistatic film flows through the antistatic film formed on the spacer.

Thus, the resistance value Rs of the spacer is set for a value within the range desirable in terms of its antistatic effect and power consumption. In terms of the antistatic effect, preferably the sheet resistivity R/□ is $10^{14}$ Ω/□ or lower. In order to obtain a sufficient antistatic effect, it is more preferable that the sheet resistivity R/□ is $10^{13}$ Ω/□ or lower. Although the sheet resistivity is dependent on the shape of the spacer and the voltage applied between the spacers, preferably it is $10^{7}$ Ω/□ or higher.

As for the thickness of the highly resistive film t, preferably it is in the range of 10 nm to 1 μm. Generally, in the thin films of 10 nm or smaller thickness, they take the form of an island, their resistance is unstable, and they lack reproducibility, although they vary depending on the surface energy of the material and the adhesion to and the temperature of the substrate. On the other hand, in the thin films of 1 μm or larger, their film stress becomes heavier, therefore, there arises a fear of film peeling, and their film formation time becomes longer, therefore, their productivity becomes low. In light of the above points, preferably the thickness of the highly resistive film is in the range of 50 to 500 nm.

Considering that the sheet resistivity R/□ is ρ/t and that preferable ranges of R/□ and t are as described above, preferably the specific resistance ρ of the antistatic films is from 10 to $10^{10}$ Ωcm. In order to realize more preferable ranges of sheet resistivity and film thickness, desirably ρ is form $10^4$ to $10^8$ Ωcm.

As described above, the temperature of the spacer rises when current flows through the antistatic film formed thereon or when the entire display generates heat during its operation. If the antistatic film has a temperature coefficient of resistance which is significantly negative, its resistance value decreases with temperature increase, which leads to increase in the current flowing through the spacer, and hence increase in temperature. And the current continues to rise till the power source reaches its limits. Empirically, the values of temperature coefficient of resistance at which such a thermal runaway lakes place are negative and their absolute values are 1% or larger. In other words, it is preferable that the temperature coefficient of resistance of the antistatic film is more than −1%.

As a material having an antistatic film property, metal oxides are excellent. Among the metal oxides, the oxides of chromium, nickel and copper are preferable materials. The reason is considered to be that their efficiency in emitting secondary electrons is relatively low, accordingly, the spacers are hard to be charged even if the electrons emitted from the electron emission devices collide with them. Among the materials other than metal oxides, carbon is a preferable material because its efficiency in emitting secondary electrons is low. Since amorphous carbon is particularly highly resistive, the use of it makes it easier to control the resistance value of the spacer as desired.

However, the above metal oxides and carbon are hard to adjust their resistance value to the specific resistance range desirable for an antistatic film, in addition, their resistance values are easily changed by the atmosphere. Thus these materials alone lack resistance controllability.

The nitrides of aluminum-transition metal alloy are suitable materials because their resistance values can be controlled over a wide range from a good conductor to an insulating material by adjusting the composition of the transition metal. In addition, since their resistance values change only a little in the production process of an image display described below, they are stable materials. Further, since the temperature coefficients of resistance are more than −1%, they are easy to practically use. The above transition metals include, for example, Ti, Cr and Ta.

[Composition Range for Obtaining Preferable Specific Resistance]

The antistatic film in accordance with the present invention may be such that a metal oxide film or a carbon film whose secondary electron emission coefficient δ is small is laminated as a top coat layer on a film of aluminium-transition metal alloy nitride (hereinafter referred to as "alloy nitride film" for short). The resistance value of the antistatic film as a whole is almost specified by the resistance value of the alloy nitride film, and the top coat layer functions for restricting the antistatic performance. Since the resistance value of the top coat layer varies depending on the atmosphere, as described above, the thickness of the top coat layer should be determined so that its resistance value will be more than one-half of the resistance value of the antistatic film. However, if the specific resistance of the top coat layer is high, it is difficult to allow the electrons accumulated on its surface to escape; thus, the thickness of the top coat layer is restricted, and preferably the value is equal to or less than 20 nm.

The above alloy nitride film is formed on the insulating member using the thin film formation methods such as sputtering, reactive sputtering in the nitrogen gas atmosphere, electron beam evaporation, ion plating, and ion assist evaporation. The metal oxide films can be also formed using the same thin film formation methods as above, in this case, however, oxygen gas is used instead of nitrogen gas. The other methods, such as CVD and alkoxide application, are also applicable to the formation of the metal oxide films. The carbon film is formed using the methods such as evaporation, sputtering, CVD and plasma CVD, and in cases where amorphous carbon film is formed, the atmosphere is made to contain hydrogen or hydrocarbon gas is used for the deposition gas.

The above alloy nitride film and the top coat layer may be formed in separate systems, the adhesion of the top coat layer, however, becomes better when those two are continuously laminated.

The antistatic films of the present invention have been described in terms of preventing static electricity of the spacers of a planar image display, their applications are, however, not limited to this, they can be used as an antistatic film in a different way.

The spacer provided with the above highly resistive film is characterized in that it has a low resistive film on the portion in contact with the upper and lower substrates, which makes possible the restriction of the local accumulation of charges in the vicinity of the spacer-anode/cathode junctions. Preferably the resistance value of the low resistive film is 1/10 times or less as high as that of the above highly resistive film and $10^7$ [Ω/□] or lower, by sheet resistivity, in order to obtain its satisfactory electrical connection with the upper and lower substrates. In terms of obtaining devices having a simpler structure as well as obtaining a high luminance, the above electron emission devices are more preferably characterized in that they are cold cathode devices, include an electrically conductive film comprising an electron emission portion between the pair of electrodes, and are surface conduction electron emission devices.

The electron beam apparatus to which the art of the present invention is applied can be also used as an image producer for producing an image by exposing the aforementioned target to the electrons emitted from the above electron emission device in response to input signals. In terms of image recording, there are various materials applicable to the above target which make possible the formation of a latent image, however the target consisting of fluorescent substances allows to record and display dynamic images at lower cost.

[Rough Summary of Image Display]

The construction of display panels of image displays to which the present invention is applied and the method of producing such panels will be described taking concrete examples.

FIG. 17 is a perspective view, partially broken away, showing a display panel used in the embodiments with the internal structure being visualized.

In the figure, reference numeral 1015 designates a rear plate, numeral 1016 a side wall, numeral 1017 a face plate, and 1015 to 1017 form a hermetic container for maintaining the inside of the display panel vacuum. When assembling the hermetic container, the junctions of each member need to be sealed so as to maintain a sufficient strength and airtightness. And the sealing was achieved by, for example, coating the junctions with frit glass and firing them at 400 to 500° C. in the atmospheric air or in the nitrogen atmosphere for more than 10 minutes. The method of evacuating the hermetic container will be described below. Since the inside of the above hermetic container is maintained at vacuum of about $10^{-6}$ [Torr] ($1.33\times10^{4}$ Pa), spacers 1020 as an atmospheric-pressure resistant structure are provided so as to prevent the hermetic container from being fractured by atmospheric pressure or a sudden impact.

Then substrates of electron emission devices applicable to the image producer of the present invention will be described.

The substrate of an electron source for use in the image producer of the present invention is formed with multiple cold cathode devices arranged on it.

There are several ways of arranging cold cathode devices. For example, a ladder arrangement is such that cold cathode devices are arranged in a row and connected to each other at each of their ends through wiring (hereinafter referred to as "ladder arrangement electron source substrate"). And a simple matrix arrangement is such that each pair of device electrodes of cold cathode devices ar connected to each other through the wiring in the X direction and wiring in the Y direction (hereinafter referred to as "matrix arrangement electron source substrate"). Image producers comprising a ladder arrangement electron source substrate need a control electrode (grid electrode) for controlling the flight of the electrons emitted from the electron emission devices.

On the rear plate 1015 is fixed a substrate 1011 on which N×M cold cathode devices 1012 are formed (wherein N, M are the positive integers of 2 or more and they are set properly according to the number of the pixel to be displayed. For example, in the image displays for high-definition televisions, desirably N is set for 3000 and M is set for 1000 or more). The above N×M cold cathode devices are wired in a simple matrix with M rows of wiring 1013 and N columns of wiring 1014. The portion consisting of the above 1011 to 1014 is called a multiple electron beam source.

For the multiple electron beam sources for use in the image display of the present invention, the material and shape of the cold cathode devices as well as the production method thereof are not restricted at all as long as they are wired in a simple matrix or arranged in a ladder form.

Accordingly, cold cathode devices, such as surface conduction electron emission devise. FE type devices and MIM type devices, are applicable.

Now the structure of the multiple electron beam source will be described where surface conduction electron emission devices (described below), as cold cathode devices, are arranged in a simple matrix wiring on the substrate.

Figure 19A:
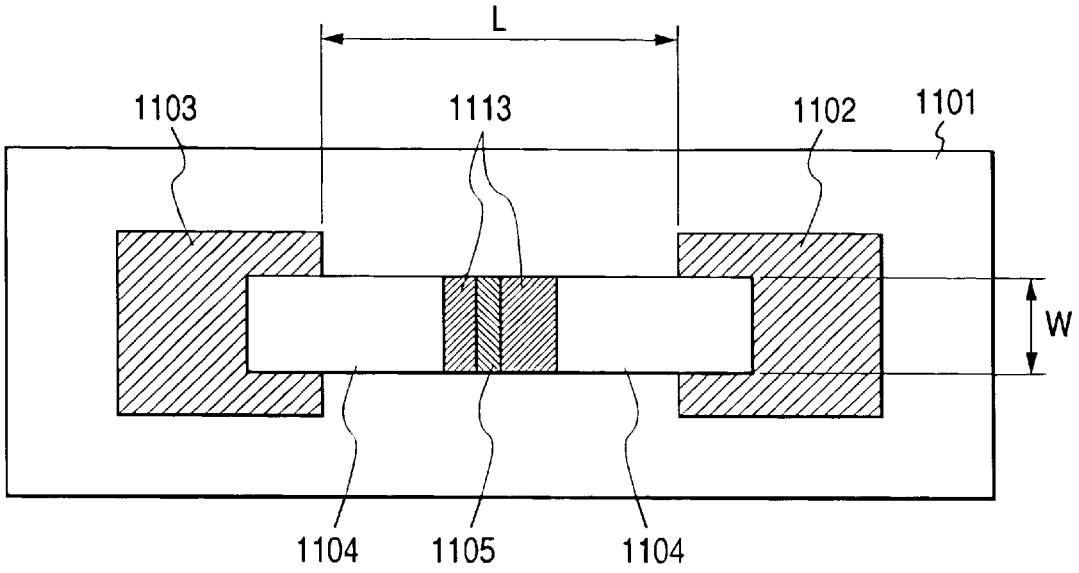
FIG. 19A is a plan view of the planar surface conduction electron emission device used in the embodiments of the present invention.
Figure 19B:
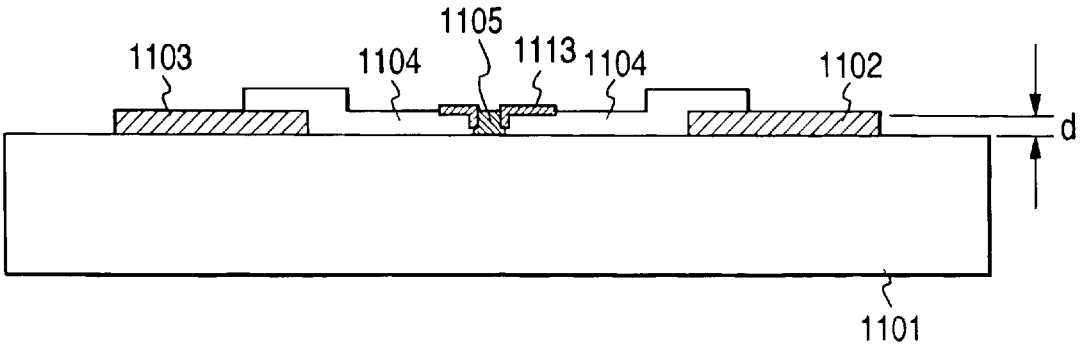
FIG. 19B is a sectional view of the same.
Figure 20:
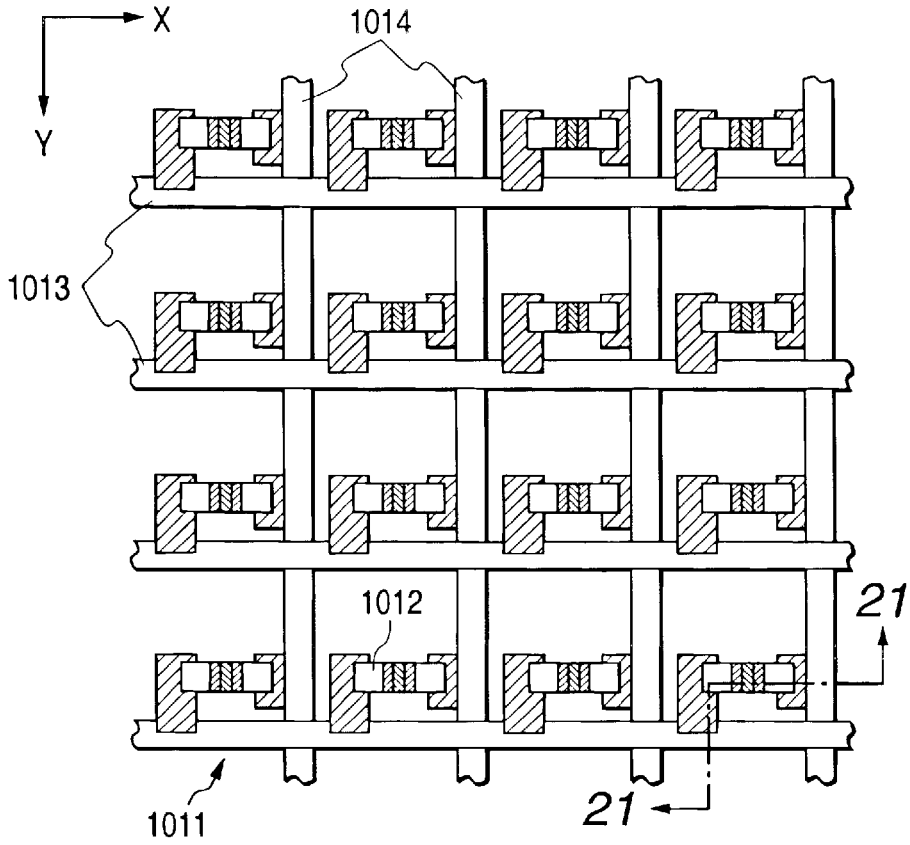
FIG. 20 is a plan view of the substrate of multiple electron beam sources used in one embodiment of the present invention.

Referring to the drawings, FIG. 17 shows a plan view of the multiple electron beam source used in the display panel of FIG. 20. On the substrate 1011, are arranged the same surface conduction electron emission devices 1012 as shown in FIGS. 19A and 19B described below which are wired in a simple matrix arrangement with row wiring 1013 and column wiring 1014. On the portion where the row wiring 1013 and the column wiring 1014 intersect, an insulating layer (not shown in the figure) is formed between the electrodes so as to keep them electrically insulating.

Figure 21:
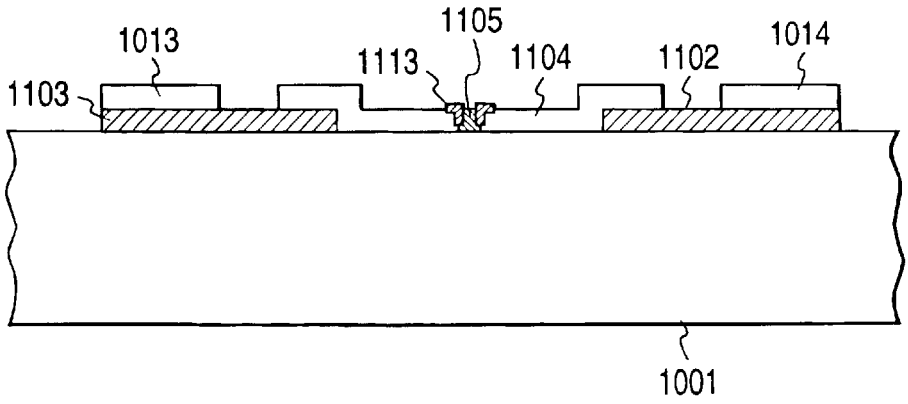
FIG. 21 is a sectional view of part of the substrate of multiple electron beam sources used in one embodiment of the present invention.

FIG. 21 is a cross sectional view of the multiple electron beam source of FIG. 20, taken along the line 21—21.

The multiple electron beam source having such a structure was produced in such a manner that, first, row wiring 1013, column wiring 1014, an insulating layer between electrodes (not shown in the figure), and an device electrode and conductive thin film of a surface conduction electron emission devices 1012 were formed on a substrate, then energization forming processing (described below) and energization activation processing (described below) were conducted by feeding power to each device via row wiring 1013, column wiring 1014.

The present embodiment has been described taking for example the construction where the substrate of the multiple electron beam source 1011 is fixed on the rear plate 1015 of the hermetic container. However, the substrate of the multiple electron beam source 1011 itself may be used as a rear plate of the hermetic container as long as the substrate 1011 has a sufficient strength.

Figure 22A:
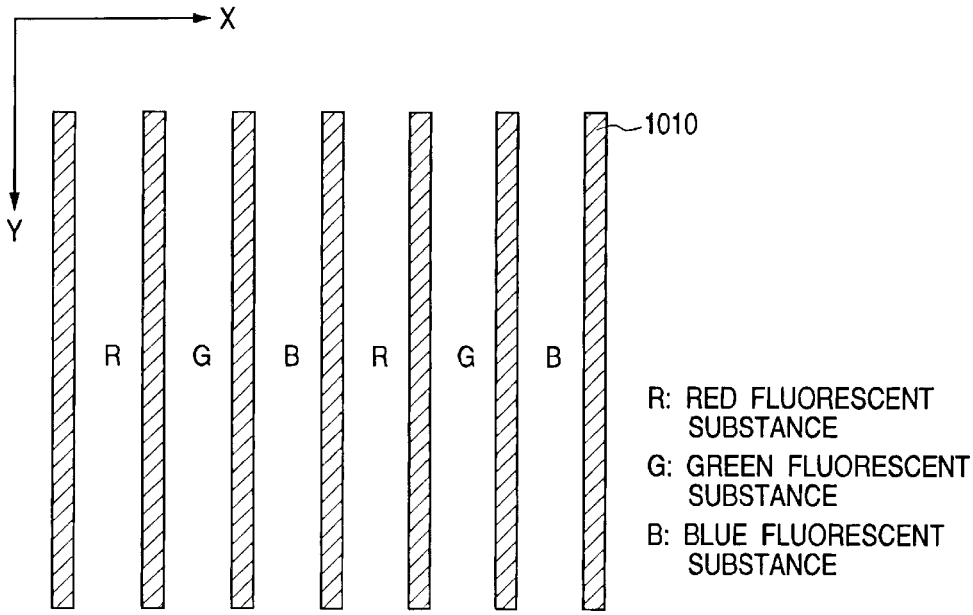
FIGS. 22A and 22B are plan views illustrating the arrangement of fluorescent substances on a face plate of a display panel.
Figure 22B:
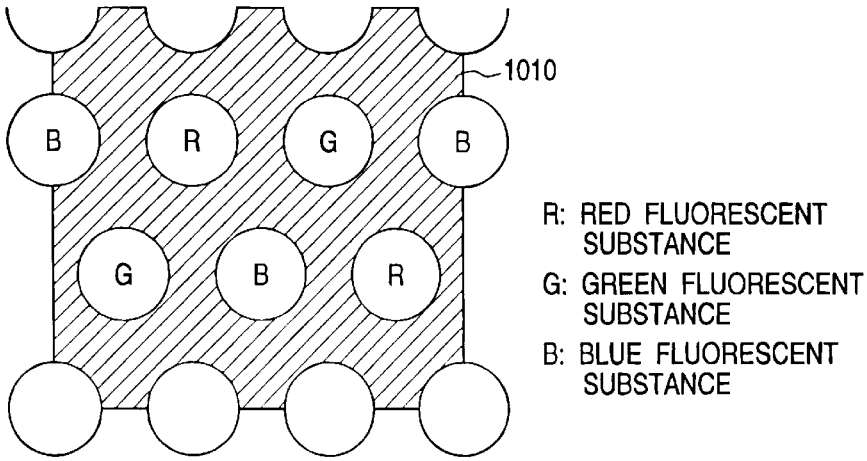

On the rear side of the face plate 1017 is formed a fluorescent film 1018. Since the present embodiment is a color image display, the portion of the fluorescent film 1018 is coated with fluorescent substances of the three primary colors: red, green and blue, which are used in the art of CRT, in a certain pattern. The fluorescent substances of the three different colors are coated on the film, for example, in stripes as shown in FIGS. 22A and 22B, and between the strips is provided a black conductor 1010. The purposes of providing the conductor 1010 are, for example, to prevent the occurrence of shear in display color when electron beams a little bit deviate from the right position, to prevent the reflection of external right so as not to decrease the display contrast, and to eliminate the charge-up of the fluorescent film resulting from the exposure to electron beams. Although graphite was used for the black conductor 1010 as a main component, the materials are not limited to this as long as they answer the above purposes.

The coating patterns of the three primary colors are not limited to the stripes shown in FIG. 22A, either; a delta pattern and the other patterns (for example, the pattern shown in FIG. 23) are also applicable as shown in FIG. 22B.

When producing display panels in monochrome, the fluorescent substance of a single color is used for the fluorescent film 1018 and the black conductor 1010 is not necessarily used.

On one side, which is nearer to the rear plate, of the fluorescent film 1018 is provided a metal back 1019, which is well known in the art of CRT. The purposes of providing the metal back 1019 are, for example, to subject part of the light emitted by the fluorescent film 1018 to its mirror reflection and improve a light usage ratio, to protect the fluorescent film 1018 against the collision with negative ions, to utilize it as an electrode for applying an accelerating voltage to electron beams, and to utilize it as a conductive path for electrons emitted by the fluorescent film 1028 in an excited state. The metal back 1019 was formed in such a manner that, first, a fluorescent film 1018 was formed on the face plate substrate 1017, then the fluorescent film was subjected to smoothing processing, followed by vacuum deposition with Al. When a material for a low voltage is used for the fluorescent film 1018, the metal back 1019 is not necessarily used.

Although it was not used in the present embodiment, a transparent electrode made of, for example, ITO may be provided between the face plate substrate 1017 and the fluorescent film 1018 in order to apply an accelerating voltage and to improve the conductivity of the fluorescent film.

Figure 18:
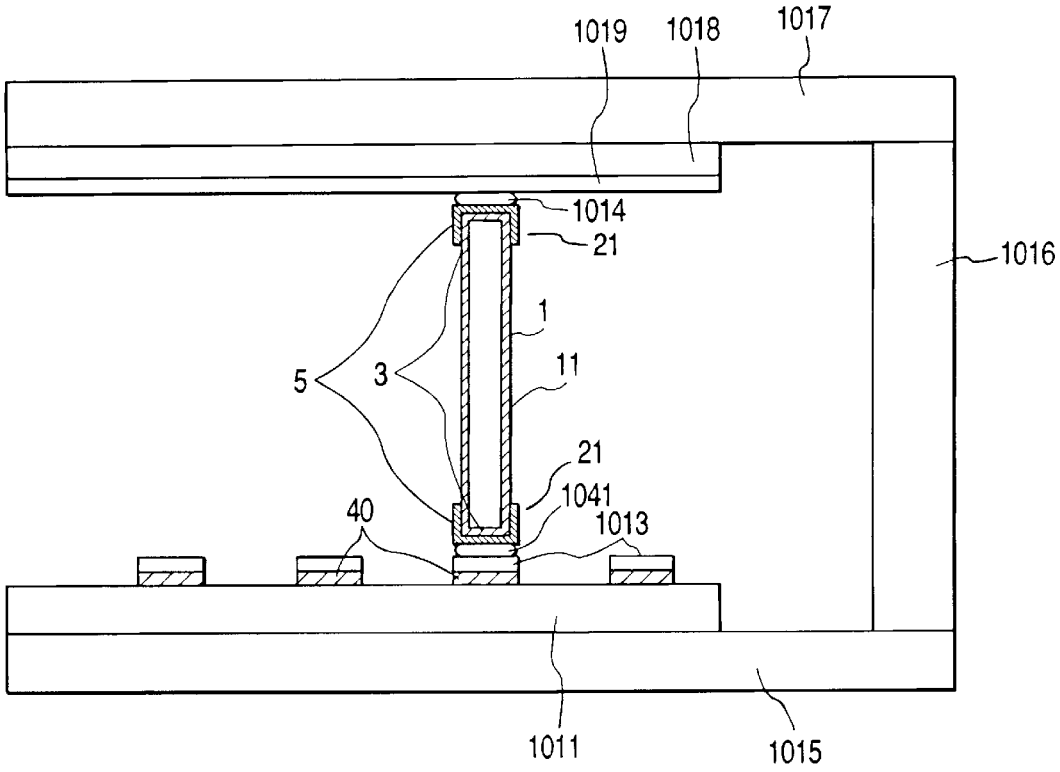
FIG. 18 is a sectional view of the display panel of FIG. 8 taken along the line 18—18.

FIG. 18 is a schematic sectional view of the display panel of FIG. 17, taken along the line 18—18, and reference numerals of each portion correspond to those of FIG. 17. The spacer 1020 consists of a member including an insulating member 1, a highly resistive film 11 formed on the surface of the above insulating member 1 to prevent static electricity, and a low resistive film 21 formed on touching portions 3 facing the inside of the face plate 1017 (metal back 1019 or the like) and the surface of the substrate 1011 (row wiring 1013 or column wiring 1014), respectively, as well as on the side surfaces 5 which is in contact with the above touching portions 3. The necessary number of the spacers are spaced and fixed to the inside of the face plate and the surface of the substrate 1011 via a joining material 1041. The highly resistive film is formed on the surface of the insulating member 1 at least at the portion exposed to vacuum within the hermetic container, and it is electrically connected to both the inside of the face plate 1017 (metal back 1019 or the like) and,the surface of the substrate 1011 (row wiring 1013 or column wiring 1014) via the low resistive film 21 on the spacer 1020 and the joining material 1041. In the embodiments described here, the shape of the spacer 1020 is in a form of a thin plate, the spacer is arranged in parallel to the row wiring 1013 and is electrically connected thereto.

The spacer 1020 needs to have a sufficient insulating property to withstand a high voltage applied between the row wiring 1013/the column wiring 1014 on the substrate 1011 and the metal back 1019 inside of the face plate 1017. At the same time it needs to have a sufficient conductivity to prevent itself from being charged.

The insulating member 1 of the spacer 1020 includes ceramics member, such as quartz glass, glass with impurities such as Na and so on reduced in it, soda-lime glass, and alumina. Preferably the insulating member 1 is such that its thermal expansion coefficient is close to that of the member constituting the hermetic container and the substrate 1011.

As a material for the highly resistive film 11, which has an antistatic property, therefore, is used for an antistatic film as described above, metal oxides, for example, are applicable. Among the metal oxides, the oxides of chromium, nickel and copper are preferable materials. The reason is considered to be that their efficiency in emitting secondary electrons is relatively low, accordingly, the spacers 1020 are hard to be charged even if the electrons emitted from the cold cathode devices 1012 collide with them. Among the materials other than metal oxides, carbon is a preferable material because its efficiency in emitting secondary electrons is low. Since amorphous carbon is particularly highly resistive, the use of it makes it easier to control the resistance value of the spacer as desired.

As described above, as another material for the highly resistive film 11, which has an antistatic property, however, the above metal oxides and carbon are hard to adjust their resistance value to the desired specific resistance range as an antistatic film, in addition, their resistance values are easily changed by the atmosphere. Thus these materials alone lack resistance controllability.

As described above, the nitrides of aluminum-transition metal alloy are suitable materials because their resistance values can be controlled over a wide range from a good conductor to an insulating material by adjusting the composition of the transition metal. In addition, since their resistance values change only a little in the production process of an image display described below, they are stable materials. Further, since their temperature coefficients of resistance are more than −1%, they are easy to practically use. The above transition metals include, for example, Ti, Cr and Ta.

As described above, the above alloy nitride film is formed on the insulating member using the thin film formation methods such as sputtering, reactive sputtering in the nitrogen gas atmosphere, electron beam evaporation, ion plating, and ion assist evaporation. The metal oxide film can be also formed using the same thin film formation methods as above, in this case, however, oxygen gas is used instead of nitrogen gas. The other methods, such as CVD and alkoxide application, are also applicable to the formation of the metal oxide films. The carbon film is formed using the methods such as evaporation, sputtering, CVD and plasma CVD, and in cases where amorphous carbon film is formed, the atmosphere is made to contain hydrogen or hydrocarbon gas is used for the deposition gas.

The purpose of providing a low resistive film 21 to the spacer 1020 as a component thereof is to electrically connect the highly resistive film 11 with both of the face plate 1017 (metal back 1019 or the like) having a higher voltage and the substrate 1011 (wiring 1013, 1014 or the like) having a lower voltage. Thus, hereinafter it is sometimes referred to as an intermediate electrode layer (intermediate layer). The intermediate electrode layer (intermediate layer) can have multiple functions listed below.

(1) To Electrically Connect the Highly Resistive Film 11 to the Face Plate 1017 and the Substrate 1011

As described above, the highly resistive film 11 is provided to prevent the surface of the spacer 1020 from being charged. However, when the highly resistive film 11 is connected with both of the face plate 1017 (metal back 1019 or the like) and the substrate 1011 (wiring 1013, 1014 or the like) directly or via the joining material 1041, a large contact resistance may be generated at the interface of their connection, which may make impossible the prompt elimination of the charges generated on the surface of the spacer 1020. In order to avoid this, the intermediate layer of low resistance is provided on the touching portion 3 of the spacer 1020 which is in contact with the face plate 1017, the substrate 1011 and the joining material 1041, and the side surface 5 of the spacer 1020.

(2) To Allow the Voltage Distribution of the Highly Resistive Film 11 to Become Uniform The electrons emitted form a cold cathode device 1012 form an electron orbit in accordance with the voltage distribution formed between the face plate 1017 and the substrate 1011. In order to prevent the disorder of the electron orbit from taking place in the vicinity of the spacer 1020, it is necessary to control the voltage distribution of the highly resistive film 11 over the entire region. When the highly resistive film 11 is connected to the face plate 1017 (metal back 1019 or the like) and the substrate 1011 (wiring 1013, 1014 or the like) directly or via the joining material 1041, non-uniformity occurs in the connecting state due to the generation of contact resistance at the interface of their connection. As a result, it is likely that the voltage distribution of the highly resistive film 11 will deviate from the desired value. In order to avoid this, the intermediate layer of low resistance is provided on the entire length of the end portion of the spacer (touching surface 3 or side surface 5) where the spacer 1020 and both the face plate 1017 and the substrate 1011 abut with each other. The voltage of the highly resistive film 11 can be controlled over the entire region by applying the desired voltage to this intermediate layer.

(3) To Control the Orbit of the Emitted Electrons

The electrons emitted from a cold cathode device 1012 form an electron orbit in accordance with the voltage distribution formed between the face plate 1017 and the substrate 1011. For the electrons emitted form the cold cathode device 1012 in the vicinity of the spacer, restriction involved with the installation of the spacer 1020 (changes in wiring, device position etc.) may occur. In such a case, in order to produce an image free from distortion and non-uniformity, it is necessary to control the orbit of the emitted electrons so that the desired position on the face plate 1017 is exposed to the electrons. Providing a low resistive intermediate layer on the side surfaces 5 where the spacer and both of the face plate 1017 and the substrate 1011 abut with each other makes possible the realization of a desired property in the voltage distribution in the vicinity of the spacer 1020, which in turn enables the control of the orbit of the emitted electrons.

The low resistive film 21 can he selected from the films containing materials whose resistance value is lower than the materials of the highly resistive film 11 by an order of magnitude. The material of the low resistive film 21 is properly selected from the group consisting of metals such as Ni, Cr, Au, Mo, W, Pt, Ti, Al, Cu and Pd or their alloy, printed conductor consisting of metals such as Pd, Ag, Au, $RuO_2$, Pd-Ag or their oxides and glass etc., a transparent conductor such as $In_2C_3$—$SnO_2$, and semiconductor material such as poly-silicon.

The joining material 1041 needs to have conductivity so that the spacer 1020 can electrically connect to the row wiring 1013 and the metal back 1019. Specifically, frit glass to which a conductive adhesive material, metal particles and a conductive filler are added is suitable.

Referring to the drawings again, in FIG. 17, Dx1 to Dxm and Dy1 to Dyn and Hv designate terminals for electrical connection of a hermetic structure provided to electrically connect the display panel to electric circuits not shown in the figure. Dx1 to Dxm, Dy1 to Dyn and Hv electrically connect with the row wiring 1013 of the multiple electron beam source, the column wiring 1014 of the multiple electron beam source and the metal back 1019 of the face plate, respectively.

In order to evacuate the hermetic container, an exhaust tube and a vacuum pump, both of which are not shown in the figure, are connected to each other after the hermetic container is assembled. The hermetic container is evacuated to the vacuum degree of about $10^{-7}$ [Torr] ($1.33\times10^{-5}$ Pa). The exhaust tube is to be sealed after the evacuation, immediately before or after the sealing, however, a getter film (not shown in the figure) is formed in a prescribed position within the hermetic container to maintain the vacuum degree within the container. A getter film means a film formed by subjecting a getter material whose main component is Ba to heating with a heater or high-frequency heating dud evaporation. Due to the adsorption of the above getter film, the vacuum degree inside the hermetic container is kept $1\times10^{-10}$ to $1\times10^{-10}$ [Torr] ($1.3\times10^{-5}$ to $1.3\times10^{-4}$ Pa).

In the image displays using the display panel described above, electrons are emitted from each of the cold cathode devices 1012 when applying a voltage to each of the devices 1012 through the terminals Dx1 to Dxm and Dy1 to Dyn outside the container. When applying a voltage of from several hundreds volt [V] to several kilovolt [kV] to the metal back 1019 through the terminal Hv outside the container while applying a voltage to each device 1012, the above emitted electrons are accelerated and collide against the inner surface of the face plate 1017. This excites the differently colored fluorescent substances constituting the fluorescent film 1018 and allows them to emit light, which leads to displaying images.

Normally, the voltage applied to the surface conduction electron emission device 1012, which is a cold cathode device, of the present invention is from about 12 to 16 [V], the distance d of the metal back 1019 from the cold cathode electrode 1012 is from about 0.1 [mm] to 8 [mm], and the voltage between the metal back 1019 and the cold cathode electrode 1012 is from about 0.1 [kV] to 10 [kV].

The basis construction of the display panel embodying the present invention and the production method thereof as well as the rough summary of the image display have been described above.

Now the method of producing a multiple electron beam source used for the display panel of the above embodiment will be described. Any multiple electron beam sources can be used for the image display of the present invention as long as multiple cold cathode devices are arranged in a simple matrix and wired or they are arranged in a ladder form and wired. The material, shape and production method of the cold cathode devices are not restricted at all. Thus, cold cathode devices such as surface conduction electron emission devices, FE type devices or MIM type devices are all applicable.

Among these types cold cathode devices, however, the surface conduction electron emission devices are especially preferable, if an image display is required such that its display screen is large and its price is low. Specifically, in FE type devices, their electron emission properties are largely dependent on the relative position of an emitter cone and a gate electrode as well as their shape, consequently their production technique requires an extremely high accuracy. This is a disadvantageous factor when trying to achieve an enlarged display screen or a reduced production cost. In MIM type devices, it is required that the film thickness of the insulating layer and the upper electrode should be thin and uniform. This is also a disadvantageous factor when trying to achieve an enlarged display screen or a reduced production cost. In that respect, in the surface conduction electron emission devices, their production method is relatively simple, therefore, it is easy to obtain an enlarged display screen and reduce the production cost. Further, it has been found by the present inventors that, among the surface conduction electron emission devices, the one whose electron emission portion or its periphery is formed with fine-particle film is especially excellent in electron emission properties and easy to produce. Accordingly, the above one can be said to be most suitable for use in the multiple electron beam sources of image displays having a high luminance and a large screen. Thus, in the display panel of the above embodiment were used the surface conduction electron emission devices whose electron emission portion or its periphery is formed with fine-particle film. Now the basic construction of the suitable surface conduction electron emission devices, the production method thereof and the characteristics thereof will be described, followed by describing the structure of the multiple electron beam source in which multiple devices are wired in a simple matrix.

[Suitable Construction of Surface Conduction Electron Emission Devices and Method of Producing Thereof]

There are two types of typical construction of surface conduction electron emission devices in which the electron emission portion or its periphery is formed of fine-particle film: planar type and vertical type.

[Planar Surface Conduction Electron Emission Devices]

First, the construction of planar surface conduction electron emission devices and the production method thereof will be described. Referring to the drawings, FIG. 19A is a plan view illustrating a construction of a planar surface conduction electron emission device and 19B is a sectional view illustrating the same. In the Figures, reference numeral 1011 designates a substrate, numerals 1102 and 1103 device electrodes, 1104 a conductive thin film, 1105 an electron emission portion formed by the energization forming processing, and 1113 a film formed by the energization activation processing.

For the substrate 1011, various types glass substrates including, for example, quartz glass and green sheet glass, various types ceramics substrates including alumina, or the above various types substrates with an insulating layer of, for example, $SiO_2$ laminated thereon can be used.

The device electrodes 1102 and 1103 provided opposite to each other on the substrate 1011 parallel thereto are formed of conductive materials. The material may be properly selected from the group consisting of metals including, for example, Ni, Cr, Au, Mo, W, Pt, Ti, Cu, Pd and Ag or their alloys, metal oxides including $In_2O_3$—$SnO_2$, semiconductor such as poly-silicon and so on. The device electrodes 1102 and, 1103 can be easily formed by combining the film formation technique such as vacuum deposition and the patterning technique such as photolithography and etching, however the other techniques (for example, printing technique) may also be used.

The shape of the device electrodes 1102 and 1103 is properly designed to suit for the purpose of applying the electron emission device concerned. Generally, the devices are usually designed in such a manner that the electrodes are spaced at intervals ranging from several hundreds Å to several hundreds μm. In order to apply the devices to an image display, preferably the intervals are selected in the range of several μm to several tens μm. The thickness of the device electrodes d is properly selected among the values ranging from several hundreds Å to several μm.

In the portion of the conductive thin film 1104, fine-particle film is used. The fine-particle film mentioned herein means the film containing multiple fine particles (including island-shaped aggregation) as a component. When microscopically examining the fine-particle film, the structure is observed where individual fine particles are spaced at certain intervals, or they are adjacent to each other, or they are overlapping with each other.

The diameter of the fine particles used in the fine-particle film is in the range of several Å to several thousands Å, preferably in the range of 10 Å to 200 Å. The thickness of the fine-particle film is properly set considering the conditions described below. That is, the conditions required under which the film is electrically satisfactorily connected with the device electrodes 1102 and 1103, the conditions required under which the film satisfactorily undergoes energization forming, the conditions required under which the electric resistance of the film itself has a proper value as described below, and so on. In particular, the thickness of the fine-particle film is set for any one of the values ranging from several Å to several thousands Å, preferably any one of the values ranging from 10 Å to 500 Å.

The materials may be used in the formation of the fine-particle film is properly selected from the group consisting of, for example, metals including Pd, Pt, Ru, Ag, Au, Ti, In, Cu, Cr, Fe, Zn, Sn, Ta, W and Pb, oxides including PdO, $SnO_2$, $In_2O_3$, PbO and $Sb_2O_3$, borides including $HfB_2$, $ZrB_2$, $LaB_6$, $CeB_6$, $YB_4$, and $GdB_4$, carbides including TiC, ZrC, HfC, TaC, SiC and WC, nitrides including TiN, ZrN and HfN, semi-conductor including Si and Ge, and carbone.

The conductive thin film 1104 is formed of fine-particle thin film, as described above, and its sheet resistivity is set for any one of the values ranging from $10^3$ to $10^7$ Ω/□.

Since it is desirable that the conductive thin film 1104 and the device electrodes 1102 and 1103 are electrically satisfactorily connected, the structure of the devices is designed in such a manner that both of them partly overlap with each other. The substrate, the device electrodes and the conductive thin film are laminated in this ascending order in the example shown in FIGS. 19A and 19B, however, the substrate, the conductive thin film and the device electrodes may be laminated in this ascending order depending on the situation.

The electron emission portion 1105 is the crack-shaped portion formed on a part of the conductive thin film 1104 and electrically more resistive than its surroundings. The crack is formed by subjecting the conductive thin film 1104 to energization forming processing describe below. There are cases in which the fine particles of several Å to several hundreds Å in diameter are arranged in the crack. Incidentally, it is very difficult to illustrate the details of the position and shape of the actual electron emission portion precisely and exactly, therefore, they are schematically shown in FIGS. 19A and 19B.

The thin film 1113 is a film formed of carbon or its compound which coats the electron emission portion 1105 and its vicinities. The thin film 1113 is formed by subjecting the conductive thin film 1104 to energization activation processing after energization forming processing.

The thin film 1113 is formed of any one of single crystal graphite, polycrystal graphite and noncrystalline carbon, or the mixture thereof, and its thickness is preferably 500 [Å] or lower, more preferably 300 [Å] or lower. Incidentally, it is very difficult to illustrate the details of the position and shape of the actual thin film 1113, therefore, they are schematically shown FIGS. 19A and 19B. In the plan view, FIG. 19A, the device is shown with the part of the thin film 1113 (the upper layer above 1105 removed.

The basic construction of preferred devices has been described above, and in the preferred embodiments used were the devices described below.

That is, for the substrate 1011 used was green sheet glass and for the device electrodes 1102 and 1103 used was Ni thin film. The thickness d of the device electrodes 1102 and 1103 was 1000 [Å], and their interval L was 2 [μm].

For the main material of the fine-particle film used was Pd or PdO, and the thickness and width W of the fine-particle film were 100 [Å] and 100 [μm], respectively.

Now the method of producing preferable planar surface conduction electron emission devices will be described. Referring to the drawings, FIGS. 24A to 24E are sectional views illustrating the process of producing of surface conduction electron emission devices. The reference numeral of each member corresponds to that of FIGS. 19A and 19B described above.

Figure 24A:
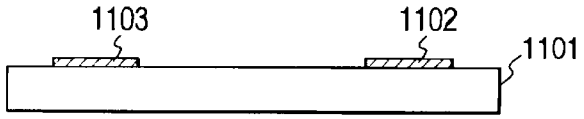
FIGS. 24A, 24B, 24C, 24D and 24E are sectional views showing the production process of a planar surface conduction electron emission device.

1) First, the device electrodes 1102 and 1103 are formed on the substrate 1011 as shown in FIG. 24A.

The substrate 1011 is cleaned sufficiently using a cleaning agent, deionized water and an organic solvent prior to forming the electrodes, then the material of device electrodes is deposited thereon. As a method of deposition, vacuum film formation techniques such as vacuum deposition, sputtering and so on are applicable. Succeedingly, the electrode material deposited is patterned using photolithography/etching techniques so as to form a pair of device electrodes 1102 and 1103 shown in FIG. 24A.

Figure 24B:
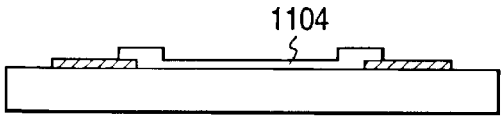

2) Second, the conductive thin film 1104 is formed, as shown in FIG. 24B.

When forming the thin film 1104, first the substrate shown in FIG. 24A is subjected to application of organic metal solution and drying, then a fine-particle thin film is formed thereon by heat firing processing, after which the thin film is patterned into a prescribed form by photolithography/etching. The organic metal solution mentioned herein means a solution of an organic metal compound of that main device is the same as the fine-particle material used in the conductive thin film. In particular, the main device used in the present embodiment was Pd. Although dipping process was used in the present embodiment as an application process, the other processes, for example, spinner process and spray process, are also applicable.

As a method of forming the conductive thin film 1104 of fine-particle film, the methods other than the one used in the present embodiment in which an organic metal solution is applied to the substrate, for example, vacuum deposition, sputtering and chemical vapor phase deposition can be used.

Figure 24C:
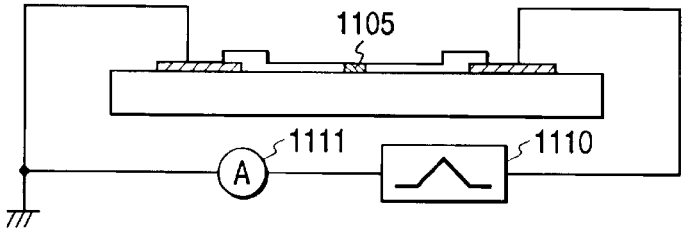

3) The electron emission portion 1105 is formed by conducting energization forming in which a proper voltage is applied between the device electrodes 1102 and 1103 through the forming source 1110 as shown in FIG. 24C.

Energization forming processing means that the conductive thin film 1104 formed of fine-particle film is energized to undergo a proper fracture, deformation or change in quality in a part thereof, so that its structure is suitably changed. In the portion of the conductive thin film formed of fine-particle film whose structure has undergone a change suitable for performing electron emission (that is, the electron emission portion 1105), the thin film has a proper crack formed on it. The electric resistance measured between the device electrodes 1102 and 1103 substantially increases after the electron emission portion 1105 is formed as compared with before its formation.

Figure 25:
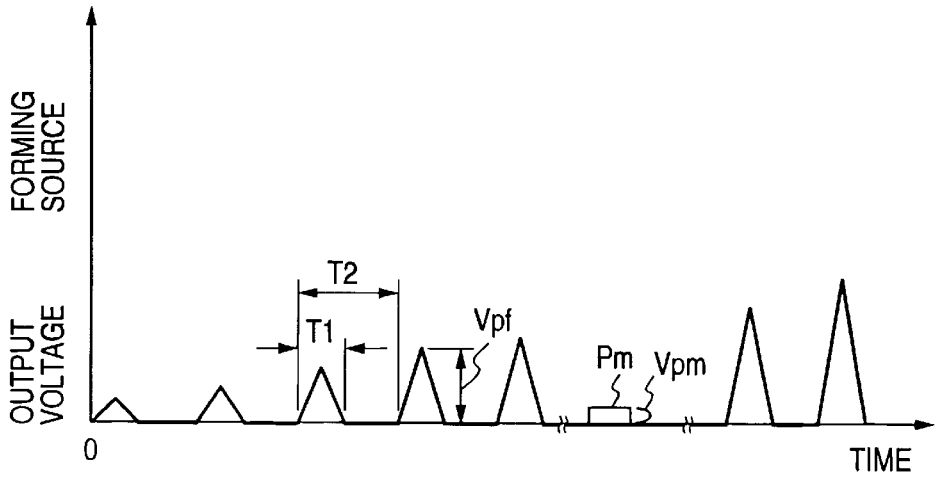
FIG. 25 is a voltage waveform presentation during energization forming processing.

In order to explain the energization processing more in detail, one example of the waveforms of a proper voltage applied through the forming source 1110 is shown in FIG. 25. When subjecting the conductive thin film 1104 formed of fine-particle film to the forming processing, preferably a pulse voltage is applied to the film. And in the present embodiment a triangular pulse voltage with a pulse width of T1 and a pulse spacing of T2 is continuously applied to the conductive thin film as shown in FIG. 16. In that case, the peak value of the triangular pulse voltage Vpf is increased step by step. A monitor pulse Pm for monitoring the state in which the electron emission portion 1105 is formed is inserted between the triangular pulses at a proper interval, and the current flow was measured with an ammeter 1111.

In the present embodiment, the peak value Vpf was adjusted in 0.1 [V] increments for each pulse under a vacuum atmosphere of the order of, for example, $10^{-5}$ [Torr] ($1.33\times10^{-3}$ Pa) while setting, for example, the pulse width T1 for 1 [msec] and pulse spacing T2 for 10 [msec]. The monitor pulse Pm was inserted once per every five triangular pulses. The voltage of the monitor pulse Vpm was set for 0.1 [V] in order not to affect the forming processing. The energization involved in the forming processing was terminated at the stage where the electric resistance between the device electrodes 1102 and 1103 became $1\times10^{6}$ [Ω], that is, the current measured with the ammeter 1111 while applying the monitor pulse became $1\times10^{-7}$ [A].

The above method is preferable with respect to the surface conduction electron emission devices of the present embodiment; accordingly, if the design of the surface conduction electron emission devices, such as the material or thickness of the fine-particle film or the intervals L of the device electrodes, is changed, desirably the energization conditions are properly changed.

Figure 24D:
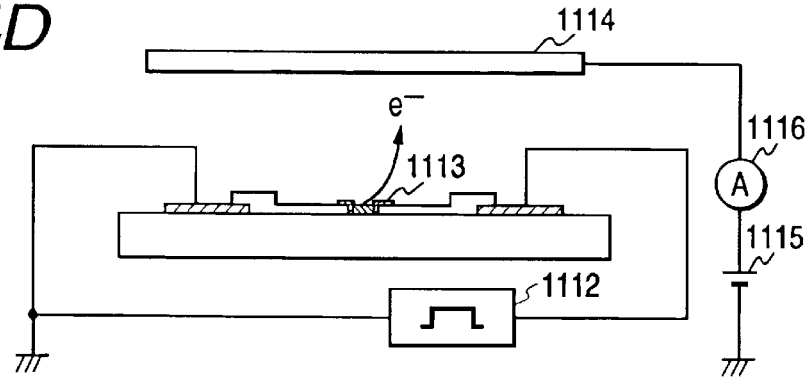

4) The electron emission properties are improved by conducting an energization activation processing in which a proper voltage is applied between the device electrodes 1102 and 1103 using an activation source 1112 as shown in FIG. 24D.

The energization activation processing means that carbon or its compound is caused to deposit in the vicinity of the electron emission portion 1105, which is formed by the above energization forming processing, by subjecting the portion to energization under proper conditions. (In the Figure, the deposition of carbone or its compound is schematically shown as a member 1113.) Typically, the energization activation processing provides a 100-fold or more increase in emission current as compared with before conducting the processing.

In particular, carbon or its compound originated from the organic compounds existing in a vacuum atmosphere is deposited in the vicinity of the electron emission portion 1105 by applying voltage pulses to the portion at regular intervals under a vacuum atmosphere within the range of $10^{-5}$ to $10^{-4}$ [Torr] ($1.3\times10^{-3}$ to $1.3\times10^{-2}$ Pa). The deposition 1113 is any one of single crystal graphite, polycrystal graphite and non-crystalline graphite, or the mixture thereof, and its thickness is preferably 500 [Å] or smaller, more preferably 300 [Å] or smaller.

Figure 26A:
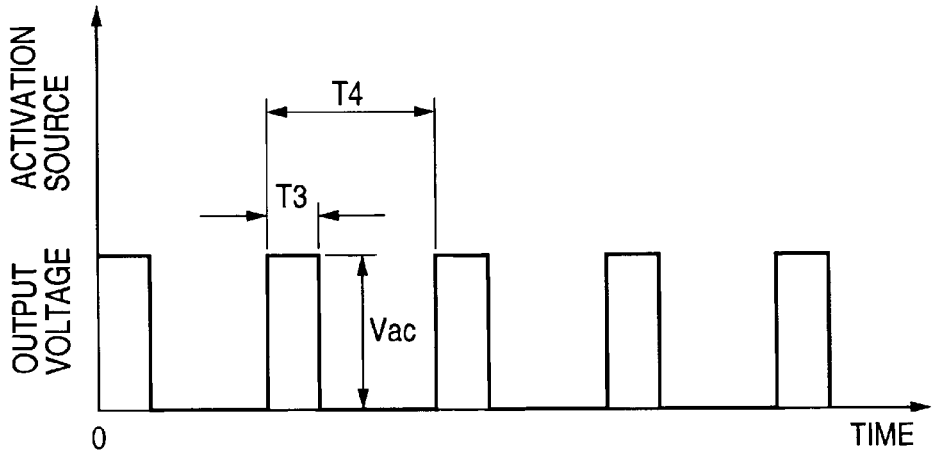
FIG. 26A is a presentation of a waveform of the voltage applied during energization activation processing.

In order to explain the energization processing more in detail, one example of the waveforms of a proper voltage applied through the activation source 1112 is shown in FIG. 26A. In the present embodiment, the energization activation processing was conducted by applying a rectangular wave of a certain voltage at regular intervals. In particular, the voltage of the rectangular wave Vac was 14 [V], the pulse width T3 was 1 [msec] and the pulse spacing T4 was 10 [msec]. The above energization conditions are preferable with respect to the surface conduction electron emission devices of the present embodiment; accordingly, if the design of the surface conduction electron emission devices is changed, desirably the conditions are properly changed.

Figure 26B:
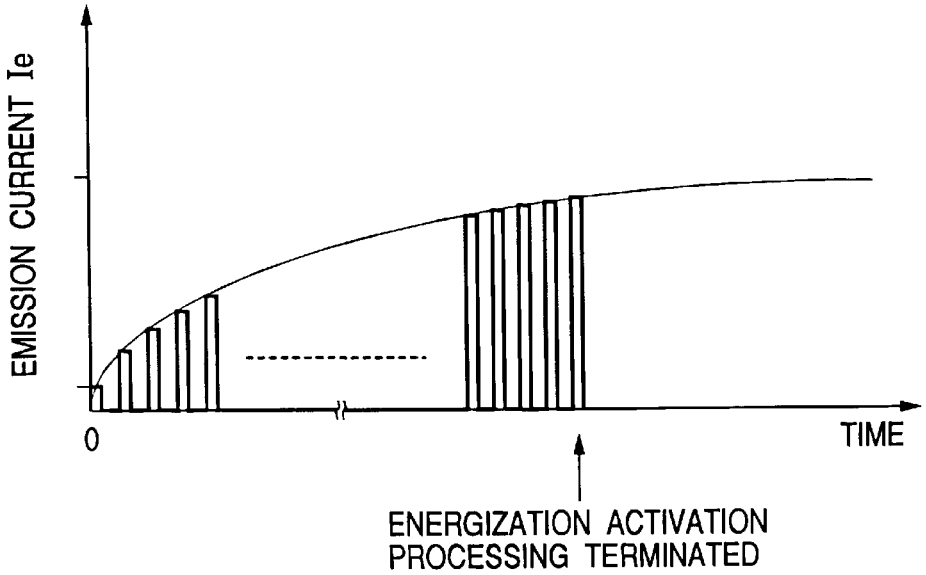
FIG. 26B is a presentation of the variation of emitted current Ie with time.

Referring to the drawings, reference numeral 1114 shown in FIG. 24D designates an anode electrode for capturing the emission current Ie emitted from the above surface conduction electron emission device, and it is connected with a direct current high voltage source 1115 and an ammeter 1116. (In cases where the activation processing is conducted after incorporating the substrate 1011 into the display panel, the fluorescent surface of the display panel is used as an anode electrode 1114.) While applying a voltage from the activation source 1112, the progress of the energization activation processing is monitored by measuring the emission current Ie with the ammeter 1116 and the operation of the activation source 1112 is controlled. One example of the emission currents Ie measured with the ammeter 1116 is shown in FIG. 26B. When starting to apply a pulse voltage from the activation source 1112, the emission current Ie increases with time, but it becomes saturated before long and comes to hardly increase. The energization activation processing is terminated at a time when the emission current Ie is almost saturated by stopping the application of the voltage from the activation source.

Incidentally, the above energization conditions are preferable with respect to the surface conduction electron emission devices of the present embodiment; accordingly, if the design of the surface conduction electron emission devices is changed, desirably the conditions are properly changed.

Figure 24E:
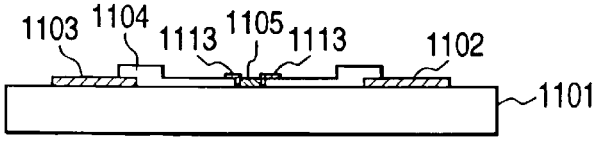

The planar surface conduction electron emission device shown in FIG. 24E was thus produced.

[Vertical Surface Conduction Electron Emission Devices]

Now, another typical construction of surface conduction electron emission devices whose electron emission portion or periphery is formed with fine-particle film, that is, the construction of vertical surface conduction electron emission devices will be described.

Figure 27:
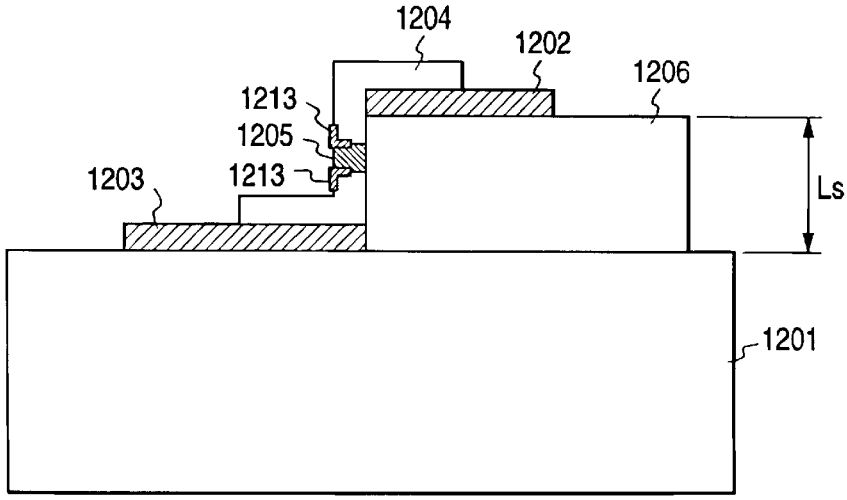
FIG. 27 is a sectional view of the vertical surface conduction electron emission device used in one embodiment of the present invention.

Referring to the drawings, FIG. 27 is a sectional view of a vertical surface conduction electron emission device illustrating its basic construction. In the figure, reference numeral 1201 designates a substrate, each of numerals 1202 and 1203 an device electrode, numeral 1206 a step formation member, numeral 1204 a conductive thin film using fine particles film, numeral 1205 an electron emission portion formed by conducting energization forming processing, and numeral 1213 a thin film formed by conducting energization activation processing.

The vertical type differs from the planar type in that one of the device electrodes (1202) is provided on the step formation member 1206 and one of the side surfaces of the step formation member 1206 is coated with the conductive thin film 1204. Accordingly, the intervals of the device electrodes L in the planar type shown in FIGS. 19A and 19B is set as a step height L of the step formation member 1206 in the vertical type. As for the materials of the substrate 1201, device electrodes 1202 and 1203, and the conductive thin film 1204 using fine-particle film, the materials listed in the description of the above planar type are applicable. For the step formation member 1206, an electrically insulating material such as $SiO_2$ is used.

Now, the method of producing vertical surface conduction electron emission devices will be described. Referring to the drawings, FIGS. 28A to 28F are sectional views for illustrating the production process of the vertical surface conduction electron emission devices, and reference numerals of each member designate the same member as in FIG. 27 described above.

Figure 28A:
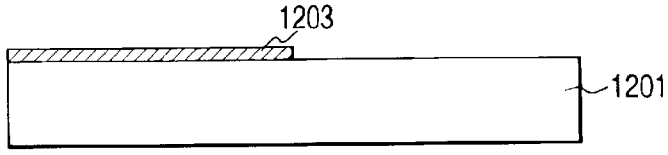
FIGS. 28A, 28B, 28C, 28D, 28E and 28F are sectional views showing the production process of a vertical surface electron emission device.

1) A device electrode 1203 is formed on the substrate 1201 as shown in FIG. 28A.

Figure 28B:
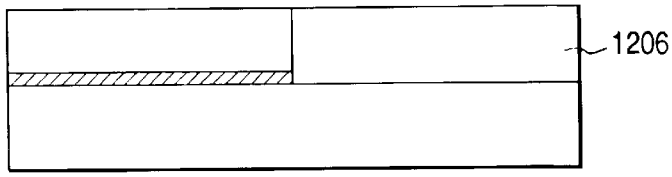

2) An insulating layer for forming the step formation member on it is laminated as shown in FIG. 28B. While the insulating layer is laminated with, for example, $SiO_2$ by sputtering, the other film formation processes such as vacuum deposition and printing process are also applicable.

Figure 28C:
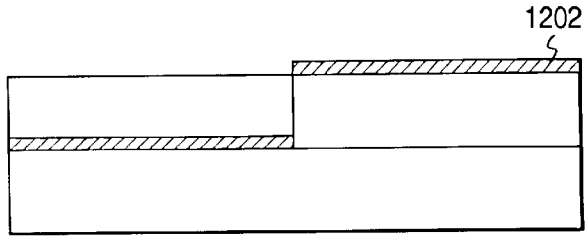

3) A device electrode 1202 is formed on the insulating layer as shown in FIG. 28C.

Figure 28D:
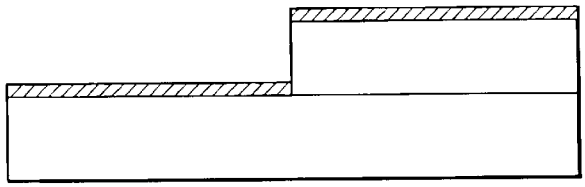

4) Part of the insulating layer is removed by, for example, an etching method so as to expose the device electrode 1203, as shown in FIG. 28D.

Figure 28E:
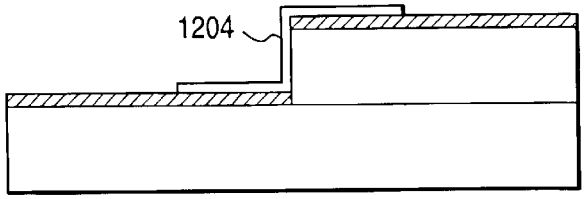

5) A conductive thin film 1204 using fine-particle film is formed as shown in FIG. 28E. For this film formation, film formation techniques such as application process can be used, like the above planar type.

6) Like the above planar type, an electron emission portion is formed by conducting energization forming processing. (The similar energization forming processing as described using FIG. 24C may be conducted.)

7) Like the above planar type, carbon or its compound is caused to deposit in the vicinity of the electron emission portion by conducting energization activation processing. (The similar energization activation processing as described using FIG. 24D may be conducted.)

Figure 28F:
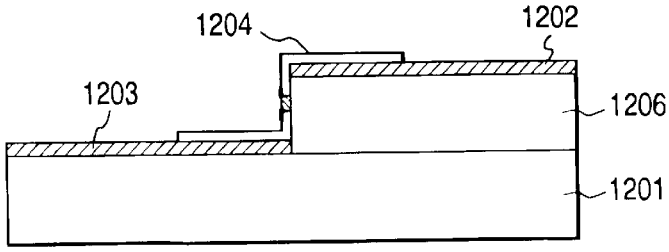

The vertical surface conduction electron emission device shown in FIG. 28F was thus produced.

[Properties of Surface Conduction Electron Emission Devices Used in Image Producer]

The construction of the planar and vertical surface conduction electron emission devices and the production method thereof have been described, and now the properties of the devices used in an image display will be described.

Figure 29:
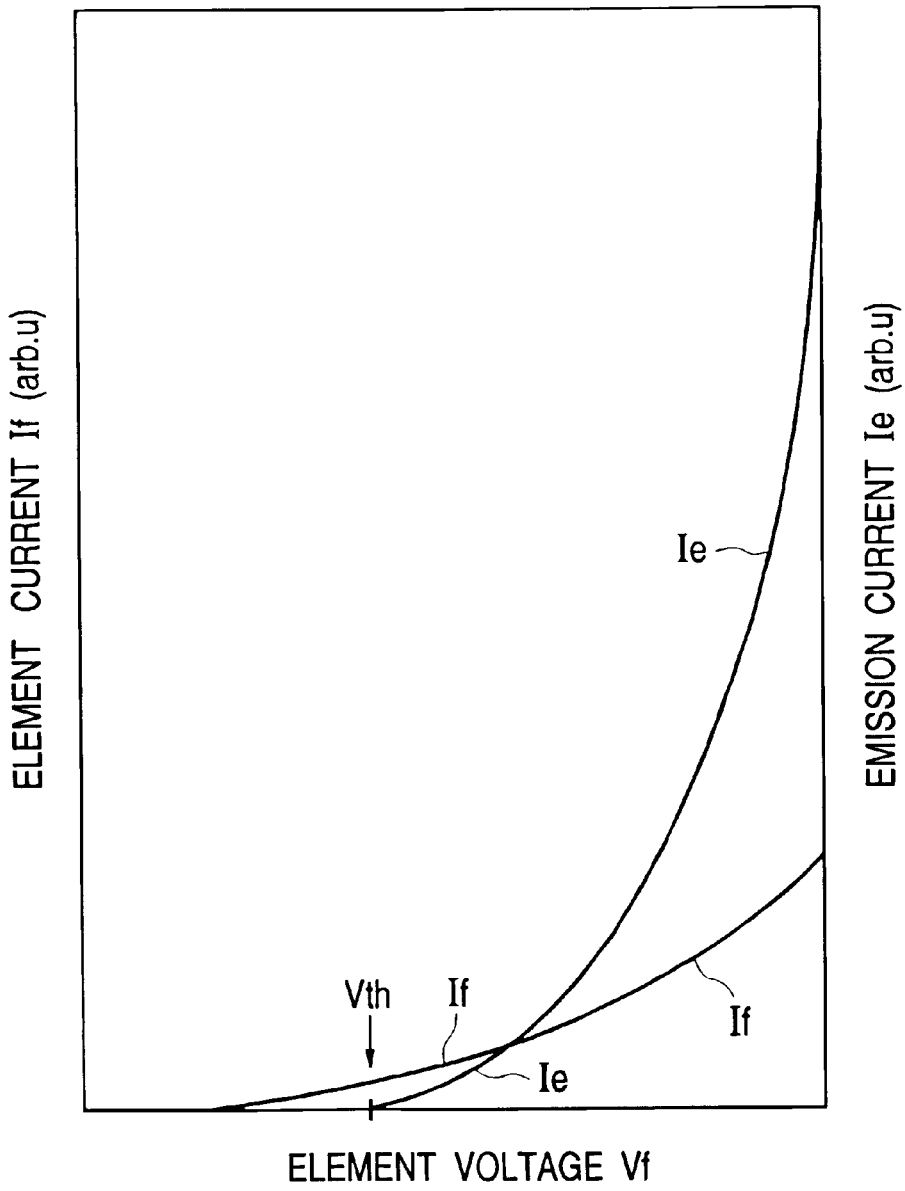
FIG. 29 is a graph showing the typical property of the surface conduction electron emission device used in one embodiment of the present invention.

Referring to the drawings, FIG. 29 shows typical examples of (Emission Current Ie) to (Device Voltage Vf) and (Device Current If) to (Device Voltage Vf) properties. The emission current Ie is significantly small as compared with the device current If, therefore, it is very difficult to illustrate them with the identical scale, in addition, the above properties change with changes in design parameter, such as size of device, shape of the same and so on. Thus, the two properties are illustrated in their respective desired units.

The devices used in an image display have three properties described below, related to emission current Ie.

First, the emission current Ie rapidly increases when the voltage equal to or higher than the voltage of a certain value (referred to as "threshold voltage Vth") is applied to the devices, while it is hardly detected when the voltage lower than the threshold voltage Vth is applied.

That is, the devices are non-linear devices having a definite threshold Vth with respect to the emission current Ie.

Second, the emission current Ie varies depending on the voltage Vf applied to the devices, therefore, the magnitude of the emission current Ie can be controlled by the voltage Vf.

Third, the current Ie emitted from the devices quickly responds to the voltage Vf applied thereto, therefore, the amount of charge of the electrons emitted from the devices can be controlled by the duration time of applying the voltage Vf.

The surface conduction electron emission devices were suitably applied to an image display due to the above properties. For example, in the image display in which multiple devices are provided corresponding to the picture devices of its display screen, display is made possible by scanning the display screen in turn while taking advantage of the first property. That is, the voltage equal to or higher than the threshold voltage Vth is applied to the devices under drive according to the desired luminance, while the voltage lower than the threshold voltage Vth is applied to the devices in the non-selective state. Display is made possible by scanning the display screen in turn while switching the devices to be driven in turn.

Further, the luminance of the display screen can be controlled while taking advantage of the second or the third property, which makes possible a gradation display.

[Structure of Multiple Electron Beam Source With Multiple Devices Arranged in a Simple Matrix]

Now, the structure of a multiple electron beam source will be described in which the above surface conduction electron emission devices are wired in a simple matrix.

Referring to the drawings, FIG. 20 is a plan view of the multiple electron beam used in the display panel of FIG. 17 described above. On the substrate 1011, arranged are the same surface conduction electron emission devices 1012 as shown in FIGS. 19A and 19B, which are wired in a simple matrix with row wiring electrodes 1003 and column wiring electrodes 1004. On each portion where a row wiring electrode 1003 and a column wiring electrode 1004 intersect, an insulating layer (not shown in the figure) is formed between the electrodes to keep them electrically insulating.

FIG. 21 is a sectional view of the multiple electron beam source of FIG. 20, taken along the line 21—21.

The multiple electron beam source having such a structure was produced by first forming the row wiring electrodes 1013, the column wiring electrodes 1014, the insulating layers between the electrodes (not shown in the figure), the device electrodes of the surface conduction electron emission devices 1012 and the conductive thin film on the substrate, then conducting energization forming processing and energization activation processing while feeding power to each device via the row wiring electrodes 1013 and the column wiring electrodes 1014.

[Construction of Driving Circuit (and Driving Method Thereof)]

Figure 30:
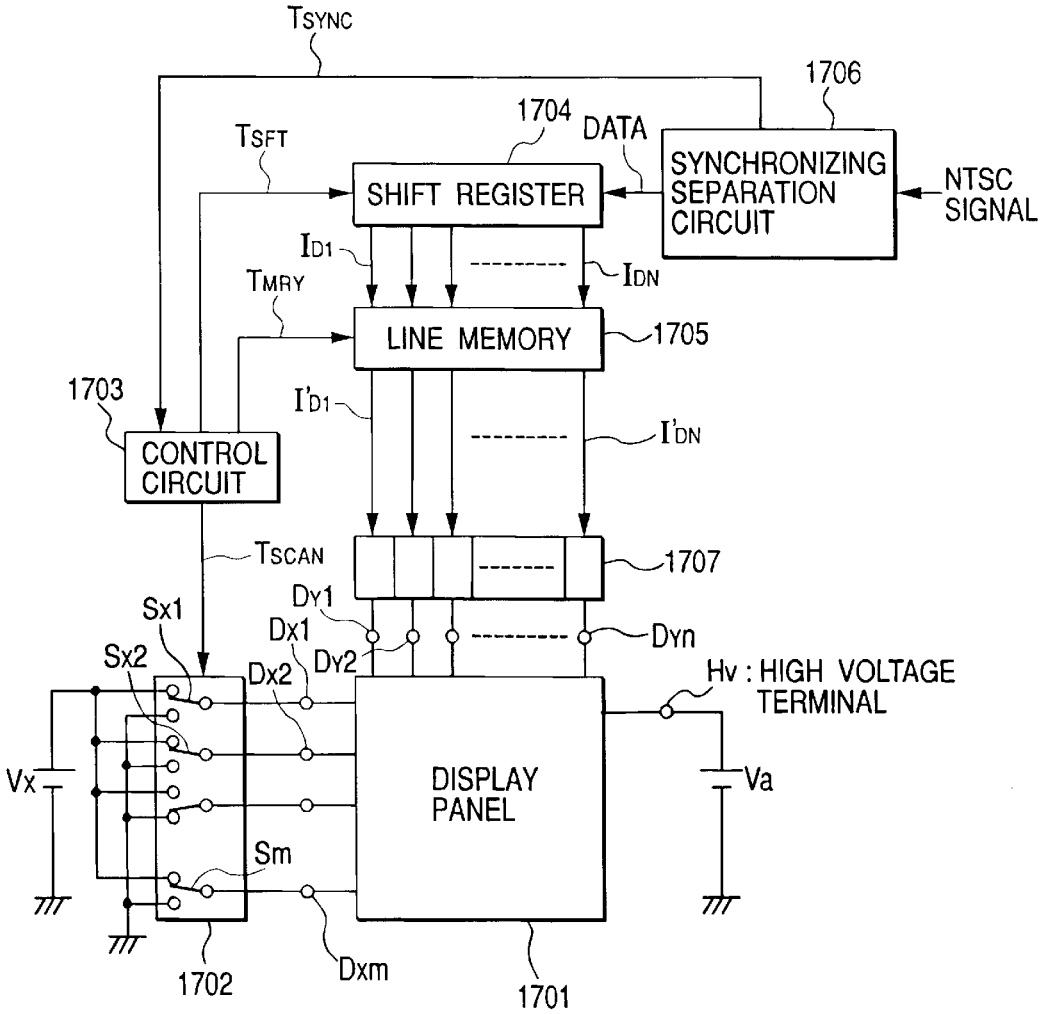
FIG. 30 is a block diagram schematically showing a configuration of a driving circuit of an image display embodying the present invention.

Referring to drawings, FIG. 30 is a block diagram schematically showing a configuration of driving circuit for displaying a television screen based on the NTSC television signals. In the figure, a display panel designated by reference numeral 1701 corresponds to the display panel described above, and it is produced and operates in the same manner as described above. A scanning circuit designated by numeral 1702 scans scanning lines, and a control circuit 1703 generates signals and the like input into the scanning circuit 1702. A shift register 1704 shifts data of each line, and a line memory 1705 outputs the data for one line from the shift register 1704 to a modulation signal generator 1707. A synchronizing signal separating circuit 1706 separates the synchronizing signals from NTSC signals.

The functions of each part of the circuit shown in FIG. 30 will be described in detail below.

The display panel 1701 is connected with an external electric circuit via terminals Dx1 to Dxm, terminals Dy1 to Dyn and a high voltage terminal Hv. To the terminals Dx1 to Dxm, applied are scanning signals for driving the multiple electron beam source provided in the display panel 1701, that is, for driving the cold cathode devices wired in a matrix of m rows and n columns one by one (n devices). On the other hand, to the terminals Dy1 to Dyn, applied are modulation signals for controlling the output electron beam of each of n devices for one row selected by the above scanning signals. And to the high voltage, terminal Hv, a DC voltage of, for example, 5 [kV] is supplied from a DC voltage source Va. The above voltage means an accelerating voltage for providing a sufficient energy for the excitation of fluorescent substances to the electron beam output from the multiple electron beam source.

Then the scanning circuit 1702 will be described. The scanning circuit 1702 has m switching devices (in the figure, they are schematically shown by S1 to Sm) in it, and each of the switching devices selects either one of the output voltage of an DC voltage Vx and 0 [V] (GND level) and electrically connects with the terminals Dx1 to Dxm of the display panel 1701. Each switching device, S1 to Sm, operates according to the control signals Tscan output from the control circuit 1703, and actually it can be easily constructed by combining the switching devices like FET. The above DC voltage source Vx is set so that it will output a certain voltage to keep the driving voltage applied to the devices having been not scanned at a level equal to or lower than the electron emission threshold voltage Vth based on the properties of the electron emission devices illustrated in FIG. 29.

The control circuit 1703 has a function of coordinating the operations of each part so that an appropriate display will be made based on the image signals input from the outside. It generates control signals Tscan, Tsft and Tmry toward each part based on the synchronizing signals Tsync sent from a synchronizing signal separation circuit 1706 described below. The synchronizing signal separation circuit 1706 is a circuit for separating a synchronizing signal component and a luminance signal component from a NTSC television signal input from the outside. Although the synchronizing signal separated by a synchronizing signal separation circuit 1706 consists of a vertical synchronizing signal and a horizontal synchronizing signal, as is well known, it is shown as a Tsync signal in the figure for convenience. On the other hand, the luminance signal component of an image separated from the above television signal is referred to as DATA signal for convenience, and the signal is input into a shift register 1704.

The shift register 1704 is a register for subjecting the above DATA signal input into serial on the basis of time series to serial/parallel conversion for each image line, and it operates based on the control signal Tsft sent from the control circuit 1703. In other words, the control signal Tsft can be a shift lock of the shift register 1704. The data for 1 line of image subjected to serial/parallel conversion (corresponds to the driving data of n electron emission devices) are output from the above shift register 1704 as n signals of Id1 to Idn.

A line memory 1705 is a memory for storing the data for 1 line of image for a required period time, and it stores properly the contents of Id1 to Idn in accordance with control signal Tmry sent from the control circuit 1703. The contents stored are output as I'd1 to I'dn and input into a modulation signal generator 1707.

The modulation signal generator 1707 is a signal source for driving and modulating each of the electron emission devices 1012 according to each of the image data I'd1 to I'dn, and its output signal is applied to the electron emission devices 1015 within the display panel 1701 through the terminals Dy1 to Dyn.

As described above using FIG. 29, the surface conduction electron emission devices in accordance with the present invention has basic properties described below for emission current Ie. That is, there exists a definite threshold voltage Vth in electron emission (in the case of the surface conduction electron emission device described in the embodiment below, Vth is 8 [V]), electrons are emitted only when applying a voltage equal to or higher than the threshold voltage Vth. And under the voltage higher than the threshold voltage Vth, emission current Ie changes with changes in voltage as shown in the graph of FIG. 29. This means that, in cases where a panel voltage is applied to the devices of the present invention, when applying a voltage lower than the threshold voltage Vth, electron emission does not occur, on the other hand, when applying a voltage higher than the threshold voltage Vth, electron beam is output from the surface conduction electron emission devices. Changing the peak value of the pulse Vm at that time makes possible controlling the intensity of the output electron beam. Further, changing the pulse width Pw makes possible controlling the total amount of charges of the output electron beam.

Thus, as a method of modulating electron emission devices according to input signals, a voltage modulation method, a pulse width modulation method and the like can be adopted. When executing the voltage modulation method, a circuit of a voltage modulation method in which a certain length of voltage pulse is generated and the peak value of the pulse is properly modulated in accordance with the data input can be used as a modulation signal generator 1707. When executing the pulse width modulation method, a circuit of a pulse width modulation type in which a certain peak value of voltage pulse is generated and the pulse width of the voltage is properly modulated in accordance with the data input can be used as a modulation signal generator 1707.

For the shift register 1704 and the line memory 1705, either a digital signal type or an analog signal type can be adopted. That is, it does not matter which type should be adopted as long as the serial/parallel conversion of an image signal and storing are conducted at a prescribed rate.

When using a digital signal type, though it is necessary that the output signal DATA from the synchronizing signal separation circuit 1706 is converted into digital signals, this can be done if only an A/D converter is provided at the output portion of the synchronizing signal separation circuit 1706. In connection with this, the circuit used for the modulation signal generator varies depending on whether the output signals of the maim memory 115 is digital or analog. Specifically, in case of the voltage modulation method using digital signals, for example, an D/A conversion circuit is used for the modulation signal generator 1707, and an amplification circuit or the like is added if necessary.

In case of the pulse width modulation method, a circuit combined with a counter for counting the number of waves output from a high-speed oscillator or an oscillator and a comparator for comparing the output values of the counter and the above memory is used for modulation signal generator 1707. If necessary, an amplifier can be added for amplifying the voltage of the signals subjected to a pulse width modulation and output from the comparator to the driving voltage of the electron emission devices.

In case of the voltage modulation method using analog signals, for example, an amplification circuit using an operational amplifier is adopted for the modulation signal generator 1707, and a shift-level circuit or the like may be added if necessary. In case of the pulse width modulation method, a voltage controlling type oscillation circuit (VCO) can be adopted. If necessary, an amplifier can be added for amplifying the voltage to the driving voltage of the electron emission devices.

In a image display to which the present invention having such a construction is applicable, electrons are emitted by applying a voltage to each of the electron emission devices via terminals, Dx1 to Dxm and Dy1 to Dyn, outside the container. The electron beam is accelerated as a result of applying a high voltage to the metal back 1019 or the transparent electrode (not shown in the figures) via the high voltage terminal Hv. The accelerated electrons collide with the fluorescent film 1018, which causes light emission and consequently produces an image.

[Electron Beam Source Having a Ladder-shaped Arrangement]

Now an electron source substrate having a ladder-shaped arrangement and an image display using the same will be described with reference to FIGS. 31 and 32.

Figure 31:
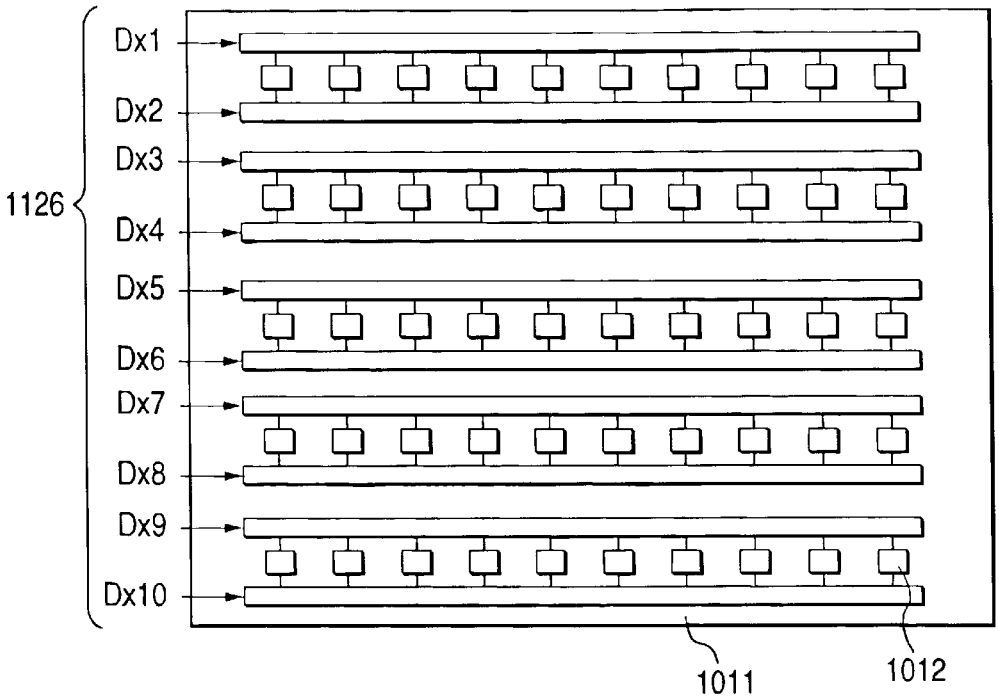
FIG. 31 is a schematic plan view showing a ladder arrangement electron source of one form of the present invention.
Figure 33:
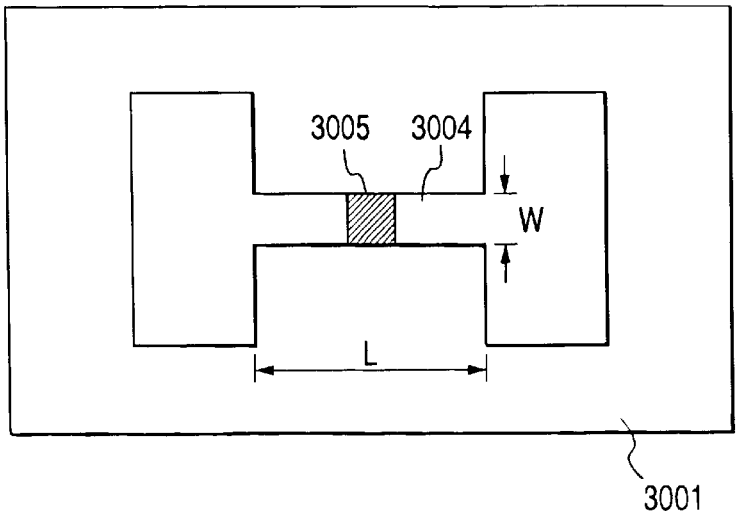
FIG. 33 is a schematic diagram of one example of the conventional surface conduction electron emission device.

Referring to FIG. 31, reference numeral 1011 designates an electron source substrate, numeral 1012 electron emission devices, and Dx1 to Dx10 of numeral 1126 common wiring connecting with the above electron emission devices. Multiple electron emission devices 1012 are arranged in parallel with a row in the direction of X on the substrate 1011. (this is referred to as device row). An electron source substrate having a ladder-shaped arrangement is produce by arranging multiple device rows on the substrate. Each of the device rows can be driven independently by properly applying a driving voltage between the common wiring of each device row. Specifically, a voltage higher than the threshold voltage Vth is applied to the device rows from which electron beam is to be emitted, and a voltage lower than the threshold voltage Vth is applied to the device rows from which no electron beam is to be emitted. The common wiring, for example, Dx2 and Dx3 of Dx2 to Dx9 may be the same wiring.

Figure 32:
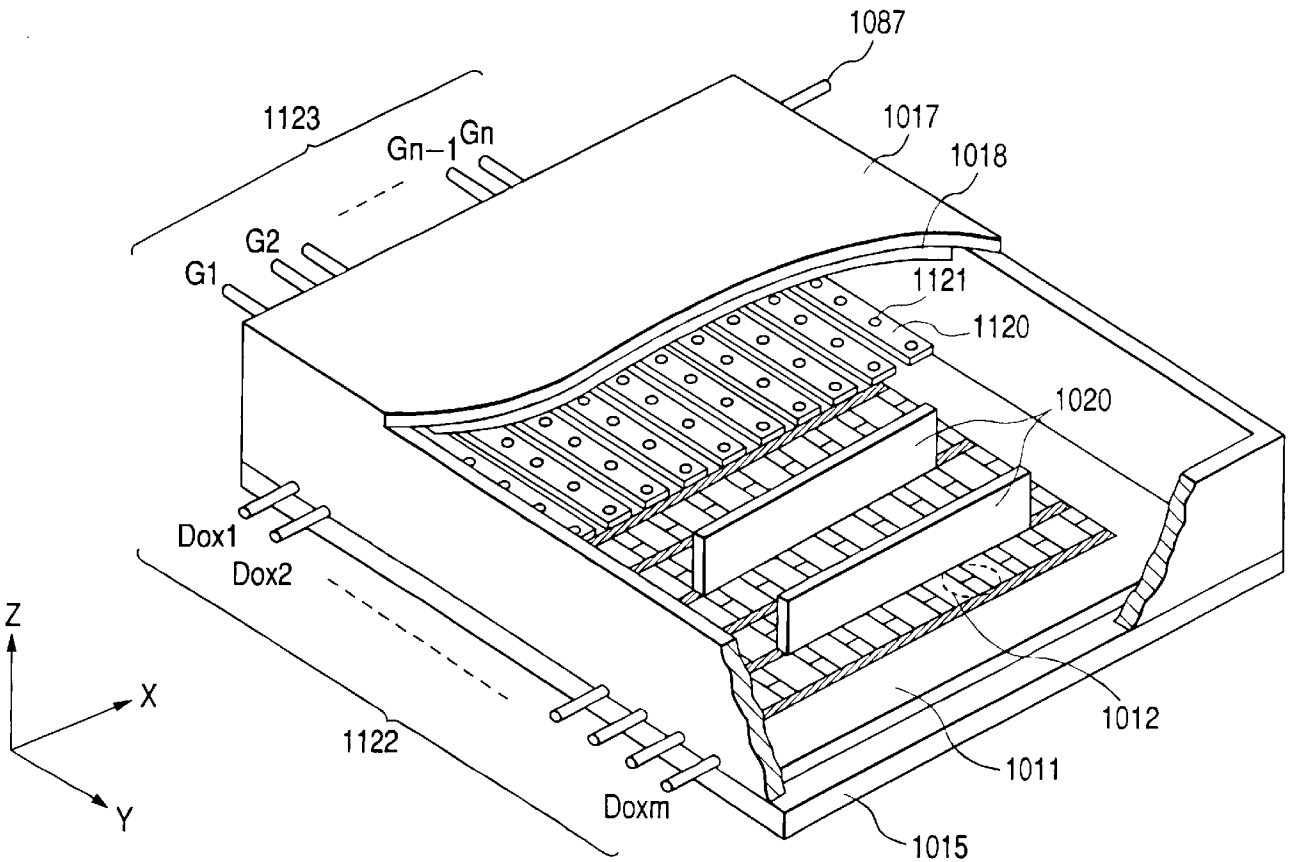
FIG. 32 is a perspective view of a planar image display containing a ladder arrangement electron source of one form of the present invention.
Figure 34:
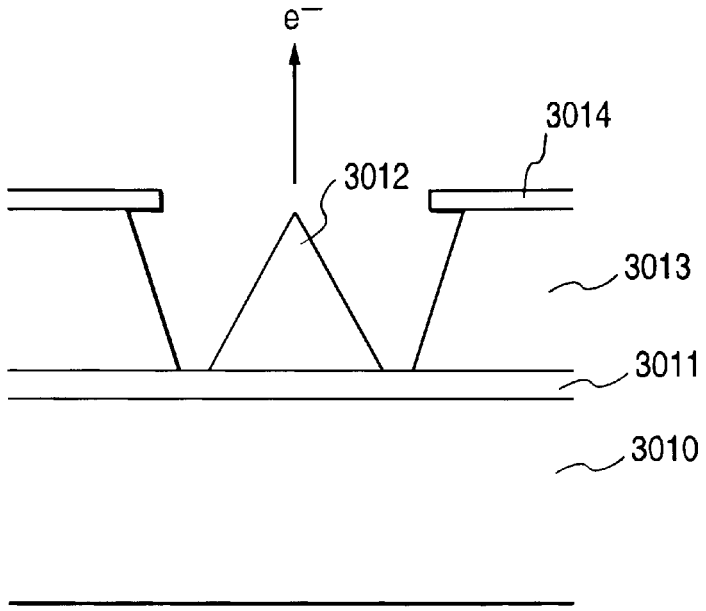
FIG. 34 is a schematic diagram of one example of the conventional FE type device.
Figure 35:
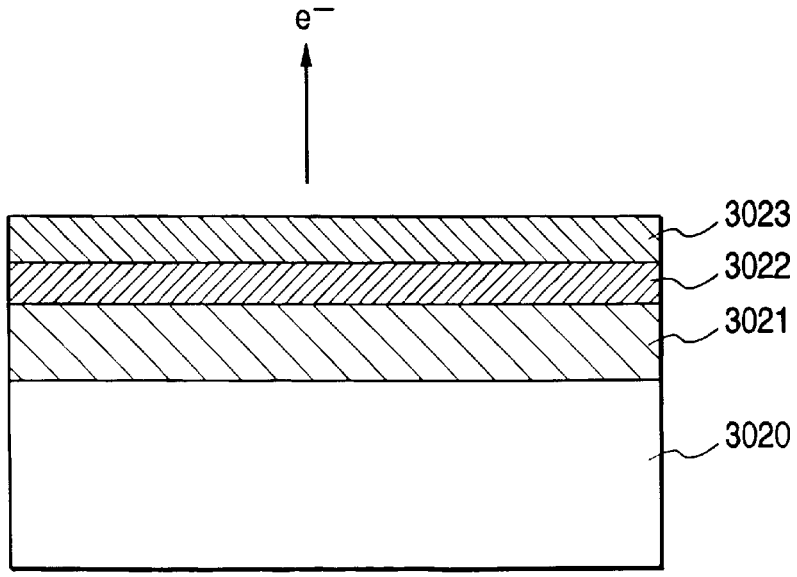
FIG. 35 is a schematic diagram of one example of the conventional MIM type device.
Figure 36:
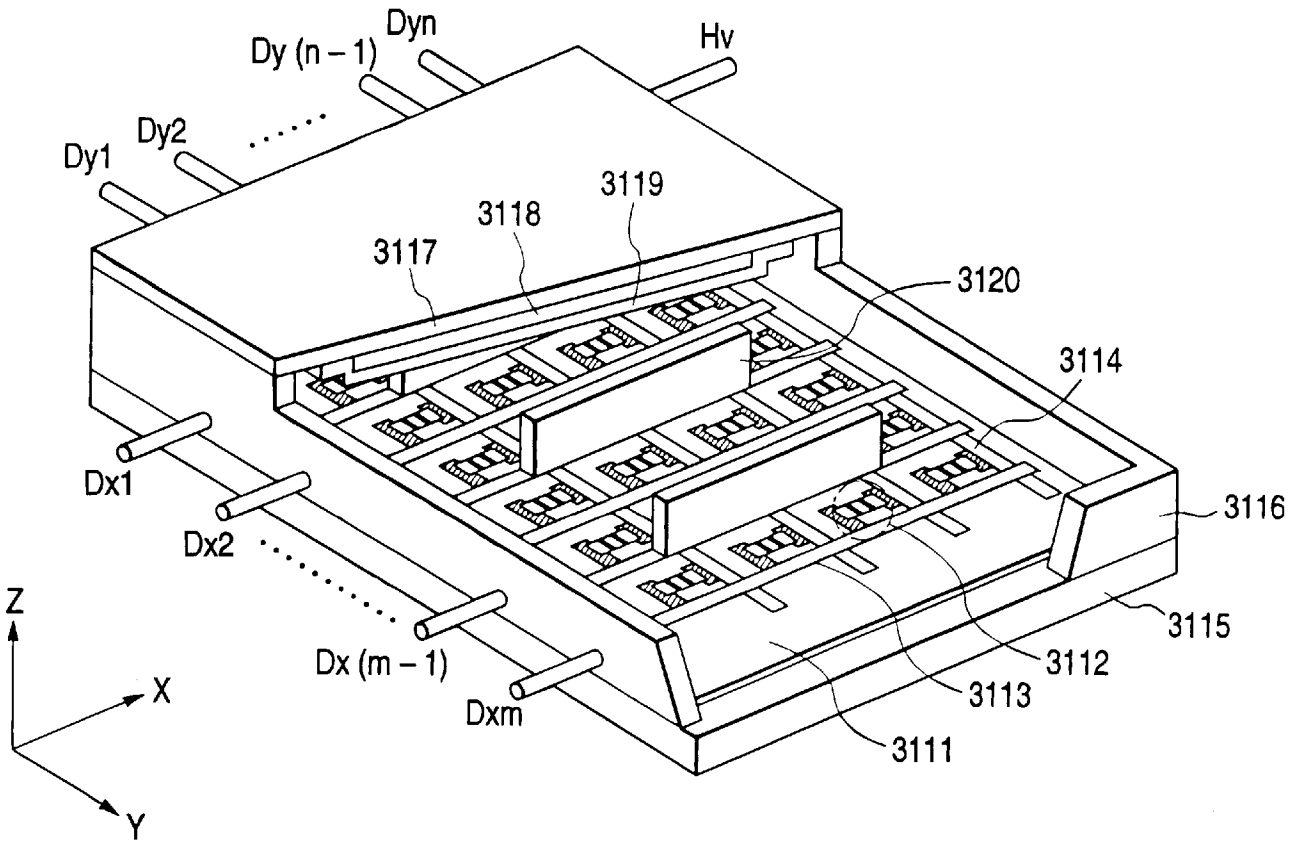
FIG. 36 is a perspective view of a display panel, partially broken away, of the conventional planar image display.

FIG. 32 shows a structure of an image display provided with an electron source having a ladder-shaped arrangement. Reference numeral 1120 designates grid electrodes, 1121 pores for allowing electrons to pass through, 1122 terminals outside of the container consisting of Dox1, Dox2, . . . Dox, 1123 terminals outside of the container consisting of G1, G2, . . . Gn connecting with the grid electrodes 1120, 1011 an electron source substrate in which each common wiring between the device rows is the same. The same reference numerals in FIG. 31 and FIG. 32 designate the same member. The difference between this type image producer and the image producer in a simple matrix arrangement (FIG. 17) is that this type image producer has grid electrodes 1120 provided between the electron source substrate 1011 and the face plate 1017.

In the panel structure described above, spacers 120 can be provided between the face plate 1017 and the rear plate 1015, if necessary in terms of its atmospheric-pressure structure, in both cases where the devices are arranged in a simple matrix and in a ladder-shaped form.

In the middle position between the substrate 1011 and the face plate 1017, provided are grid electrodes 1120. The grid electrodes 1120 can modulate the electron beam emitted from the surface conduction electron emission devices 1012, and each grid electrode is provided with circular openings 1121 corresponding to each device to allow electron beam to pass through the electrodes provided in stripes perpendicular to the device rows in a ladder-shaped arrangement. The shape of the grids and the installation position thereof are not limited to those of FIG. 32. Multiple through-holes, as an opening, can be provided in a mesh form, and they can be provided around or in the vicinity of the surface conduction electron emission devices.

The terminals 1122 outside the container and the grid terminals 1123 outside the container are electrically connected with the driving circuit shown in FIG. 30.

In the present image display, the exposure of the fluorescent substances to each electron beam can be controlled by applying modulation signals for 1 line of image to the grid electrodes and driving (scanning) the device rows line by line synchronously. Thus the image can be displayed line by line.

The construction of the above two image displays is an example of the image producers to which the present invention is applicable, and various changes and modifications can be made in it based on the concept of the present invention. Input signals have been described in terms of NTSC, they are, however, not limited to this, PAL method, SECAM, and TV signals (for example, high definition television) consisting of a larger number of scanning lines as compared with the former can also be adopted.

In accordance with the present invention, image producers for television broadcasting as well as image producers suitable for the image displays of video conference system, computers and the like can be provided. In addition, image producers as an optical printer comprising of a photographic drum can be provided.

EXAMPLES

The present invention will be explained more detail with reference to the concrete examples.

In the respective examples described below, used was the multiple electron beam source of a type in which N×M (N−3072, M=1024) surface conduction electron emission devices having an electron emission portion on the conductive fine-particle film between electrodes are wired in a matrix with M direction rows of wiring and N direction columns of wiring (refer to FIGS. 17 and 20).

Example 1

Glass Substrate/Aluminum Sputtering Film/Anodic Oxidation Micro-hole

The spacer 1024 used in this example was produced as described below.

As a master, a soda-lime glass substrate which was the same material as the rear plate was used. The master was subjected to shape processing by injection molding and mirror finish polishing so that its outside dimensions of the thickness, height and length would be 0.2 mm, 3 mm and 40 mm, respectively. The average roughness of the substrate surface thus formed was 100 Å. Hereinafter, the substrate will be referred to as g0.

Prior to deposition process, the above spacer substrate g0 was subjected to first ultrasonic cleaning in deionized water, isopropyl alcohol (IPA) and acetone for 3 minutes, then drying at 80° C. for 30 minutes, and followed by UV ozone cleaning so as to remove organic residues on the surface of the substrate.

Then titanium and aluminium were deposited on each side of the substrate by sputtering so as to form films 0.5 μm and 0.1 μm, respectively. After that, the substrate was subjected to anodic oxidation treatment in 0.3 N oxalic acid aqueous solution. The electrolytic conditions in that case were such that the voltage applied to anode was 40 V and energization time was 30 minutes in a potensional mode. By this electrolytic treatment, micro-holes of average diameter 1000 Å and the maximum depth 5000 ↑ were formed with the adjacent holes spaced at average intervals of 2000 Å.

In order to provide unevenness on the top surface portion, the surface of the substrate was subjected to processing with #4000 sandpaper and made rough. The average roughness of the non-opening portion was 100 Å then. Hereinafter the substrate thus obtained is referred to as substrate g1. The appearance of the surface of the substrate g1 is roughly as follows: the surface aluminium layer was turned into an insulating alumina layer in a highly oxidized state, there existed micro-holes which were almost uniformly spaced as a whole and reached the titanium layer at the bottom, and infinitesimal unevenness was formed in every pore.

Then a Cr—Al alloy nitride film of 200 nm, as an antistatic film, was formed on the surface of the substrate by subjecting Cr and Al targets to sputtering with a high-frequency power source. The sputtering gas used was a mixed gas with Ar-to-$N_2$ ratio of 1:2 and its total pressure was 1 mTorr (0.13 Pa). For the film co-deposited under the above conditions, the sheet resistivity was $R/\square=2\times10^9\ \Omega/\square$, and the first and the second cross point energies of secondary electron emission coefficient were 30 eV and 5 keV, respectively.

The antistatic film applicable to the present invention is not limited to this, various types antistatic film are applicable.

Further a low resistive film was formed in the region to become an upper-lower electrodes junction portion by the method described below. The above region was subjected to vapor phase deposition to form a titanium film of 10 nm thickness and a Pt film of 200 nm thickness in a 200 μm sheet form parallel to the above junction portion by sputtering. The Ti film was needed as a foundation layer for reinforcing the film, adhesion of the Pt film. The spacer 1020 with a low resistive film was thus obtained. Hereinafter thus obtained spacer is referred to as spacer A. The film thickness of the low resistive film was 210 nm, and the sheet resistivity was 10 Ω/□.

FIG. 3 shows the surface geometry of the highly resistive film of spacer A thus obtained.

In the above uneven portion, the coating performance of the film was satisfactory over the boundary regions between the depressed portion and the elevated portion, and the opening regions of the substrate were not filled up by the formation of the highly resistive film. Further, in the non-opening regions, the continuity of the film was satisfactory.

The incident angle dependency coefficient of secondary electron emission coefficient $m_0$ of spacer A was 2 for the incident electron energy of 1 keV.

In the present example, a display panel was produced in which the spacers 1020 shown in FIG. 17 were arranged. The details will be described with reference to FIGS. 17 and 18. First, the substrate 1011 with row wiring electrodes 1013, column wiring electrodes 1014, insulating layers between electrodes (not shown in the figures) and the device electrode and conductive thin film of the surface conduction electron emission devices 1012 formed on it was fixed on the rear plate 1015. Then the above spacers A, as a spacer 1020, were fixed on the row wiring electrodes 1013 of the substrate 1011 at regular intervals and parallel thereto. After that, a face plate 1017 with a fluorescent film 1018 and a metal back 1019 provided on its internal surface was arranged 5 mm above the substrate 1011 via side walls 1016, and the rear plate 1015, the face plate 1017, the side walls 1016 and the spacers 1020 were fixed at each junction portion. Frit glass (not shown in the figures) was applied to the substrate 1011—rear plate 1015 junction, the rear plate 1015—side wall 1016 junction and the face plate 1017—side wall 1016 junction, and each of the junction portions was sealed by firing at 400° C. to 500° C. in the atmosphere for 10 minutes or longer. The spacers 1020 were arranged with their one side facing the substrate 1011 being on the row wiring 1013 (of 300 μm width) and the other side facing the face plate 1017 being on the metal back 1019 via a conductive filler or a conductive frit glass (not shown in the figures) mixed with a conductive material such as metals (not shown in the figures). And their adhesion and electrical connection were achieved by firing them at 400° C. to 500° C. in the atmosphere for 10 minutes or longer at the same time that the above hermetic container was sealed.

Figure 23:
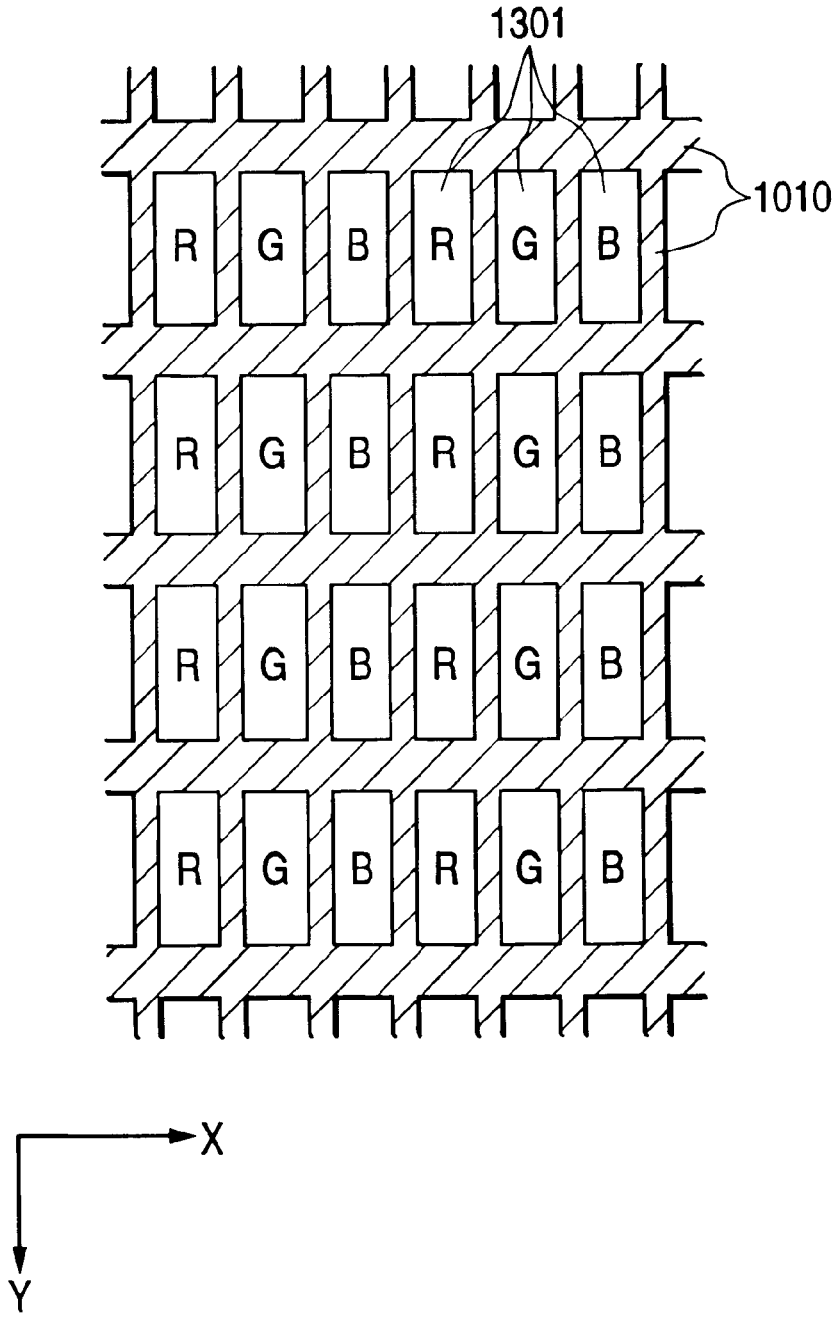
FIG. 23 is a plan view illustrating the arrangement of fluorescent substances on a face plate of a display panel.

In the present example, adopted was the fluorescent film 1018 which was formed, as shown in FIG. 23, in such a manner that fluorescent substances 1301 of the same color were placed in a column (in the direction of Y), multiple columnar lines of different colors form stripes, and black conductors 1010 are arranged between the two differently colored fluorescent substances (R, G, B) 1301 as well as between the two consecutive picture devices of the same color placed in the direction of Y. And the spacers 1020 were arranged within the region (of 300 μm width) parallel to each row of the black conductors 1010 (in the direction of X) via the metal back 1019. When conducting the sealing described above, the rear plate 1015, the face plate 1017 and the spacer 1020 were carefully positioned so that the each differently colored fluorescent substance 1301 will correspond to each device 1013 arranged on the substrate 1011.

After the hermetic container thus completed was evacuated with a vacuum pump through an exhaust tube (not shown in the figures) till it had a sufficient vacuum degree, the aforementioned energization forming processing and energization activation processing were conducted by feeding power to each device 1013 via the row wiring electrodes 1013 and the column wiring electrodes 1014 through the terminals Dx1 to Dxm and Dy1 to Dyn outside the hermetic container. A multiple electron beam source was thus produced. Then the outer enclosure (hermetic container) was sealed by heating the exhaust tube not shown in the figures with a gas burner to be deposited with vacuum degree of $10^{-6}$ [Torr]($1.3\times10^{-4}$ Pa).

Finally, a getter processing was conducted to maintain the vacuum degree in the hermetic container after sealing.

In an image display using the display panel shown in FIGS. 17 and 18 thus completed, an image is displayed in such a manner that electrons are emitted by applying scanning signals and modulation signals to each cold cathode device (surface conduction electron emission device) from a signal generator shown in the FIG. 30 through the terminals Dx1 to Dxm and Dy1 to Dyn outside the hermetic container, the emitted electron beams are accelerated by applying a high voltage to the metal back 1019 through a high voltage terminal Hv and caused to collide with the fluorescent film 1018, and the differently colored fluorescent substances 1301 (R,G,B in FIG. 23) are excited and caused to emit light. The voltage Va applied to the high voltage terminal Hv was increased slowly within the range from 3 [kV] to 12 [kV] to a threshold voltage at which electric discharge occurred. The voltage Vf applied between the wiring electrodes 1013 and 1014 was 14 [V]. The withstand voltage was judged to be satisfactory as long as a continuous driving is possible for 1 hours or longer when applying a voltage of 8 kV or higher to the high voltage terminal Hv.

Under such conditions, withstand voltage was satisfactory in the vicinity of spacer A. And lines of emission spots, including the spots formed by the electrons emitted from the cold cathode devices 1012 in the vicinity of spacer A, were made in such a manner that they were spaced at regular intervals in a two-dimensional form. And a color image display excellent in visibility and color reproducibility was obtained. This suggests that the installation of spacer A did not generate the disorder of the electric field which would affect the electron orbits.

In the panel adopting the spacers on which a 200 nm thick film of each of GeN, WGeN, $SiO_2$, CN, and carbon was deposited by sputtering, instead of CrAlN highly resistive film on spacer A, the same effects were obtained.

Example 2

Substrate Material

The metal layer of the substrate surface was subjected to anodic oxidation treatment and sandpaper processing in the same manner as used for the spacer production in example 1 so that the substrate surface would have micro-holes and become rough, except that the master substrate subjected to shape processing was an alumina substrate. In this case, the average diameter and the depth of the opening portions were 100 nm and 500 nm, respectively, and the average roughness of the non-opening portions was 100 nm. Then a highly resistive film and a low resistive layer were formed by sputtering in the same manner as in example 1. Hereinafter the spacer thus obtained is referred to as spacer B.

In the above uneven portion, the coating performance of the film was satisfactory over the boundary regions between the depressed portion and the elevated portion, and the opening regions of the substrate were not filled up by the formation of the highly resistive film. Further, in the non-opening regions, the continuity of the film was satisfactory.

The incident angle dependency coefficient of secondary electron emission coefficient $m_0$ of the spacer B was 2 for the incident electron energy of 1 keV.

An electron beam emission apparatus together with a rear plate which incorporated electron beam emission devices in it were produced in the same manner as in example 1, and high voltage application and device driving were performed under the same conditions as in example 1.

Under such conditions, withstand voltage was satisfactory in the vicinity of the spacer B. And lines of emission spots, including the spots formed by the electrons emitted from the cold cathode devices 1012 in the vicinity of the spacer B, were made in such a manner that they were spaced at regular intervals in a two-dimensional form. And a color image display excellent in visibility and color reproducibility was obtained. This suggests that the installation of the spacer B did not generate the disorder of the electric field which would affect the electron orbits.

Example 3

Photolithograph, Wall Structure

A spacer C with a highly resistive film was produced in the same manner as in example 1, except that a selective perforating processing by the photolithographic method was used as a means for roughing the substrate surface.

Figure 10:
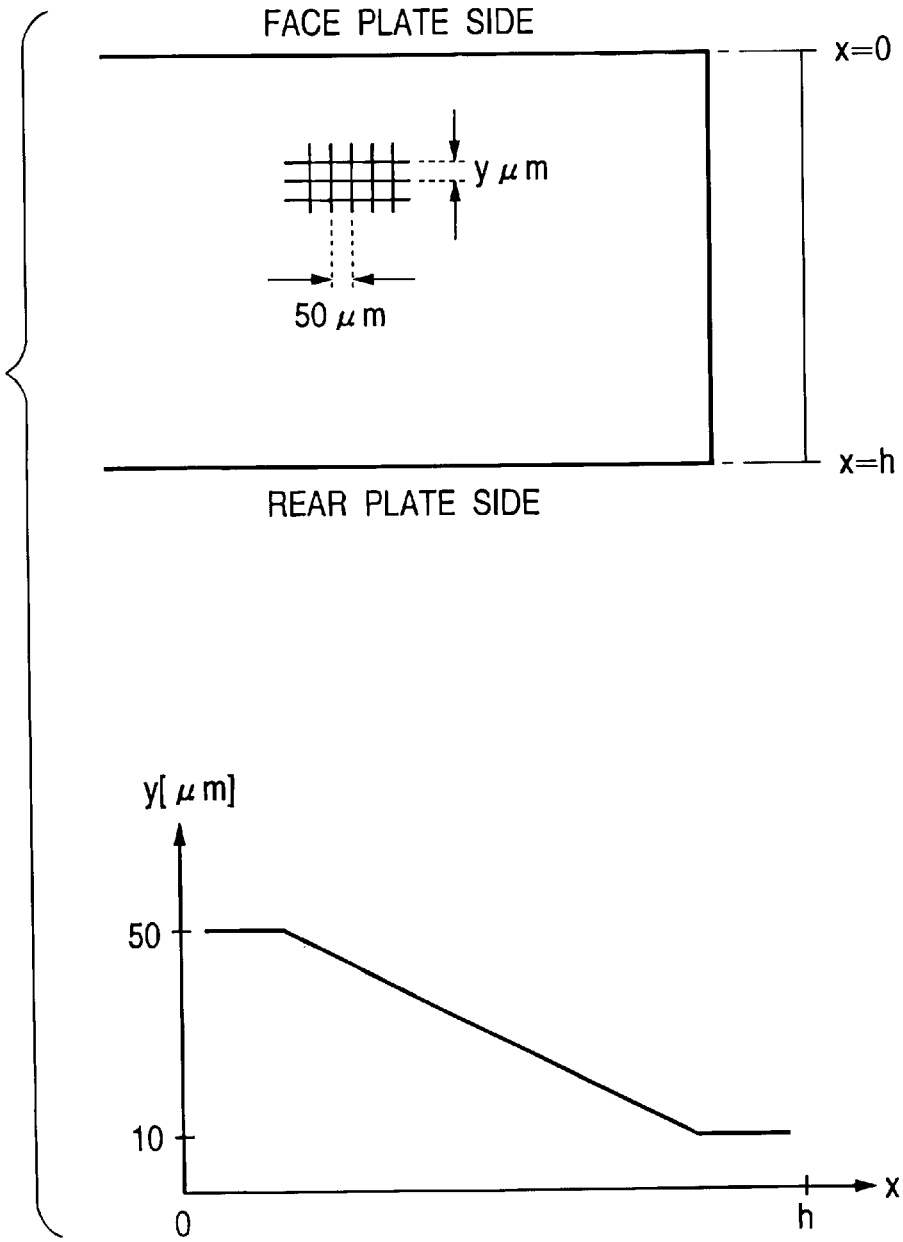
FIG. 10 are illustrations of an unevenness formation pattern of spacers Embodiments 3 and 4 embodying the present invention.

The method of roughing the substrate surface of the spacer C will be shown below. First, the above spacer substrate g0 was subjected to deposition of OFPR-800 by dipping treatment, as a resist material, made by Tokyo Ohka Kogyo Co., Ltd. and to pre-baking on a hot plate at 90° C. for 2 minutes. Then the substrate with resist was exposed to ultraviolet light of 405 nm from the face plate edge side to the highly resistive film portion of the rear plate side using a lattice mask pattern in which the repeating cycle y changes from 50 $\mu$m to 10 $\mu$m linearly, as shown in FIG. 10. In this case, the sideways repeating cycle was 50 $\mu$m and the exposure time was 4 seconds. After the exposure, the substrate surface was developed with MF CD-2 made by Shipley Far East, rinsed with deionized water and dried. Then it was subjected to post-baking on a hot plate at 140° C. for 5 minutes. Then the glass surface was etched using hydrofluoric acid as an corrosive in such a manner that the etching depth became 5 $\mu$m, and followed by rinsing with deionized water and drying. Finally, the resist was removed using Resist Strip N321, as a remover, made by Nagase & Co., Ltd., and the substrate was rinsed with deionized water to be dried. A highly resistive film and a low resistive layer were formed on the substrate surface by sputtering in the same manner as in example 1.

Figure 4:
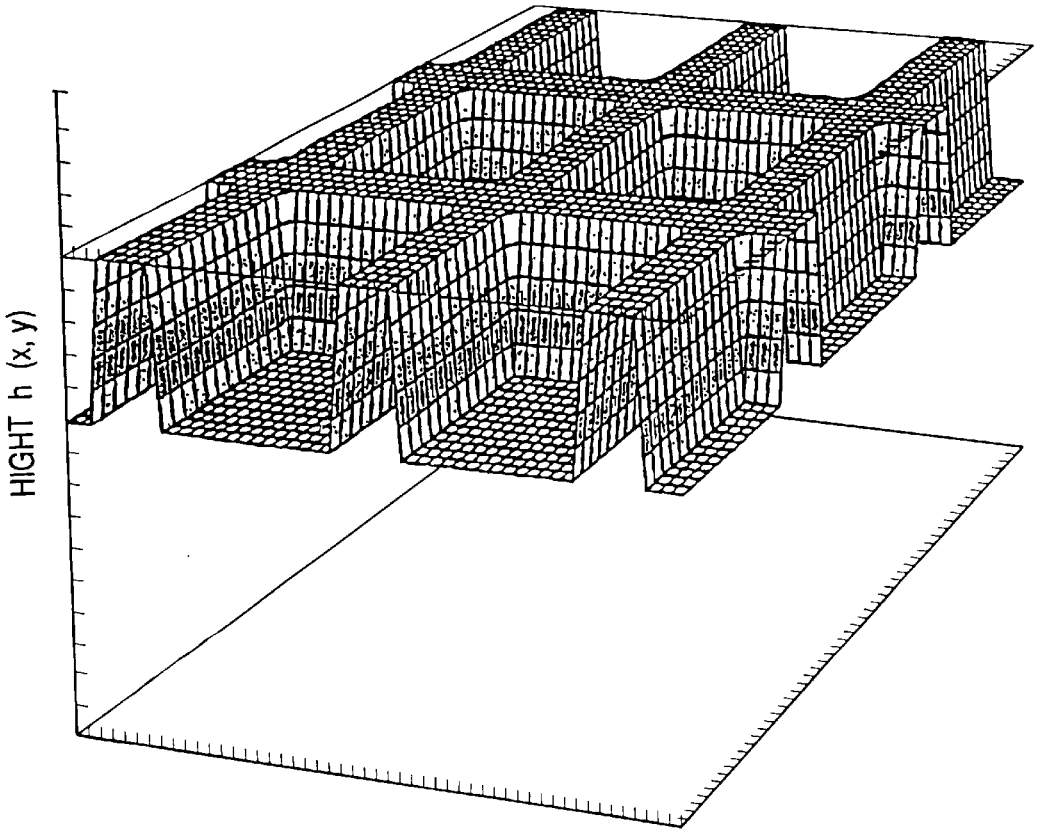
FIG 4 is a view illustrating a surface geometry of still another form of a spacer embodying the present invention.

FIG. 4 shows the surface geometry of the highly resistive film portion of the spacer C thus obtained.

In the above uneven portion, the coating performance of the film was satisfactory over the boundary regions between the depressed portion and the elevated portion, and the opening regions of the substrate were not filled up by the formation of the highly resistive film. Further, in the non-opening regions, the continuity of the film was satisfactory.

The incident angle dependency coefficient of secondary electron emission coefficient $m_0$ of the spacer C was 2 for the incident electron energy of 1 keV.

An electron beam emission apparatus together with a rear plate which incorporated electron beam emission devices in it were produced in the same manner as in example 1, and high voltage application and device driving were performed under the same conditions as in example 1.

Under such conditions, withstand voltage was satisfactory in the vicinity of the spacer C. And lines of emission spots, including the spots formed by the electrons emitted from the cold cathode devices 1012 in the vicinity of the spacer C, were made in such a manner that they were spaced at regular intervals in a two-dimensional form. And a color image display excellent in visibility and color reproducibility was obtained. This suggests that the installation of the spacer C did not generate the disorder of the electric field which would affect the electron orbits.

Example 4

Sandblasting, Wall Structure

A spacer D with a highly resistive film was produced in the same manner as in example 3, except that a selective perforating processing by the sandblasting was used as a means for roughing the substrate surface.

The method of roughing the substrate surface of the spacer D will be shown below. First, the above spacer substrate go was subjected to sandblasting from the face plate edge side to the highly resistive film portion of the rear plate side using a lattice mask pattern in which the repeating cycle y changes from 50 μm to 10 μm linearly, as shown in FIG. 10. In this case, the sideways repeating cycle was 50 μm. The sandblasting was performed in such a manner that the depths of the opening became 3 μm laterally and 4 μm longitudinally. A highly resistive film and a low resistive layer were formed on the substrate surface by sputtering in the same manner as in example 1.

Figure 5:
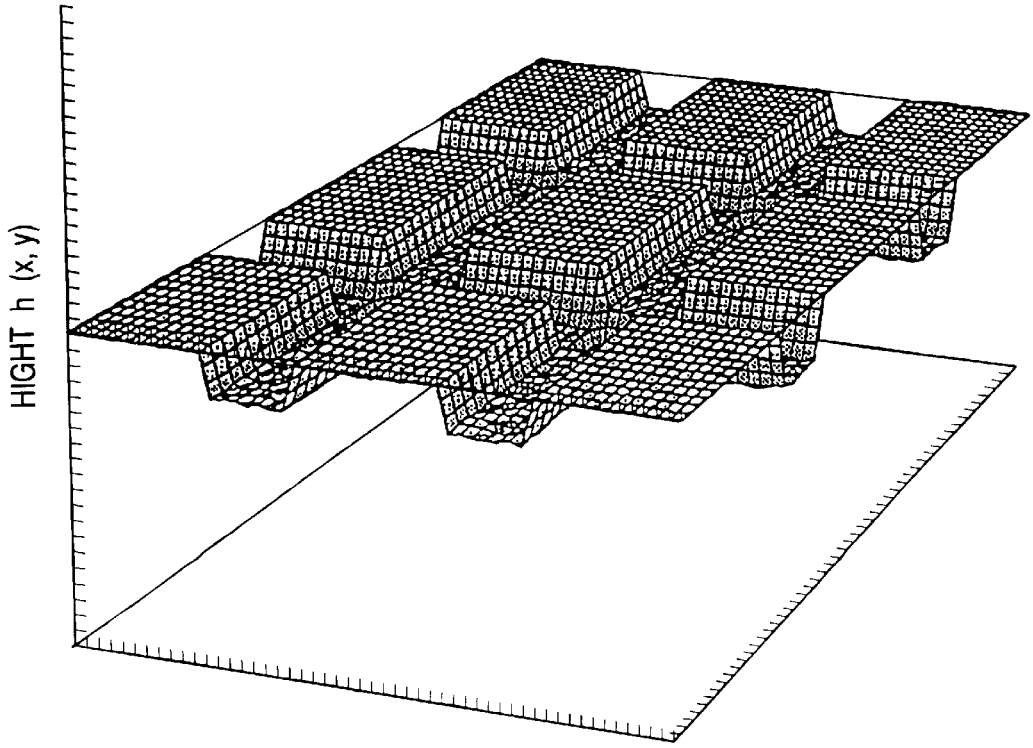
FIG. 5 is a view illustrating a surface geometry of still another form of a spacer embodying the present invention.
Figure 6:
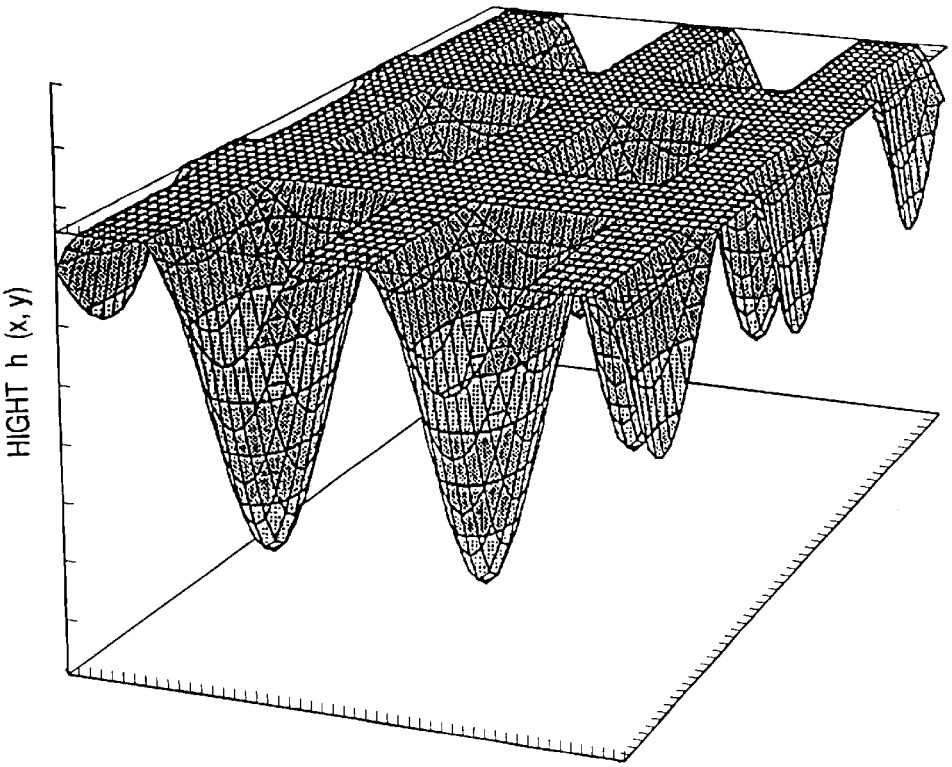
FIG. 6 is a view illustrating a surface geometry of still another form of a spacer embodying the present invention.

FIG. 5 shows the surface geometry of the highly resistive film portion of the spacer D thus obtained.

In the above uneven portion, the coating performance of the film was satisfactory over the boundary regions between the depressed portion and the elevated portion, and the opening regions of the substrate were not filled up by the formation of the highly resistive film. Further, in the non-opening regions, the continuity of the film was satisfactory.

The incident angle dependency coefficient of secondary electron emission coefficient $m_0$ of the spacer D was 3 for the incident electron energy of 1 keV.

An electron beam emission apparatus together with a rear plate which incorporated electron beam emission devices in it were produced in the same manner as in example 1, and high voltage application and device driving were performed under the same conditions as in example 1.

Under such conditions, withstand voltage was satisfactory in the vicinity of the spacer D. And lines of emission spots, including the spots formed by the electrons emitted from the cold cathode devices 1012 in the vicinity of the spacer D, were made in such a manner that they were spaced at regular intervals in a two-dimensional form. And a color image display excellent in visibility and color reproducibility was obtained. This suggests that the installation of the spacer D did not generate the disorder of the electric field which would affect the electron orbits.

Example 5

Roughed Foundation Layer, Unevenness

A spacer E with a highly resistive film was produced in the the same manner as in example 1, except that a fine particle dispersion type film, as a second film, was used between the highly resistive antistatic film and the smooth substrate as a means for roughing the substrate surface.

The method of roughing the substrate surface of the spacer E will be shown below. Prior to deposition process, the above spacer substrate go was subjected to first ultrasonic cleaning in deionized water, isopropyl alcohol (IPA) and acetone for 3 minutes, then drying at 80° C. for 30 minutes, and followed by UV ozone cleaning so as to remove organic residues on the surface of the substrate. Then, the substrate surface was subjected to dipping treatment in PAM606EP solution, which is a fine-particle dispersion type highly resistive film made by Catalysts & Chemicals Ind. Co., Ltd., and to heating and firing in an oven at 270° C. This roughing was performed in such a manner that the average particle diameter became 450 Å and the film thickness became 200 Å at the base portion of the binder.

A highly resistive film and a low resistive layer were formed on the substrate surface by sputtering in the same manner as in example 1.

Figure 9:
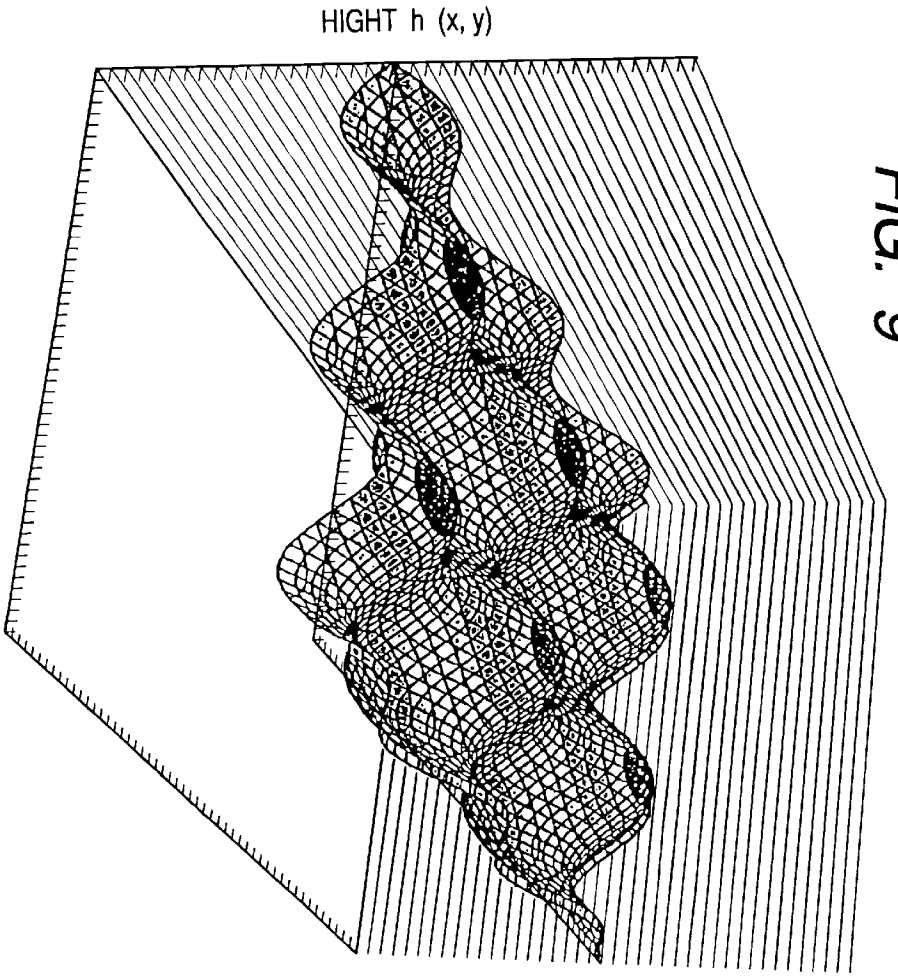
FIG. 9 is a view illustrating a surface geometry of still another form of a spacer embodying the present invention.

FIG. 9 shows the surface geometry of the highly resistive film portion of the spacer E thus obtained.

The thickness of the highly resistive film was large for the unevenness of the substrate thus obtained, the highly resistive film, however, had unevenness of about 300 Å on its surface following the unevenness of the underlying layer. In the above uneven portion, the coating performance of the film was satisfactory over the boundary regions between the depressed portion and the elevated portion.

The incident angle dependency coefficient of secondary electron emission coefficient $m_0$ of the spacer E was 4 for the incident electron energy of 1 keV.

An electron beam emission apparatus together with a rear plate which incorporated electron beam emission devices in it were produced in the same manner as in example 1, and high voltage application and device driving were performed under the same conditions as in example 1.

Under such conditions, withstand voltage was satisfactory in the vicinity of the spacer E. And lines of emission spots, including the spots formed by the electrons emitted from the cold cathode devices 1012 in the vicinity of the spacer E, were made in such a manner that they were spaced at regular intervals in a two-dimensional form. And a color image display excellent in visibility and color reproducibility was obtained. This suggests that the installation of the spacer E did not generate the disorder of the electric field which would affect the electron orbits.

The prevent invention can be applied to not only a board-like member but also a member with various shapes such as a cylindrical or angular shape or the like.

Comparative Example

Planar Spacer

Figure 11:
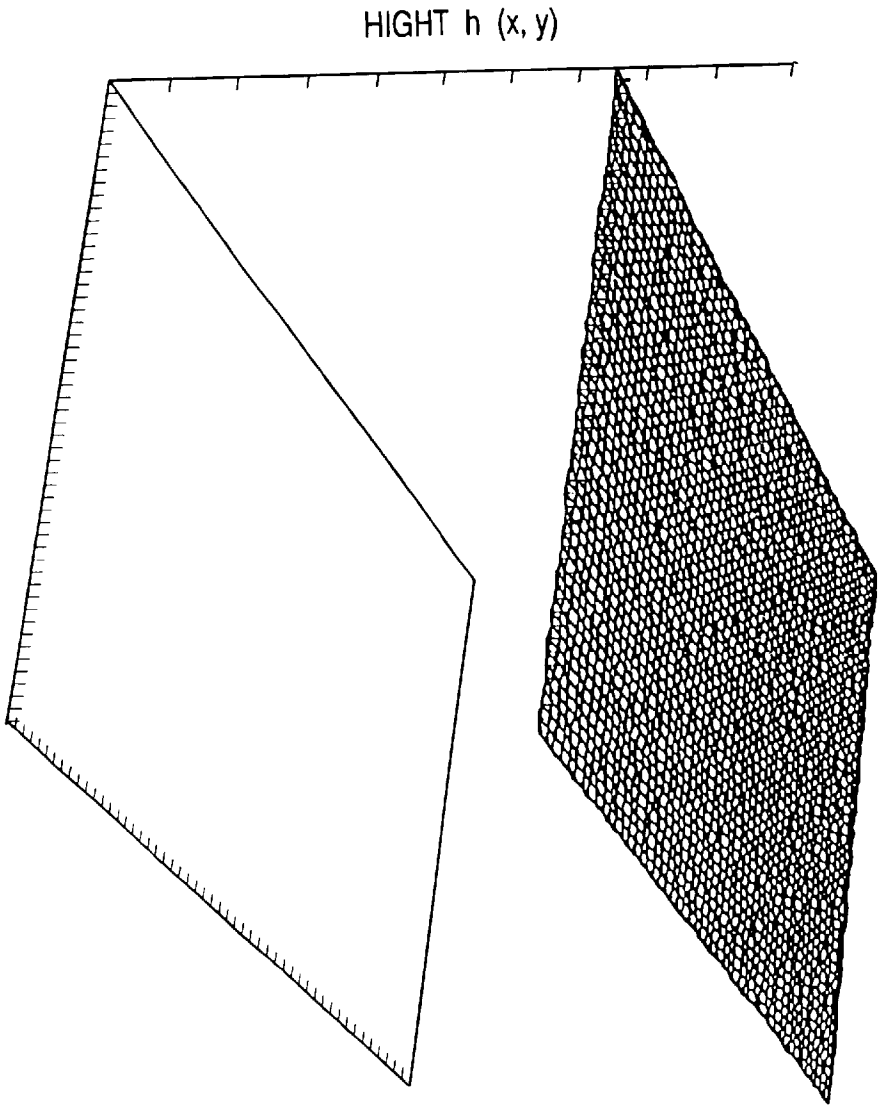
FIG. 11 is a view illustrating a surface geometry of a spacer of comparative Example.
Figure 12:
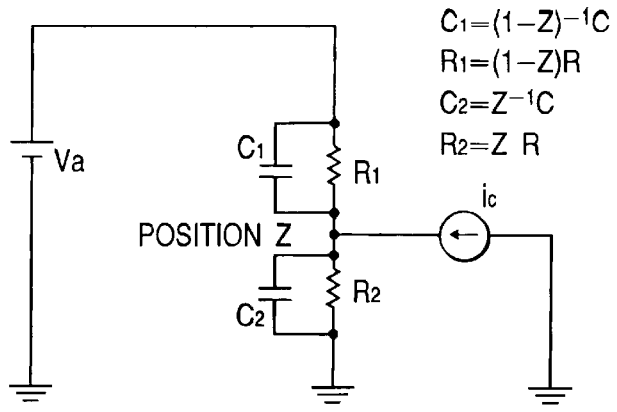
FIG. 12 is a schematic diagram showing a basic model for the calculation of charged electric potential considering the effects of secondary electron emission.
Figure 13:
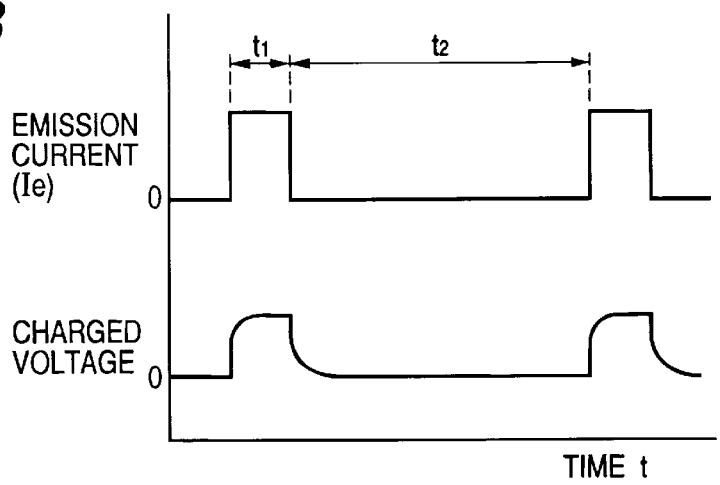
FIG. 13 is a schematic presentation of one example of the relationship between charged voltage and driving time illustrating the accumulation effects of electrification.
Figure 14:
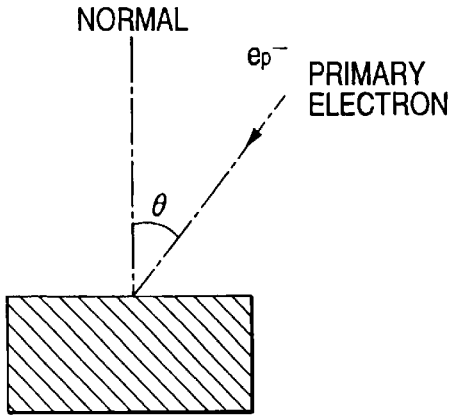
FIG. 14 is an illustration of an incident angle of primary electrons and a distribution of secondary electron emission.

A highly resistive film and a low resistive layer were formed on a substrate surface by sputtering in the same manner as in example 1, except that the smooth substrate g0 was used as it was as a substrate for a spacer without applying the surface roughing processing. Hereinafter the spacer thus obtained is referred to as spacer F. FIG. 11 shows the surface geometry of the highly resistive film portion of the spacer F.

The continuity of the film was satisfactory on the highly resistive film portion, unevenness was, however, not formed on that portion.

The incident angle dependency coefficient of secondary electron emission coefficient $m_0$ of the spacer F was 11 for the incident electron energy of 1 keV.

An electron beam emission apparatus together with a rears plate which incorporated electron beam emission devices in it were produced in the same manner as in example 1, and high voltage application and device driving were performed under the same conditions as in example 1.

Under such conditions, withstand voltage was satisfactory in the vicinity of the spacer F. And an infinitesimal electric discharge was observed, it did not cause the devices to fracture though. In addition, the commission spots caused by the electrons emitted from the cold cathode devices 1012 in the vicinity of spacer F were drawn up to the spacer by a distance of 0.2 times as long as the pitch of a picture device. This suggests that the spacer was electrically charged, and the installation of spacer F generated the disorder of the electric field which would affect the electron orbits.

Figure 7:
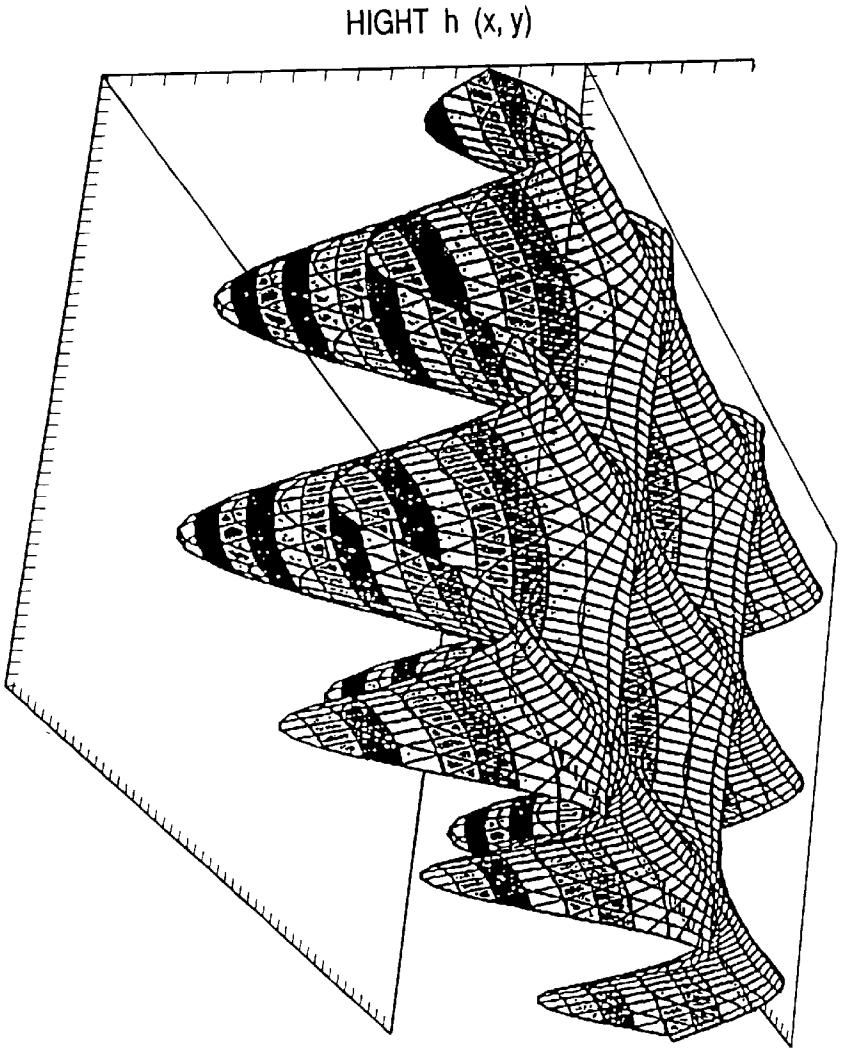
FIG. 7 is a view illustrating a surface geometry of still another form of a spacer embodying the present invention.
Figure 8:
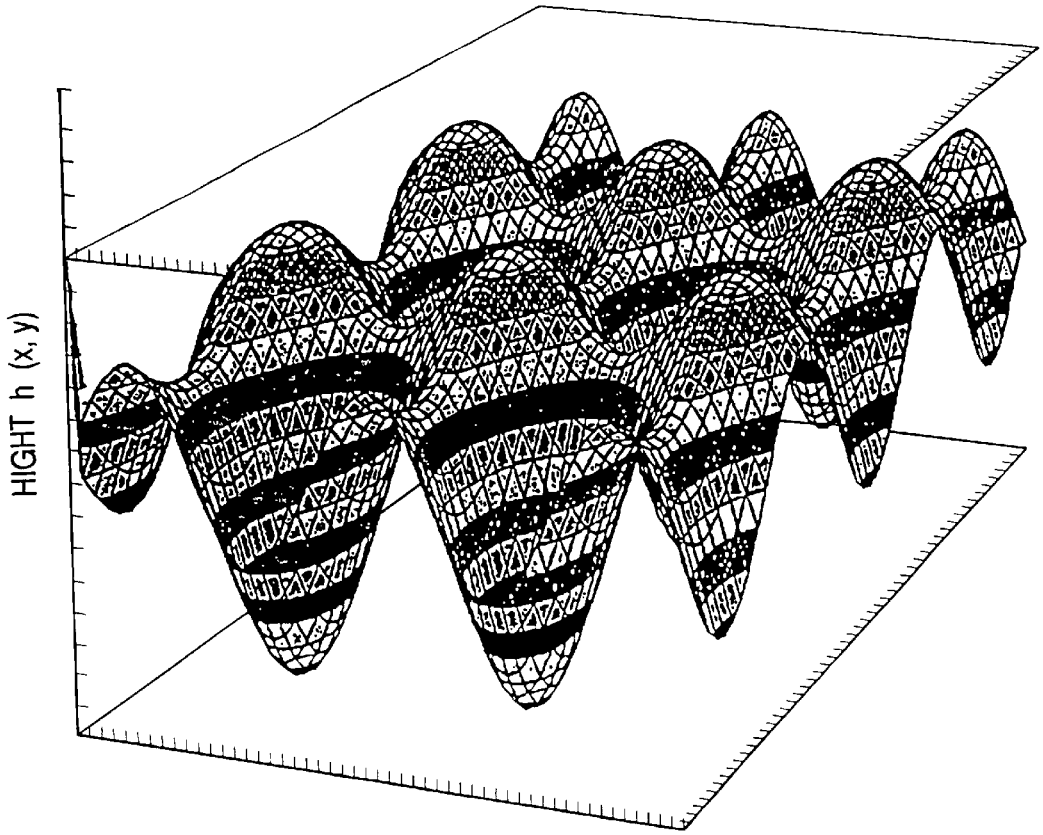
FIG. 8 is a view illustrating a surface geometry of still another form of a spacer embodying the present invention.

Comparing the surface geometry, incident angle dependency of secondary electron emission coefficient, displacement of emission point and anode withstand voltage of the samples A to E where a lower resistive film of the present invention described above was formed and the sample F of the comparative example, the electric contact, displacement of emission point and withstand voltage, all of which are panel characteristics, were all satisfactory. Thus spacers with antistatic and highly resistive film suitable for a vacuum-resistant spacer of the electron beam apparatus could be formed. The electric contact used herein means contact of the highly resistive film with the substrate wiring and the face plate wiring via a low resistive film. However, as compared with the comparative example F, the incident angle dependency coefficient of secondary electron emission coefficient of the examples A to E decreased by one-half or more. Thus the effect of restricting the electric charge due to the electrons entering the spacer at an angle was obtained in the examples A to F. In addition multiple emission phenomenon of secondary electrons was also restricted, thus a spacer having a good beam-stability and high discharge restriction ability was obtained. The treatment for making the surface porous by anodic oxidation, which was used in the example 1, is advantageous in that it makes possible the control of the diameter and the depth of the openings if only the time for the electrolytic treatment is controlled. For example, spending more time in the electrolytic treatment than the example 1 is advantageous in that it changes the shape of the projection portions as shown in FIGS. 7 and 8.

In accordance with the embodiments described above, spacers can be provided in which not only the static charge caused by the direct incident electrons from the closest electron source, but the static charge caused by the cumulative generation of electrons, reflected from the face plate and of electrons multiply emitted from the edge surface of the spacers due to the anode applied voltage are restricted by the effect of relaxing the incident angle and the effect of suppressing the cumulative incidence and discharge of the secondary electrons.

The above spacers make it possible to produce electron beam type image displays with high definition and long-term reliability in which displacement of omission points and creeping discharge both involved with static electricity are restricted.

In addition, the spacer described above makes easier the process for materializing the final uneven geometry. And it makes higher the degree of freedom in designing the geometry; for example, the design is possible in which unevenness has distribution in a film surface. These are because the spacer makes possible the restriction of static electrification described above if only the surface geometry of its substrate is controlled. Further, it does not require big changes in the existing film formation process. Still further it makes higher the degree of freedom in stoichiometrically designing the film materials, because it does not restrict the film materials used very much. Thus the spacer described above is advantageous from the viewpoint of its production.

According to the invention of the present application, in an electron beam apparatus, the effects of static charge on the members within a hermetic container can be relaxed. Thus, an image display with high definition and long-term reliability can be realized.

What is claimed is:

1. An electron beam apparatus comprising a hermetic container which includes an electron source having electron emission devices and targets exposed to the electrons emitted from said electron source and further comprising a first member within said hermetic container, wherein the value of the incident angle multiplication coefficient of secondary electron emission coefficient $m_0$, which is a parameter of the following formula:

$$\frac{\delta_\theta}{\delta_0} = \frac{\exp(-m_0\cos\theta)}{1-\left\{1-\dfrac{m_0}{1+(m_1)^{-1}\times m_0^{m_2}}\right\}\exp(-m_0)} \times \frac{1}{\cos\theta} \qquad \text{General Formula (1)}$$

$$1-\left\{1-\frac{m_0\cos\theta}{1+(m_1)^{-1}\times(m_0\cos\theta)^{m_2}}\right\}$$

is 10 or less, when obtaining it from the value of secondary electron emission coefficient measured under the conditions that incident energy is 1 keV and incident angle is 0 degree as well as the values measured under the conditions that incident energy is 1 keV and incident angles θ are 20, 40, 60 and 80 degrees by conducting a regression analysis by the least square method in said general formula (1), provided that the second electron emission coefficient of the surface of said first member has two incident energies which satisfy the second electron emission coefficient δ=1 under the vertical incident conditions, and that when the larger energy of the above two energies satisfying δ=1 is referred to as a second cross-point energy, the secondary electron emission coefficients for the primary electrons whose incident angles are θ and 0 degrees are represented by $\delta_\theta$, $\delta_0$, respectively, and $m_1$, $m_2$ have the values $m_1$=0.68273

$m_2$=0.86212, respectively, in the incident energy equal to or lower than the second cross-point energy.

2. The electron beam apparatus according to claim 1, wherein said first member comprises a substrate provided with an uneven geometry at least on a part of its surface and a film coating said uneven geometric portion, the thickness of said film being smaller than the height difference between the top and lowest portions of the uneven geometry of said substrate.

3. The electron beam apparatus according to claim 1, wherein said first member is provided with a film at least on a part of its surface, said film containing at least one kind of metal, carbon, silicon, or germanium and consisting of nitride, oxide or carbide.

4. An electron beam apparatus comprising a hermetic container which includes an electron source having electron emission devices and targets exposed to the electrons emitted from said electron source and further comprising a first member within said hermetic container, wherein said first member has a film on its surface, the foundation of said film having an uneven geometry, the thickness of said film being smaller than the height difference between the top and lowest portions of the uneven geometry of said foundation.

5. A spacer, wherein the value of the incident angle multiplication coefficient of secondary electron emission coefficient $m_0$, which is a parameter of the following formula:

$$\frac{\delta_\theta}{\delta_0} = \frac{\exp\left(-m_0\cos\theta\right)^{1-\left\{1-\frac{m_0\cos\theta}{1+(m_1)^{-1}\times(m_0\cos\theta)^{m_2}}\right\}}}{1-\left\{1-\frac{m_0}{1+(m_1)^{-1}\times m_0^{m_2}}\right\}\exp(-m_0)} \times \frac{1}{\cos\theta} \quad \text{General Formula (1)}$$

is 10 or less, when obtaining it from the value of secondary electron emission coefficient measured under the conditions that incident energy is 1 keV and incident angle is 0 degree as well as the values measured under the conditions that incident energy is 1 keV and incident angles θ are 20, 40, 60 and 80 degrees by conducting a regression analysis by the least square method in said general formula (1), provided that the second electron emission coefficient of its surface has two incident energies which satisfy the second electron emission coefficient δ−1 under the vertical incident conditions, and that when the larger energy of said two energies satisfying said condition δ=1 is referred to as a second cross-point energy, the secondary electron emission coefficients for the primary electrons whose incident angles are θ and 0 degrees are represented by $\delta_\theta$, $\delta_0$, respectively, and $m_1$, $m_2$ has the values $m_1$=0.68273

$m_2$=0.86212, respectively, in the incident energy equal to or lower than the second cross-point energy.

6. An electron beam apparatus comprising a hermetic container which includes an electron source having electron commission device and targets exposed to the electrons emitted from said electron source and further comprising a first member within said hermetic container, wherein the value of the incident angle multiplication coefficient $m_0$ of secondary electron emission coefficient, which is a parameter of the following formula:

$$\frac{\delta_\theta}{\delta_0} = \frac{\exp\left(-m_0\cos\theta\right)^{1-\left\{1-\frac{m_0\cos\theta}{1+(m_1)^{-1}\times(m_0\cos\theta)^{m_2}}\right\}}}{1-\left\{1-\frac{m_0}{1+(m_1)^{-1}\times m_0^{m_2}}\right\}\exp(-m_0)} \times \frac{1}{\cos\theta} \quad \text{General Formula (1)}$$

is 10 or less, when obtaining it from the value of secondary electron emission coefficient measured under the conditions that incident energy is 1 keV and incident angle is 0 degree as well as the values measured under the conditions that incident energy is 1 keV and incident angles θ are 20, 40, 60 and 80 degrees by conducting a regression analysis by the least square method in said general formula (1), provided that the second electron emission coefficient of the surface of said first member has two incident energies which satisfy the second electron emission coefficient δ=1 under the vertical incident conditions, and that when the larger energy of the above two energies satisfying δ=1 is referred to as a second cross-point energy, the secondary electron emission coefficients for the primary electrons whose incident angles are θ and 0 degrees are represented by $\delta_\theta$, $\delta_0$, respectively, and $m_1$, $m_2$ have the values $m_1$=0.68273

$n_2$=0.86212, respectively, in the incident energy equal to or lower than the second cross-point energy, wherein said first member is provided with an uneven geometry at least on a part of its surface, said uneven geometry being arranged at least in two directions on the surface.

7. An electron beam apparatus comprising a hermetic container which includes an electron source having electron emission devices and targets exposed to the electrons emitted from said electron source and further comprising a first member within said hermetic container, wherein the value of the incident angle multiplication coefficient $m_0$ of secondary electron emission coefficient, which is a parameter of the following formula:

$$\frac{\delta_\theta}{\delta_0} = \frac{\exp\left(-m_0\cos\theta\right)^{1-\left\{1-\frac{m_0\cos\theta}{1+(m_1)^{-1}\times(m_0\cos\theta)^{m_2}}\right\}}}{1-\left\{1-\frac{m_0}{1+(m_1)^{-1}\times m_0^{m_2}}\right\}\exp(-m_0)} \times \frac{1}{\cos\theta} \quad \text{General Formula (1)}$$

is 10 or less, when obtaining it from the value of secondary electron emission coefficient measured under the conditions that incident energy is 1 keV and incident angle is 0 degree as well as the values measured under the conditions that incident energy is 1 keV and incident angles θ are 20, 40, 60 and 80 degrees by conducting a regression analysis by the least square method in said general formula (1), provided that the second electron emission coefficient of the surface of said first member has two incident energies which satisfy the second electron emission coefficient δ=1 under the vertical incident conditions, and that when the larger energy of the above two energies satisfying δ=1 is referred to as a second cross-point energy, the secondary electron emission coefficients for the primary electrons whose incident angles are θ and 0 degrees are represented by $\delta_\theta$, $\delta_0$, respectively, and $m_1$, $m_2$, have the values $m_1$=0.68273

$m_2$=0.86212, respectively, in the incident energy equal to or lower than the second cross-point energy, wherein said first member is provided with an uneven geometry at least on a part of its surface, said uneven geometry constituting of the amplitudes of at least two kinds of unevenness.

8. An electron beam apparatus comprising a hermetic container which includes an electron source having electron emission devices and targets exposed to the electrons emitted from said electron source and further comprising a first member within said hermetic container, wherein the value of the incident angle multiplication coefficient $m_0$ of secondary electron emission coefficient, which is a parameter of the following formula:

$$\frac{\delta_\theta}{\delta_0} = \frac{\exp(-m_0\cos\theta)^{1-\left\{1-\frac{m_0\cos\theta}{1+(m_1)^{-1}\times(m_0\cos\theta)^{m_2}}\right\}}}{1-\left\{1-\frac{m_0}{1+(m_1)^{-1}\times m_0^{m_2}}\right\}\exp(-m_0)} \times \frac{1}{\cos\theta} \quad \text{General Formula (1)}$$

is 10 or less, when obtaining it from the value of secondary electron emission coefficient measured under the conditions that incident energy is 1 keV and incident angle is 0 degree as well as the values measured under the conditions that incident energy is 1 keV and incident angles θ are 20, 40, 60 and 80 degrees by conducting a regression analysis by the least square method in said general formula (1), provided that the second electron emission coefficient of the surface of said first member has two incident energies which satisfy the second electron emission coefficient δ=1 under the vertical incident conditions, and that when the larger energy of the above two energies satisfying δ=1 is referred to as a second cross-point energy, the secondary electron emission coefficients for the primary electrons whose incident angles are θ and 0 degrees are represented by $\delta_\theta$, $\delta_0$, respectively, and $m_1$, $m_2$ have the values $m_1$=0.68273

$m_2$=0.86212, respectively, in the incident energy equal to or lower than the second cross-point energy, wherein said first member is provided with an uneven geometry at least on a part of its surface, said uneven geometry constituting of the cycles periods of at least two kinds of unevenness.

9. A spacer, wherein the value of the incident angle multiplication coefficient $m_0$ of secondary electron emission coefficient, which is a parameter of the following formula:

$$\frac{\delta_\theta}{\delta_0} = \frac{\exp(-m_0\cos\theta)^{1-\left\{1-\frac{m_0\cos\theta}{1+(m_1)^{-1}\times(m_0\cos\theta)^{m_2}}\right\}}}{1-\left\{1-\frac{m_0}{1+(m_1)^{-1}\times m_0^{m_2}}\right\}\exp(-m_0)} \times \frac{1}{\cos\theta} \quad \text{General Formula (1)}$$

is 10 or less, when obtaining it from the value of secondary electron emission coefficient measured under the conditions that incident energy is 1 keV and incident angle is 0 degree as well as the values measured under the conditions that incident energy is 1 keV and incident angles θ are 20, 40, 60 and 80 degrees by conducting a regression analysis by the least square method in said general formula (1), provided that the second electron emission coefficient of its surface has two incident energies which satisfy the second electron emission coefficient δ=1 under the vertical incident conditions, and that when the larger energy of said two energies satisfying said condition δ=1 is referred to as a second cross-point energy, the secondary electron emission coefficients for the primary electrons whose incident angles are θ and 0 degrees are represented by $\delta_\theta$, $\delta_0$, respectively, and $m_1$, $m_2$ have the values $m_1$=0.68273

$m_2$=0.86212, respectively, in the incident energy equal to or lower than the second cross-point energy, wherein said spacer is provided with an uneven geometry at least on a part of its surface, said uneven geometry being arranged at least in two directions on the surface.

10. A spacer, wherein the value of the incident angle multiplication coefficient $m_0$ of secondary electron emission coefficient, which is a parameter of the following formula:

$$\frac{\delta_\theta}{\delta_0} = \frac{\exp(-m_0\cos\theta)^{1-\left\{1-\frac{m_0\cos\theta}{1+(m_1)^{-1}\times(m_0\cos\theta)^{m_2}}\right\}}}{1-\left\{1-\frac{m_0}{1+(m_1)^{-1}\times m_0^{m_2}}\right\}\exp(-m_0)} \times \frac{1}{\cos\theta} \quad \text{General Formula (1)}$$

is 10 or less, when obtaining it from the value of secondary electron emission coefficient measured under the conditions that incident energy is 1 keV and incident angle is 0 degree as well as the values measured under the conditions that incident energy is 1 keV and incident angles θ are 20, 40, 60 and 80 degrees by conducting a regression analysis by the least square method in said general formula (1), provided that the second electron emission coefficient of its surface has two incident energies which satisfy the second electron emission coefficient δ=1 under the vertical incident conditions, and that when the larger energy of said two energies satisfying said condition δ=1 is referred to as a second cross-point energy, the secondary electron emission coefficients for the primary electrons whose incident angles are θ and 0 degrees are represented by $\delta_\theta$, $\delta_0$, respectively, and $m_1$, $m_2$ have the values $m_1$=0.68273

$m_2$=0.86212, respectively, in the incident energy equal to or lower than the second cross-point energy, wherein said spacer is provided with an uneven geometry at least on a part of its surface, said uneven geometry constituting of the amplitudes of at least two kinds of unevenness.

11. A spacer, wherein the value of the incident angle multiplication coefficient $m_0$ of secondary electron emission coefficient, which is a parameter of the following formula:

$$\frac{\delta_\theta}{\delta_0} = \frac{\exp(-m_0\cos\theta)^{1-\left\{1-\frac{m_0\cos\theta}{1+(m_1)^{-1}\times(m_0\cos\theta)^{m_2}}\right\}}}{1-\left\{1-\frac{m_0}{1+(m_1)^{-1}\times m_0^{m_2}}\right\}\exp(-m_0)} \times \frac{1}{\cos\theta} \quad \text{General Formula (1)}$$

is 10 or less, when obtaining it from the value of secondary electron emission coefficient measured under the conditions that incident energy is 1 keV and incident angle is 0 degree as well as the values measured under the conditions that incident energy is 1 keV and incident angles θ are 20, 40, 60 and 80 degrees by conducting a regression analysis by the least square method in said general formula (1), provided that the second electron emission coefficient of its surface has two incident energies which satisfy the second electron emission coefficient $\delta=1$ under the vertical incident conditions, and that when the larger energy of said two energies satisfying said condition $\delta=1$ is referred to as a second cross point energy the secondary electron emission coefficients for the primary electrons whose incident angles are $\theta$ and 0 degrees are represented by $\delta_\theta$, $\delta_0$, respectively, and $m_1$, $m_2$ have the values $m_1=0.68273$ $m_2=0.86212$, respectively, in the incident energy equal to or lower than the second cross-point energy, wherein said spacer is provided with an uneven geometry at least on a part of its surface, said uneven geometry constituting of the cycles periods of at least two kinds of unevenness.

12. An electron beam apparatus comprising a hermetic container which includes an electron source having electron emission devices and targets exposed to the electrons emitted from said electron source and further comprising a first member within said hermetic container, wherein said first member is provided with an uneven geometry at least on a part of its surface, said uneven geometry being arranged at least in two directions on the surface, such that total secondary electron emissions generated by irradiating said uneven geometry of said first member with electrons emitted from plural directions is smaller than total secondary electron emissions generated in a case of irradiating a flat surface with electrons under same conditions.

13. An electron beam apparatus comprising a hermetic container which includes an electron source having electron emission devices and targets exposed to electrons emitted from said electron source and further comprising a first member within said hermetic container, wherein said first member is provided with an uneven geometry at least on a part of its surface, said uneven geometry constituting of the amplitudes of at least two kinds of unevenness, such that total secondary electron emissions generated by irradiating said uneven geometry of said first member with electrons emitted from plural directions is smaller than total secondary electron emissions generated in a case of irradiating a flat surface with electrons under same conditions.

14. An electron beam apparatus comprising a hermetic container which includes an electron source having electron emission devices and targets exposed to electrons emitted from said electron source and further comprising a first member within said hermetic container, wherein said first member is provided with an uneven geometry at least on a part of its surface, said uneven geometry constituting of the cycles periods of at least two kinds of unevenness, such that total secondary electron emissions generated by irradiating said uneven geometry of said first member with electrons emitted from plural directions is smaller than total secondary electron emissions generated in a case of irradiating a flat surface with electrons under same conditions.

15. A flat display apparatus, comprising:

first and second substrates supported in opposition to each other, wherein a spacer having a predetermined height exists between said first and second substrates, a periphery of opposing sections of said first and second substrates are hermetically sealed to form a hermetic flat space between said first and second substrates, and an electron-emitting section is disposed at a side of said first substrate; and a phosphor plane disposed at a side of said second substrate, wherein an electron derived from said electron-emitting section is accelerated and irradiates onto said phosphor plane to cause an excited light emission from said phosphor plane, thereby performing a desired light emission displaying, and a surface of said spacer includes a fine unevenness, and wherein a maximum height Rmax of the fine unevenness of the surface meets $0.05\ \mu m \leqq Rmax \leqq 100\ \mu m$.

16. An electron beam apparatus, comprising:

a hermetic container which includes an electron source having electron emission devices and targets exposed to electrons emitted from said electron source; and a first member within said hermetic container, wherein said first member is provided with an uneven geometry on at least a part of its surface, and said uneven geometry has multiple cycles, such that total secondary electron emissions generated by irradiating said uneven geometry of said first member with electrons emitted from plural directions is smaller than total secondary electron emissions generated in a case of irradiating a flat surface with electrons under same conditions.

17. An electron beam apparatus, comprising:

a hermetic container which includes an electron source having electron emission devices and targets exposed to electrons emitted from said electron source; and a first member within said hermetic container, wherein said first member is provided with a random uneven geometry on at least a part of its surface, said uneven geometry being arranged at least in two directions on the surface, such that total secondary electron emissions generated by irradiating said uneven geometry of said first member with electrons emitted from plural directions is smaller than total secondary electron emissions generated in a case of irradiating a flat surface with electrons under same conditions.

18. An electron beam apparatus comprising a hermetic container which includes an electron source having electron emission devices and targets exposed to the electrons emitted from said electron source and further comprising a first member within said hermetic container;

wherein said first member is provided with an uneven geometry at least on a part of its surface, such that total secondary electron emissions generated by irradiating said uneven geometry of said first member with electrons reflected from said targets is smaller than total secondary electron emissions generated in a case of irradiating a flat surface with electrons under same conditions.

19. An electron beam apparatus comprising a hermetic container which includes an electron source having electron emission devices and targets exposed to the electrons emitted from said electron source and further comprising a first member within said hermetic container, wherein said first member is provided with an uneven geometry at least on a part of its surface, said uneven geometry constituting of amplitudes of at least two kinds of unevenness and having an opening region which is not covered or closed.

20. An electron beam apparatus comprising a hermetic container which includes an electron source having electron emission devices and targets exposed to the electrons emitted form said electron source and further comprising a first member within said hermetic container, wherein said first member is provided with an uneven geometry at least on a part of its surface, said uneven geometry constituting of the cycles periods of at least two kinds of unevenness, such that total secondary electron emissions generated by irradiating said uneven geometry of said first member with electrons reflected from said targets is smaller than total secondary electron emissions generated in a case of irradiating a flat surface with electrons under same conditions.

21. An electron beam apparatus, comprising:

a hermetic container which includes an electron source having electron emission devices and targets exposed to electrons emitted from said electron source; and a first member within said hermetic container, wherein said first member is provided with an uneven geometry on at least a part of its surface, and said uneven geometry has multiple cycles, such that total secondary electron emissions generated by irradiating said uneven geometry of said first member with electrons reflected from said targets is smaller than total secondary electron emissions generated in a case of irradiating a flat surface with electrons under same conditions.

22. An electron beam apparatus, comprising:

a hermetic container which includes an electron source having electron emission devices and targets exposed to electrons emitted from said electron source; and a first member within said hermetic container, wherein said first member is provided with a random uneven geometry on at least a part of its surface, such that total secondary electron emissions generated by irradiating said uneven geometry of said first member with electrons reflected from said targets is smaller than total secondary electron emissions generated in a case of irradiating a flat surface with electrons under same conditions.

23. An electron beam apparatus comprising a hermetic container which includes an electron source having electron emission devices and targets exposed to electrons emitted from said electron source and further comprising a first member within said hermetic container, wherein said first member is provided with an uneven geometry on at least a part of its surface, the uneven geometry being substantially comprised of a plurality of depressions, wherein there is a multiplicity of cycles of said depressions and said depressions are not covered or closed.

24. An electron beam apparatus comprising a hermetic container which includes an electron source having electron emission devices and targets exposed to electrons emitted from said electron source and further comprising a first member within said hermetic container, wherein said first member is provided with an uneven geometry on at least a part of its surface, and the uneven geometry is substantially comprised of a plurality of depressions, wherein there is a multiplicity of amplitudes of said depressions and said depressions are not covered or closed.

25. An electron beam apparatus comprising a hermetic container which includes an electron source having electron emission devices and targets exposed to electrons emitted from said electron source and further comprising a first member within said hermetic container, wherein said first member is provided with an uneven geometry on at least a part of its surface, and the uneven geometry is substantially comprised of a plurality of depressions and is formed by multiplying one cycle of said depressions with random cycles of said depressions different from the one cycle.

* * * * *

UNITED STATES PATENT AND TRADEMARK OFFICE

CERTIFICATE OF CORRECTION

PATENT NO. : 6,809,469 B1
DATED : October 26, 2004
INVENTOR(S) : Ito et al.

It is certified that error appears in the above-identified patent and that said Letters Patent is hereby corrected as shown below:

Column 1,
Line 26, “the,” should read -- the --.
Lines 35 and 37, “et al.” should read -- et al., --.

Column 2,
Line 10, “cones,”” should read -- Cones,” --.
Line 13, “et al.” should read -- et al., --.

Column 3,
Line 24, “producer” should read -- producers --.
Line 61, “and” should be deleted.

Column 7,
Line 38, “(-tΣ)” should read -- $(-t_2/\tau)$ --.

Column 9,
Line 48, “∝0” should read -- ∝ --.

Column 12,
Line 49, “a” should read -- an --.

Column 15,
Line 51, “uneven,geometry” should read -- uneven geometry --.
Line 55, “is” should read -- are --.

Column 16,
Line 29, “an” should read -- a --.

Column 20,
Line 48, “on,its” should read -- on its --.

Column 21,
Line 63, “δ1>0,” should read -- -δ-1>0, --.

Column 22,
Line 41, “a” should read -- an --.

Column 23,
Line 62, “types” should read -- types of --.

Column 24,
Line 26, “form” should read -- from --.

UNITED STATES PATENT AND TRADEMARK OFFICE

CERTIFICATE OF CORRECTION

PATENT NO. : 6,809,469 B1
DATED : October 26, 2004
INVENTOR(S) : Ito et al.

It is certified that error appears in the above-identified patent and that said Letters Patent is hereby corrected as shown below:

Column 27,
Line 17, “ar” should read -- are --.
Line 56, “cross sectional” should read -- cross-sectional --.
Line 61, “an” should read -- a --.

Column 28,
Line 20, “right” should read -- light --.

Column 29,
Line 8, “and,the” should read -- and the --.
Line 63, “be also” should read -- also be --.

Column 31,
Line 40, “dud” should read -- and --.
Line 42, “$1x10^{-10}$” should read -- $1x10^{-5}$ --.
Line 43, “$1x10^{-10}$” should read -- $1x10^{-7}$ -- and “($1.3x10^{-5}$ to $1.3x10^{-4}$)” should read -- ($1.3x10^{-3}$ to $1.3x10^{-5}$) --.

Column 33,
Line 8, “and,” should read -- and --.
Line 46, “is” should read -- and are --.

Column 34,
Line 22, “1105” should read -- 1105) --.

Column 37,
Line 7, “is” should read -- are --.

Column 40,
Line 63, “maim” should read -- main --.

Column 41,
Line 39, “(this” should read -- (This --.
Line 45, “which” should read -- which an --.

Column 42,
Line 9, “beam” should read -- beams --.
Line 43, “more” should read -- in more --.

Column 43,
Line 15, “5000 ↑” should read -- 5000 Å --.

UNITED STATES PATENT AND TRADEMARK OFFICE

CERTIFICATE OF CORRECTION

PATENT NO. : 6,809,469 B1
DATED : October 26, 2004
INVENTOR(S) : Ito et al.

It is certified that error appears in the above-identified patent and that said Letters Patent is hereby corrected as shown below:

Column 45,
Line 11, “hours” should read -- hour --.

Column 47,
Line 3, “go” should read -- g0 --.
Line 44, “fine” should read -- fine- --.
Line 50, “go” should read -- g0 --.

Column 48,
Line 26, “prevent” should read -- present --.

Column 49,
Line 15, “F.” should read -- E. --.
Line 39, “omission” should read -- emission --.

Column 51,
Line 20, “$\delta$ - 1” should read -- $\delta = 1$ --.
Line 27, “has” should read -- have --.

Column 52,
Line 4, “$n_2$” should read -- $m_2$ --.

Column 55,
Line 8, “energy” should read -- energy, --.

Column 57,
Line 4, “form” should read -- from --.

Signed and Sealed this

Twenty-seventh Day of September, 2005

JON W. DUDAS
*Director of the United States Patent and Trademark Office*